US010315214B2

(12) United States Patent
Vogtner et al.

(10) Patent No.: US 10,315,214 B2
(45) Date of Patent: Jun. 11, 2019

(54) LIGHTED WATERFALL DEVICE WITH SPREADING MANIFOLD

(71) Applicant: Custom Molded Products, LLC, Newnan, GA (US)

(72) Inventors: Zachary T. Vogtner, Fayetteville, GA (US); Xiurong Smith, Newnan, GA (US)

(73) Assignee: Custom Molded Products, LLC, Newnan, GA (US)

( * ) Notice: Subject to any disclaimer, the term of this patent is extended or adjusted under 35 U.S.C. 154(b) by 0 days.

(21) Appl. No.: 15/884,531

(22) Filed: Jan. 31, 2018

(65) Prior Publication Data

US 2018/0147595 A1 May 31, 2018

Related U.S. Application Data

(63) Continuation-in-part of application No. 15/339,063, filed on Oct. 31, 2016, now Pat. No. 9,914,146, which (Continued)

(51) Int. Cl.

| | |
|---|---|
| ***B05B 17/00*** | (2006.01) |
| ***B05B 17/08*** | (2006.01) |
| ***F21S 10/02*** | (2006.01) |
| ***F21S 10/00*** | (2006.01) |
| ***F21S 8/00*** | (2006.01) |
| ***F21V 19/04*** | (2006.01) |

(Continued)

(52) U.S. Cl.

CPC ..... *B05B 17/085* (2013.01); *E04H 4/12* (2013.01); *E04H 4/148* (2013.01); *F21S 8/00* (2013.01); *F21S 10/002* (2013.01); *F21S 10/023* (2013.01); *F21V 19/04* (2013.01); *A61H 2033/0083* (2013.01); *A61H 2201/0188* (2013.01); *F21V 23/06* (2013.01); *F21W 2121/02* (2013.01); *F21W 2131/109* (2013.01); *F21W 2131/401* (2013.01); *F21Y 2103/10* (2016.08); *F21Y 2115/10* (2016.08)

(58) Field of Classification Search

CPC .... F21Y 2101/02; B05B 1/04; F21V 33/0004; F21V 33/06; F21V 33/004; F21W 2121/00; F21W 2121/02

USPC ..... 239/17, 18; 4/496, 407; 362/96

See application file for complete search history.

(56) References Cited

U.S. PATENT DOCUMENTS 4,786,139 A * 11/1988 Sedlmayr ..... G02B 6/04 156/158

4,974,779 A * 12/1990 Araki ..... G03B 21/608 239/18

(Continued)

*Primary Examiner* — Viet Le

(74) *Attorney, Agent, or Firm* — Laurence P. Colton; Smith Tempel Blaha LLC

(57) ABSTRACT

A low profile, lighted waterfall apparatus for producing a sufficiently lit artificial waterfall having a light source chamber, distal to a waterfall slot/primary outlet and substantially aligned on the same plane therewith, and a port for accessing the light source, such that the light source can be easily accessed, inserted, removed, and/or replaced. The light source chamber having a transparent, semi-transparent, or translucent divider to shine light towards and across the waterfall slot/primary opening via a spreading manifold/area/passage that is configured to spread the flowing water, and direct the water as a fluid wave guide towards the waterfall slot/primary outlet.

20 Claims, 43 Drawing Sheets

Related U.S. Application Data is a continuation-in-part of application No. 13/663,988, filed on Oct. 30, 2012, now Pat. No. 9,505,018.

(51) Int. Cl.

| | |
|---|---|
| ***E04H 4/14*** | (2006.01) |
| ***E04H 4/12*** | (2006.01) |
| *F21V 23/06* | (2006.01) |
| *F21W 121/02* | (2006.01) |
| *F21W 131/401* | (2006.01) |
| *F21Y 103/10* | (2016.01) |
| *F21Y 115/10* | (2016.01) |
| *A61H 33/00* | (2006.01) |
| *F21W 131/109* | (2006.01) |

(56) References Cited

U.S. PATENT DOCUMENTS 4,975,811 A * 12/1990 Fraser ..... F21S 8/00 239/18
5,249,744 A * 10/1993 Ruthenberg ..... B05B 1/044 239/17
5,309,581 A * 5/1994 Lockwood ..... E04H 4/14 239/590.3
5,430,825 A * 7/1995 Leaman ..... G02B 6/0008 359/900
5,642,534 A * 7/1997 Sanchez ..... E04H 4/1218 210/167.12
5,738,280 A * 4/1998 Ruthenberg ..... B05B 1/044 239/17
5,893,179 A * 4/1999 Johnson ..... B05B 17/085 4/507
6,076,741 A * 6/2000 Dandrel ..... E03C 1/0408 239/18
6,152,381 A * 11/2000 Hones ..... B05B 1/044 239/16
6,170,094 B1 * 1/2001 Weise ..... B05B 1/044 239/17
6,250,570 B1 * 6/2001 Starr ..... B05B 1/3426 239/17
6,257,497 B1 * 7/2001 Pham ..... B05B 7/02 239/12
6,347,750 B1 * 2/2002 Delettre ..... B05B 1/36 239/17
6,375,342 B1 * 4/2002 Koren ..... F21S 8/00 239/18
6,393,192 B1 * 5/2002 Koren ..... G02B 6/0006 239/12
6,450,418 B1 * 9/2002 Simpson ..... B05B 1/044 239/16
6,484,952 B2 * 11/2002 Koren ..... B05B 17/085 239/18
6,543,925 B2 * 4/2003 Kuykendal ..... F21S 10/005 239/18
6,578,774 B1 * 6/2003 Noyes ..... B05B 1/044 239/17
6,595,435 B1 * 7/2003 Cardenas ..... A61H 33/6063 239/17
6,595,675 B2 * 7/2003 Dongo ..... G02B 6/001 362/556
6,901,925 B2 * 6/2005 Coughlin ..... F24B 1/198 126/500
6,971,125 B2 * 12/2005 Mattson, Jr. ..... A61H 33/0087 210/167.11
7,200,879 B2 * 4/2007 Li ..... E04H 4/14 4/507
7,229,027 B2 * 6/2007 Ehresman ..... B05B 1/044 239/17
7,254,847 B2 * 8/2007 Kunkel ..... B05B 1/044 4/507
7,384,165 B2 * 6/2008 Doyle ..... B05B 15/00 362/101
7,654,471 B2 * 2/2010 Johnson ..... B05B 17/085 239/12
7,698,754 B2 * 4/2010 Kunkel ..... B05B 1/044 239/16
7,819,541 B2 * 10/2010 Kunkel ..... E03C 1/0404 239/18
7,861,942 B2 * 1/2011 Damon ..... B05B 17/085 239/16
8,070,075 B2 * 12/2011 Schmidt ..... B05B 1/04 239/16
8,522,372 B1 * 9/2013 Lafon ..... B05B 17/08 239/18
2001/0018776 A1 * 9/2001 Koren ..... B05B 1/044 4/507
2002/0074420 A1 * 6/2002 Koren ..... B05B 17/085 239/18
2003/0010836 A1 * 1/2003 Pham ..... B05B 1/3402 239/17
2005/0086733 A1 * 4/2005 Li ..... B05B 1/044 4/507
2005/0268393 A1 * 12/2005 Bergstrom ..... B05B 17/085 4/541.1
2006/0021127 A1 * 2/2006 Li ..... E04H 4/14 4/507
2006/0021128 A1 * 2/2006 Li ..... E04H 4/14 4/507
2007/0061957 A1 * 3/2007 Meincke ..... E04H 4/1236 4/507
2008/0034490 A1 * 2/2008 Li ..... A61H 33/6063 4/496
2010/0187325 A1 * 7/2010 Houstoun ..... B05B 17/085 239/17
2010/0187326 A1 * 7/2010 Paroonagian ..... E03C 1/0404 239/17
2010/0195309 A1 * 8/2010 Cieslak ..... B05B 1/044 362/96
2013/0206859 A1 * 8/2013 Sheridan ..... B05B 17/085 239/17
2014/0117107 A1 * 5/2014 Vogtner ..... B05B 17/085 239/18
2014/0151459 A1 * 6/2014 Sheridan ..... B05B 17/085 239/21

* cited by examiner

LIGHTED WATERFALL DEVICE WITH SPREADING MANIFOLD

STATEMENT OF RELATED APPLICATIONS

This patent application claims the benefit of and priority on U.S. patent application Ser. No. 15/339,063 having a filing date of 31 Oct. 2016, which claims the benefit of and priority on U.S. patent application Ser. No. 13/663,988 having a filing date of 30 Dec. 2012, currently pending.

BACKGROUND OF THE INVENTION

Technical Field

The present invention generally is in the field of devices for generating waterfalls, and more particularly is in the field of devices for generating aesthetically pleasing lighted waterfalls in spas, swimming pools, hot tubs, garden baths, and the like.

Prior Art

Few applications derive more benefit from the addition of waterfalls or fountains than artificial bodies of water such as spas, swimming pools, hot tubs, garden baths, and the like. The popularity of waterfalls and fountains in such structures is probably associated with the numerous aesthetic and practical applications that make waterfalls desirable. More specifically, the addition of a waterfall or fountain to an artificial body of water can provide a substantial decorative effect or can provide a relaxing background sound, generated from the water flow. As such, users and owners of artificial bodies of water often desire the addition of waterfalls or fountains.

Many existing waterfall apparatuses also include some type of lighting feature to add to the aesthetics of the device. In some existing waterfall apparatuses, the lighting feature is located near either the device or where water emanating from the device impacts the water in the artificial body of water. In such locations, the water itself often is not completely or sufficiently lighted. In other existing waterfall apparatuses, the lighting feature is located within the device so as to shine into the water as it emanates from the device. In such locations, the water can be more completely or more sufficiently lighted, but also often not completely or sufficiently lighted.

Moreover, in other existing waterfall apparatus, the light from an internal lighting feature is primarily guided by solid wave guides such as transparent and/or internally refractive solid materials. In such locations, although the water can be completely or sufficiently lighted, the entire device often is difficult to manufacture and assemble, more expensive in time and capital, and difficult to repair or customize at the point of installation. Also, in such devices, it can be difficult to replace malfunctioning lights, as the device typically is permanently embedded within a wall proximal to the artificial body of water.

Accordingly, there is a need for a lighted waterfall apparatus that allows for the addition of a lighted waterfall to an artificial body of water, such as a spa, swimming pool, hot tub, garden bath, or the like with a minimum of manufacturing and installation costs. There also is a need for such a lighted waterfall apparatus that provides satisfactory lighting to the water emanating from the waterfall apparatus. There is also a need for such a lighted waterfall apparatus to be able to be permanently integrated into a spa, swimming pool, hot tub, garden bath, or the like yet still allow for the simple and inexpensive replacement of the light generating components. There also is a further need for such a lighted waterfall apparatus that is easy to make, maintain, and customize without need of special skills, special materials, and special tools. It is to these needs and others that the present invention is directed.

BRIEF SUMMARY OF THE INVENTION

Briefly described, the present invention is a low profile, customizable, lighted waterfall apparatus that produces a waterfall into a spa, swimming pool, hot tub, garden bath, or the like, and that incorporates a removable and replaceable lighting unit so that, for example, the lighted waterfall apparatus can be permanently and discreetly mounted yet allow the simple replacement of the lighting unit. The present invention further comprises a front or waterfall producing end that can be customized to the shape of the wall into which the waterfall apparatus is mounted. Additionally, the present invention is a lighted waterfall apparatus that produces a lighted waterfall into a spa, swimming pool, hot tub, garden bath, or the like, that provides satisfactory lighting to the water emanating from the waterfall apparatus. In some embodiments of the invention, the lighting unit can be mounted proximal to where water emanates, namely mounted at the front facing side of the waterfall apparatus, without affecting the satisfactory lighting or ease-of-repair. In other embodiments of the invention, the lighting unit can be mounted distal to where water emanates, namely mounted at the rear side of the waterfall apparatus, without affecting the satisfactory lighting or ease-of-repair. In still other embodiments of the invention, the lighting unit and components are accessible and/or replaceable from the front (spa) side of the unit.

More specifically described, in a first exemplary embodiment, the present invention provides a structure and means for maintaining the lighting unit of a lighted waterfall apparatus by allowing the easy and quick removal of the lighting unit from waterfall apparatus without removing the lighted waterfall apparatus from the spa wall or having to access behind the spa wall. For simplicity, spa, swimming pool, hot tub, garden bath, or the like, and all such reservoirs and artificial bodies of water, together or separately will be referred to as spas or a spa.

A representative waterfall apparatus of the first exemplary embodiment is to provide for the addition of an aesthetically pleasing and decorative waterfall that flows into a spa. In the waterfall apparatus, water from a water source flows into the interior hollow or manifold of the waterfall apparatus and is discharged through a waterfall slot/primary outlet into the spa. A means for lighting the waterfall, and more particularly for lighting the water emanating from the waterfall apparatus, is contained within the waterfall apparatus proximal to the waterfall slot/primary outlet. Additionally, a means for accessing the means for lighting the waterfall is located at, on, or proximal to the front of the waterfall structure, preferably proximal to the waterfall slot/primary outlet, so as to allow easier access to the means for lighting. The means for accessing the means for lighting the waterfall can be a door or other covering to a chamber in which the means for lighting is retained. The chamber can have a transparent, semi-transparent, or translucent divider between the chamber and the waterfall slot/primary opening so as to allow the means for lighting to light the water emanating from the waterfall slot/primary opening yet be separated from the water in a "dry" zone.

The waterfall apparatus can be placed above the surface of the water in the spa on or proximal to the edge, preferably the upper edge, of the spa wall or within the spa wall above the water level of the spa so that the waterfall can be a smooth flow of falling water extending from the waterfall apparatus to the surface of the water in the spa.

A representative waterfall apparatus of the first embodiment of the present invention generally comprises an inlet, a primary outlet or waterfall slot, an interior manifold for holding and spreading water along the outlet, optional baffles to remove turbulence and debris from the water, a primary outlet for creating the waterfall, a chamber for the means for lighting the waterfall, and an access port to the chamber. When the waterfall apparatus is installed in the spa, the representative waterfall apparatus can appear as a generally continuous shaped structure with the waterfall slot/primary outlet in the center of the waterfall waterjet such that water emanates from the waterfall into the spa. When the means for lighting is on, light is directed to and lights the water emanating from the waterfall slot/primary outlet.

In one sub-embodiment of the first embodiment, the representative waterfall apparatus comprises a structure or set of structures for creating the waterfall and a chamber for the means for lighting, separated by a transparent, semi-transparent, or translucent divider so as to allow the chamber and the means for lighting to light to remain in a "dry" zone. In another sub-embodiment, the representative waterfall apparatus comprises a structure or set of structures for creating the waterfall and a chamber for the means for lighting with no divider so as to allow the water and the means for lighting to be in direct contact. The chamber has an access port accessible from the front, or spa side, of the waterfall apparatus to allow access to the means for lighting so as to allow removal and/or replacement of the means for lighting without having to otherwise remove or deal with the main structure of the waterfall apparatus.

In another sub-embodiment of the first embodiment, the means for lighting is a strip of light emitting diodes (LEDs) and the chamber is an elongated manifold lying proximal to the waterfall slot/primary outlet. In another sub-embodiment, the waterfall slot/primary outlet is an elongated horizontal opening and the chamber is an elongated horizontal manifold located above, behind, or below the waterfall slot/primary outlet. In another sub-embodiment, the waterfall slot/primary outlet is an elongated horizontal opening and the chamber is an elongated horizontal manifold located below the waterfall slot/primary outlet and separated from the waterfall slot/primary outlet by a transparent, semi-transparent, or translucent divider.

In use, the means for lighting can be inserted into and removed from the chamber via the access port on the front (spa) side of the apparatus. In this manner, if the means for lighting fails, the means for lighting can be easily replaced without disassembling the waterfall apparatus or the spa. Additionally, if a user decides to change the color of the means for lighting, a means for lighting of one color can be easily replaced with a means for lighting of another color without disassembling the waterfall apparatus or the spa.

The waterfall apparatus can be anchored to or contained within the wall or edge of a spa using any appropriate means as long as water can be fed into, and water can flow out of, the waterfall apparatus. In one embodiment, the waterfall apparatus may be contained within the spa wall, such as for example within a stone, brick, concrete, or other masonry spa wall. In this embodiment, the primary outlet would face the interior of the spa (the "wet" side) and the water inlet could face in a generally opposite direction towards the mechanical components of the spa (the "dry" side). This can be considered a more permanent installation of the waterfall apparatus. In another embodiment, the waterfall apparatus may be structured to have securing ends for securing the waterfall apparatus to the spa wall. In this embodiment, the waterfall apparatus can be installed with a minimum of disturbance to the surrounding spa. This can be considered a less permanent installation of the waterfall apparatus.

The waterfall apparatus can be used on almost any artificial water body. While the waterfall apparatus is described in connection with a spa, it is understood that the waterfall apparatus can be used on spas, swimming pools, tubs, and the like. For example, the waterfall apparatus can be placed on or proximal to the edge of a swimming pool so to provide a waterfall. One of ordinary skill in the art can modify the waterfall apparatus without undue experimentation so that it can be placed on almost any artificial water body.

In a second exemplary embodiment, with generally the same function as the first exemplary embodiment, the present invention provides a structure and means for positioning the lighting unit, and any chamber in which it is retained, away from the front of the waterfall structure, that is, distal to the waterfall slot/primary outlet, without affecting the satisfactory lighting or the ease-of-repair. A representative waterfall apparatus of the second exemplary embodiment comprises a means for lighting the waterfall, and more particularly for lighting the water emanating from the waterfall apparatus, that is contained within the waterfall apparatus but distal to the waterfall slot/primary outlet, namely at the back of the apparatus. The means for lighting is substantially laterally displaced from the waterfall slot/primary outlet. A means for accessing the means for lighting the waterfall remains located at, on, or proximal to the front of the waterfall structure, so as to allow easier access to the means for lighting, despite its distal/rearward positioning, opposite the waterfall slot/primary outlet, in this exemplary embodiment.

Moreover, the means for accessing the means for lighting the waterfall also is a door or other covering to the chamber in which the means for lighting is retained. The chamber, also distal to the waterfall slot/primary outlet, can have a transparent, semi-transparent, or translucent divider between the chamber and the water carrying passage towards the waterfall slot/primary opening. In this way, the means for lighting remains positioned to shine light towards the waterfall slot/primary opening in a way that sufficiently and adequately lights the water passing through the water carrying passage and emanating from the waterfall slot/primary opening, and allows for a lower profile visible portion of the waterfall slot/primary opening.

A representative waterfall apparatus of the second embodiment of the present invention generally comprises an inlet, a primary outlet or waterfall slot for creating the waterfall, an interior manifold for directing flowing water along the entire device, a spreading manifold or passage for spreading the flowing water as the water is flowing in a direction towards the primary outlet/waterfall slot, optional baffles to remove turbulence and debris from the water, a chamber for the means for lighting the waterfall, and an access port to the chamber. As the primary outlet/waterfall slot, the spreading manifold or passage, the means for lighting, and the chamber are substantially aligned on the same plane and as the means for lighting is oriented to direct light parallel to and in the direction of the passage towards the waterfall slot/primary opening, when the means for lighting is on, light is directed into the parallel streams of water and, therefore, into the water emanating from the waterfall slot/primary outlet.

Furthermore, as the means for lighting the waterfall is distal to and laterally displaced from the spreading manifold or passage and the waterfall slot/primary outlet, namely in a rearward position, when the waterfall apparatus is installed in the spa, the representative waterfall apparatus can appear to have an even thinner top to bottom or vertical profile and be more discreet. More specifically, in this second embodiment, there is no lighting chamber located below the waterfall outlet. Moreover, as the representative waterfall apparatus does not primarily rely on solid wave guide materials in the casing or built-in, instead primarily relying on the light being directed along the flow path of the water forming the waterfall, when the waterfall apparatus is being manufactured, assembled, machined, and/or customized at the point of installation, the representative waterfall apparatus benefits from being easy to make, maintain, and customize without need of special skills, special materials, special tools, etc.

In one sub-embodiment of the second embodiment, the representative waterfall apparatus comprises a transparent, semi-transparent, or translucent divider so as to allow the chamber and the means for lighting to light to remain in a "dry" zone. In another sub-embodiment, the representative waterfall apparatus comprises no divider so as to allow the stream of water and the means for lighting to be in more direct proximity/contact. In yet another sub-embodiment, the spreading manifold or passage comprises a structure or set of structures for creating turbulence in the stream of water flowing through the spreading manifold or passage thereby assisting in the spreading of the stream of water to a width corresponding to the waterfall slot/primary outlet. The chamber has an access port accessible from the front, or spa side, of the waterfall apparatus to allow access to the means for lighting so as to allow installation, removal, and/or replacement of the means for lighting without having to otherwise remove or deal with the main structure of the waterfall apparatus.

In another sub-embodiment of the second embodiment, the waterfall slot/primary outlet is a low profile, elongated horizontal opening and the chamber is an elongated, horizontal manifold running parallel to the horizontal opening and located distal to and laterally displaced from the waterfall slot/primary outlet. As the access chamber for the means for lighting and the manifold are an elongated structure, both the front end of the access chamber and the front end of the manifold, namely the ends proximal to the waterfall outlet, are free from operative parts and can be cut and shaped so as to correspond to the shape of the wall in which the waterfall apparatus is installed, or any other desired shaped extending outward from the wall in which the waterfall apparatus is installed, so as to provide for a more customized or aesthetic installation. In another sub-embodiment, the chamber is an elongated horizontal manifold separated from the spreading manifold or passage by a transparent, semi-transparent, or translucent divider. The remainder of the chamber (the remaining sides) can be generally opaque and/or reflective to direct as much light out of the divider and parallel to and in the direction of the passage towards the waterfall slot/primary opening.

In a third exemplary embodiment, with generally the same function as the second exemplary embodiment, the present invention provides a structure and means for quickly installing and replacing the lighting unit in the chamber in which it is retained. A representative waterfall apparatus of the third exemplary embodiment comprises a chamber for the lighting unit positioned distal to the waterfall slot/primary outlet. Like the second exemplary embodiment, the lighting unit is substantially laterally displaced from the waterfall slot/primary outlet and illuminates the water emanating from the waterfall apparatus by shining along the flow path of the water forming the waterfall. Moreover, the means for accessing the lighting unit/the chamber remains located at, on, or proximal to the front of the waterfall structure; however, the entire structure and configuration of the means for accessing facilitates an inventive process/method of installing or replacing the lighting unit of the low profile, customizable, lighted waterfall apparatus of the present invention.

Another representative waterfall apparatus of the third embodiment of the present invention generally provides a structure and means for quickly installing and replacing a removable and replaceable lighting unit in the rearward chamber. The lighted waterfall device has at least one specialized port. In a one-port embodiment, the port is situated laterally on one side of the waterfall device. In a two-port embodiment, is the ports are situated laterally on both sides of the lighted waterfall device. Each port has a port door as a means for accessing the lighting unit and electrical supply components and as a structure upon which the lighting unit or any other internal components can be engaged/retained for easy access. For example, the ports allow access to the lighting chamber and, via connecting pathways, form a generally U-shaped pathway from one port through the lighting chamber to the other port. Thus, both ports cooperate with the lighting chamber and allow access to the lighting chamber.

In one sub-embodiment of the third embodiment, the representative lighted waterfall device also has a power cord length management system comprising a retractable and extendable power cord, a power cord bundle/spool, a constriction component, a power cord collar, and a device/unit connector component. The entire port is structured and configured to retain and channel the power cord such that the power cord length management system may facilitate extension or retraction of the power cord out of the interior of the port. The power cord length management system also helps ensure that the unit connector end of the power cord remains within or proximate to the port and available for engagement with any other internal component. Thus, the power cord management system also is accessible through the front ports.

In another sub-embodiment of the third embodiment, the representative lighted waterfall device also has a pull-through system configured to extend through the specialized port and into or through the lighting chamber to facilitate insertion/repair/replacement of the lighting unit. If two ports are present, the pull-through system preferably extends from one port to the other port through the lighting chamber. The pull-through system may be engaged to the port cover or covers for easy retrieval and access.

In a fourth exemplary embodiment, with generally the same function as the third exemplary embodiment, the present invention provides another structure and means for quickly installing and replacing a removable and replaceable lighting unit situated in a rearward chamber. The lighted waterfall device has a specialized port with half on the left lateral side and half on the right lateral side allowing access to the rearward chamber and, via connecting pathways, forming a generally U-shaped pathway. Each lateral side of the specialized port each, respectively, comprises a port insertion structure capped on one end by an exemplary embodiment of a port door. The port insertion structures are each respectively configured as a means for accessing the lighting unit and electrical supply components and as a structure upon which the lighting unit or any other internal components can be engaged/retained for channeling into the port halves and for easy access.

In one sub-embodiment of the fourth embodiment, the representative lighted waterfall device has two matching port insertion structures complementary of the lateral port halves, which also are matching. The port insertion structures are configured to enter the port halves and engage snuggly therein so as to cap the port half. The port doors cap the end of the port half when the port insertion structures are engaged within their respective port halves. The end of the port insertion structure opposite the port door end is configured to retain and channel a power cord, and/or a portion of a lighting unit, within a port half, as the respective port insertion structure is inserted or removed from the interior of a respective port half. In this way, the port insertion structures help ensure that a unit connector end of a power cord remains within or proximate to the port halves and available for engagement with the lighting unit.

In another sub-embodiment of the fourth embodiment, the end of the port insertion structure opposite the port door end is configured to retain and channel a portion of a pull-through guide wire, within a port half, as the respective port insertion structure is inserted or removed from the interior of a respective port half. One end of the guide wire may be detachably engaged to one port insertion structure and the opposite end may be detachably engaged to the lighting unit (to help pull the lighting strip through the opposite port half into place within the rearward chamber) and/or the opposite port insertion structure (to remain easily retrievable and accessible when not attached to the lighting unit). In this way, the port insertion structures help ensure that a portion of the guide wire remains within or proximate to the port halves and available for engagement.

These features, and other features and advantages of the present invention will become more apparent to those of ordinary skill in the relevant art when the following detailed description of the preferred embodiments is read in conjunction with the appended drawings in which like reference numerals represent like components throughout the several views.

DETAILED DESCRIPTION OF THE PREFERRED EMBODIMENTS

Figure 1:
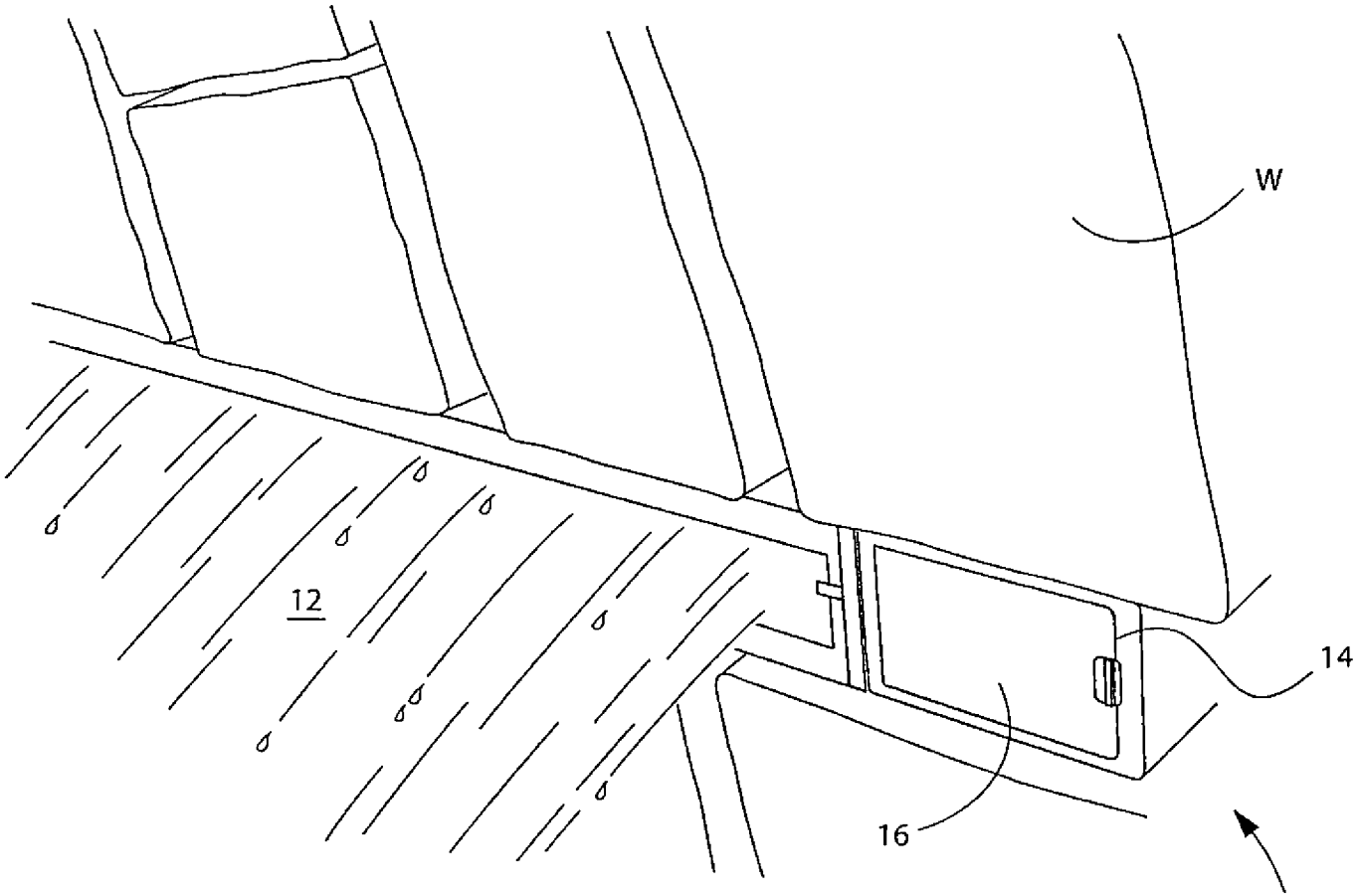
FIG. 1 is a top right perspective view of a first exemplary embodiment of the invention in operation as mounted in a stone wall and producing a waterfall.

Illustrative embodiments of a first exemplary embodiment of a lighted waterfall 10 according to the present invention are shown in FIGS. 1 through 11. FIG. 1 is a top right perspective view of the inventive lighted waterfall device 10 in operation as mounted in a stone wall W and producing a waterfall 12 of water. FIG. 1 also illustrates a representative placement of a first exemplary embodiment of a port 14 and port door 16, which is a means for accessing the means for lighting 18 the waterfall 12.

Figure 2A:
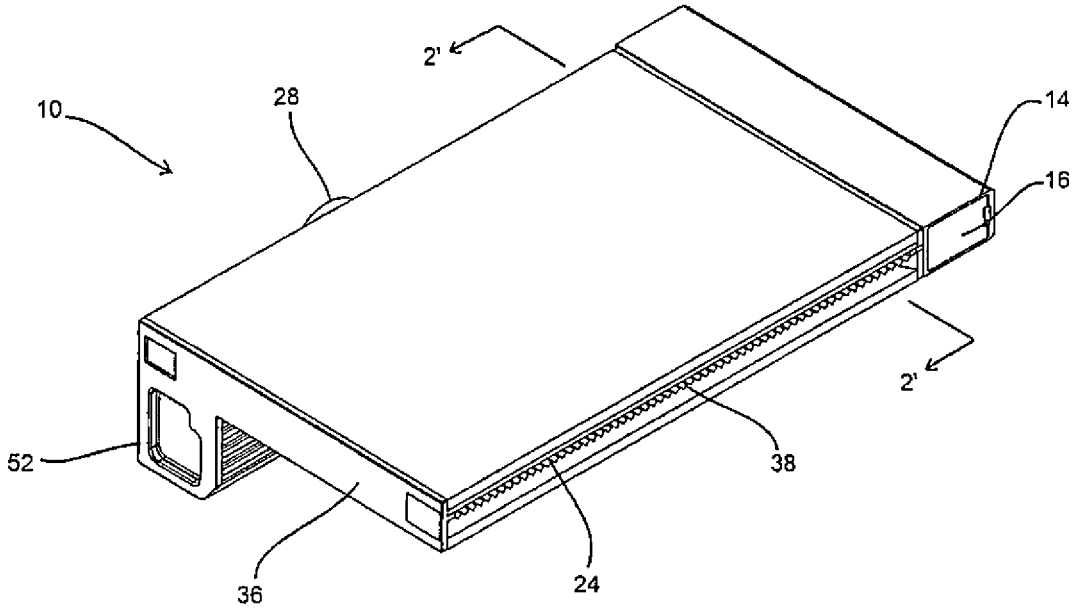
FIG. 2A is a top left perspective view of the exemplary embodiment of FIG. 1.
Figure 2B:
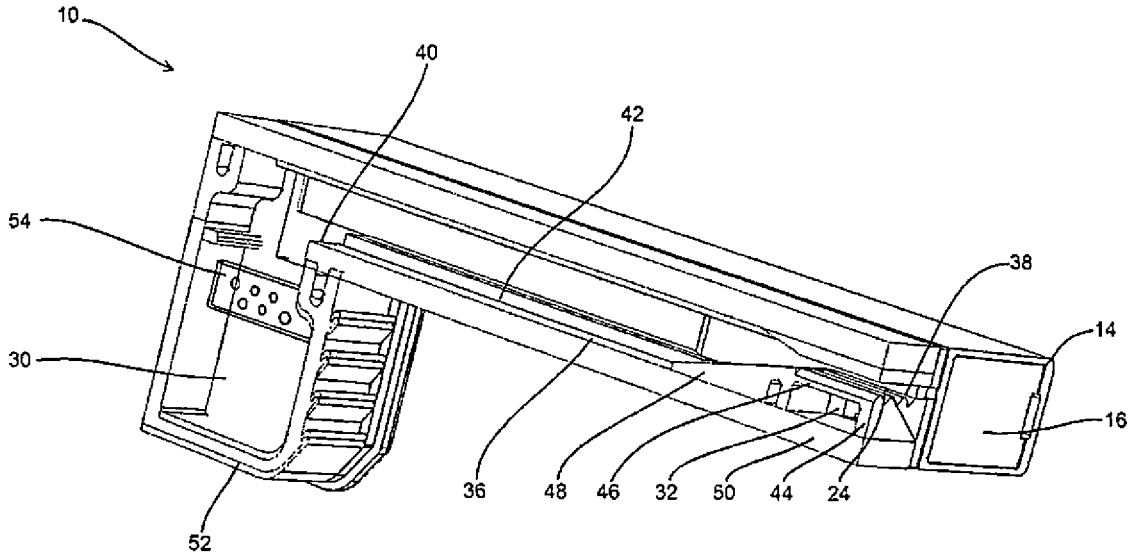
FIG. 2B is a left perspective cross section view of the exemplary embodiment of FIG. 1 through line 2'-2' of FIG. 2A.
Figure 2C:
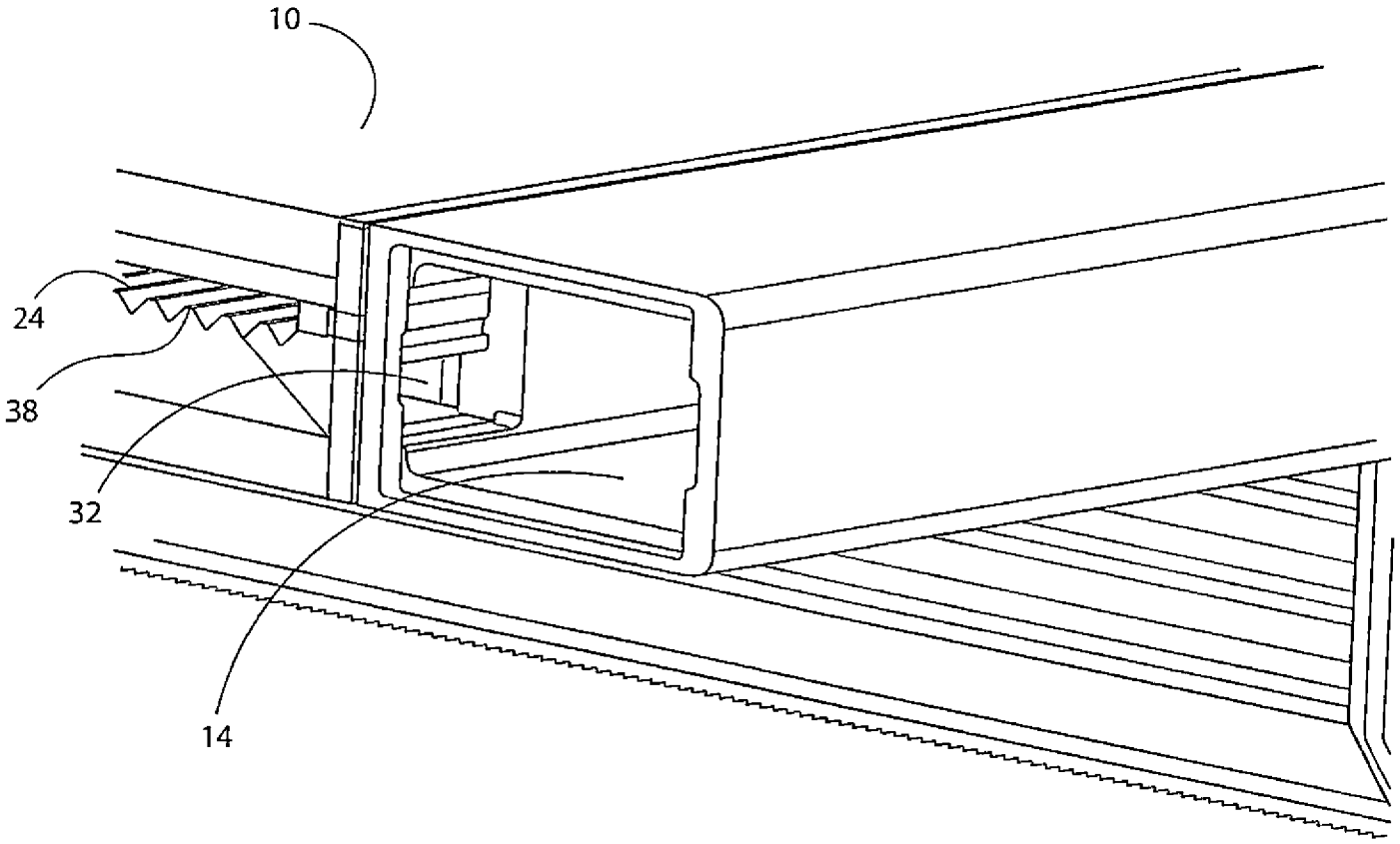
FIG. 2C is a right perspective view of the exemplary embodiment of FIG. 1 showing a detail of a portion of the interior of the invention.

FIG. 2A is a top left perspective view of the lighted waterfall device 10 and FIG. 2B is a left perspective cross section view of the lighted waterfall device 10 through line 2'-2' of FIG. 2A. FIG. 2C is a right perspective view of the lighted waterfall device 10 showing a detail of a portion of the interior of the lighted waterfall device 10.

Figure 3A:
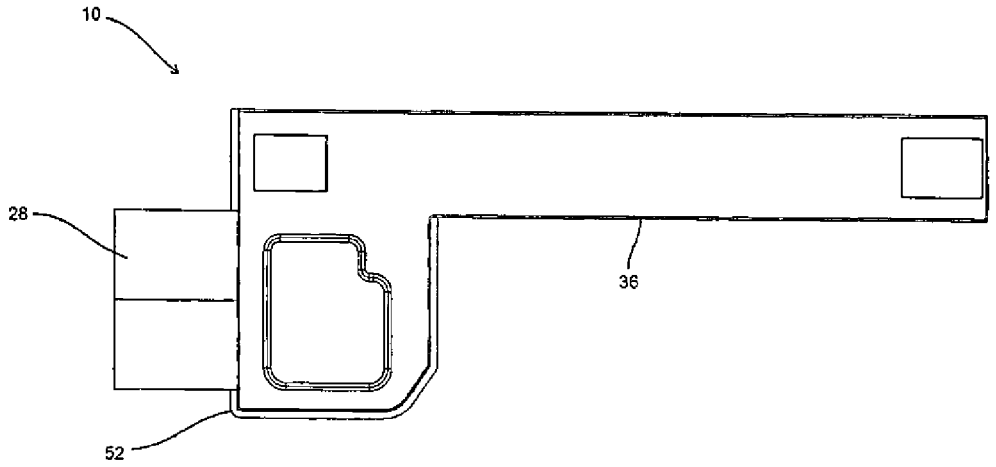
FIG. 3A is a left plan view of the exemplary embodiment of FIG. 1.
Figure 3B:
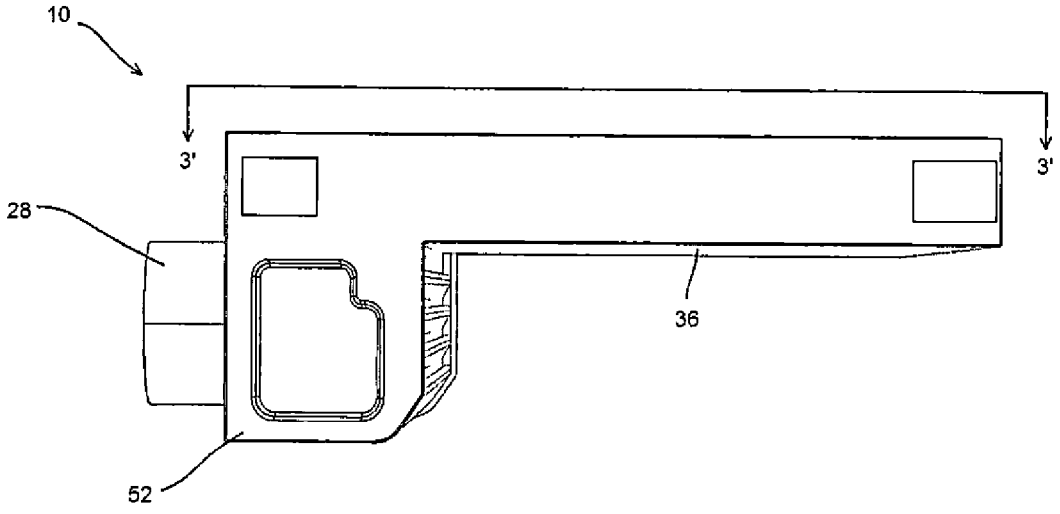
FIG. 3B is a left perspective view of the exemplary embodiment of FIG. 1.
Figure 3C:
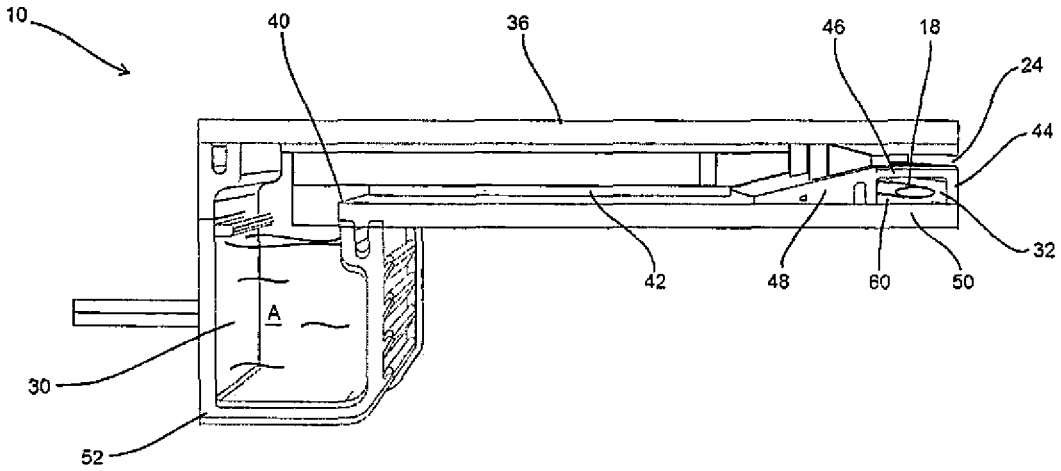
FIG. 3C is a left perspective cross section view of the exemplary embodiment of FIG. 1 through line 3'-3' of FIG. 3B.
Figure 4A:
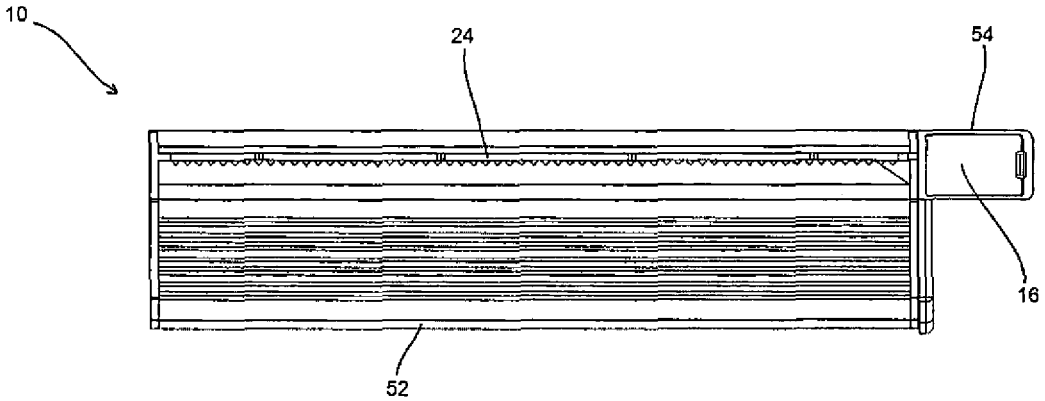
FIG. 4A is a front plan view of the exemplary embodiment of FIG. 1.
Figure 4B:
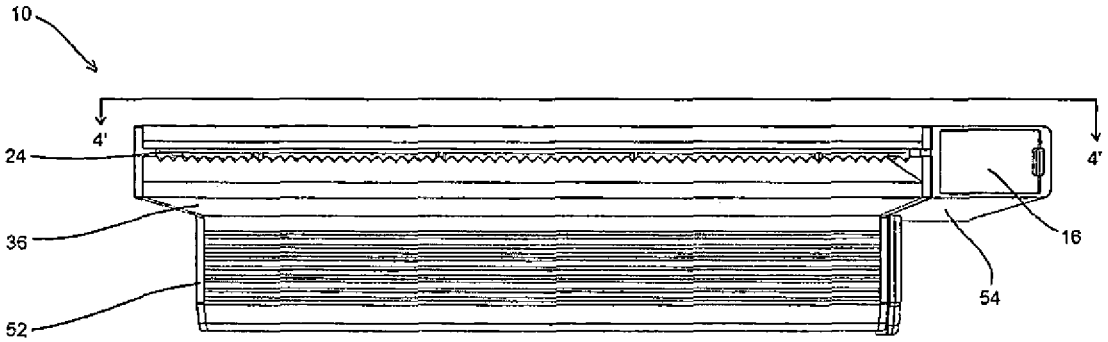
FIG. 4B is a front perspective view of the exemplary embodiment of FIG. 1.
Figure 4C:
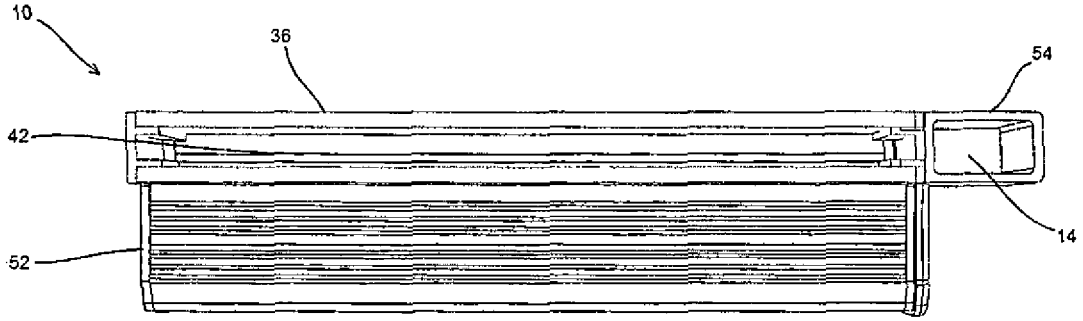
FIG. 4C is a front perspective view, partly in cross section, of the exemplary embodiment of FIG. 1 through line 4'-4' of FIG. 4B.
Figure 5A:
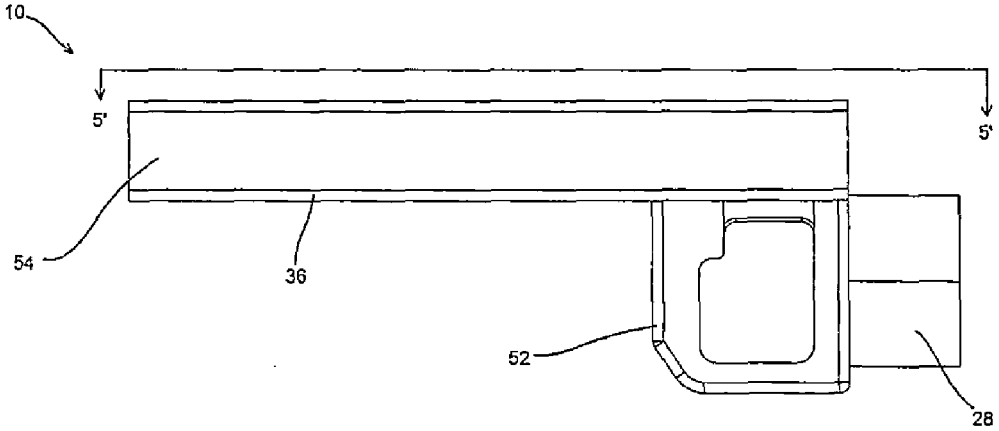
FIG. 5A is a right plan view of the exemplary embodiment of FIG. 1.
Figure 5B:
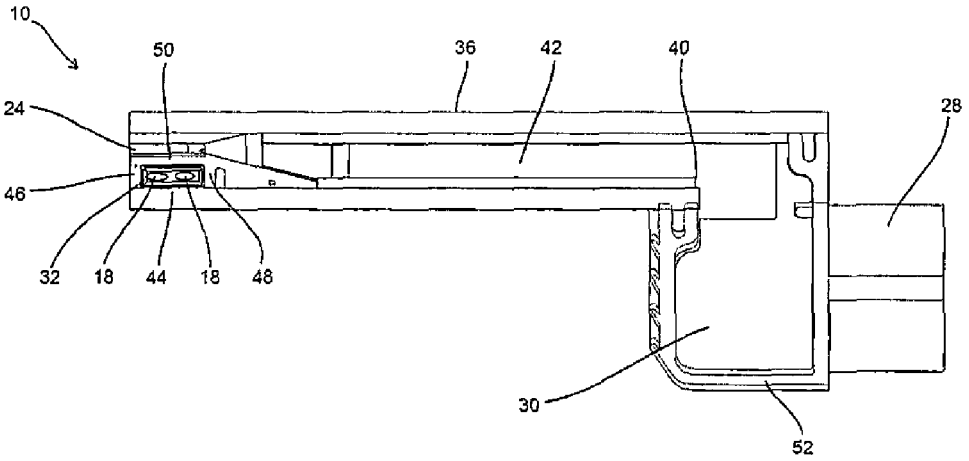
FIG. 5B is left cross section view of the exemplary embodiment of FIG. 1 through line 5'-5' of FIG. 5C.
Figure 5C:
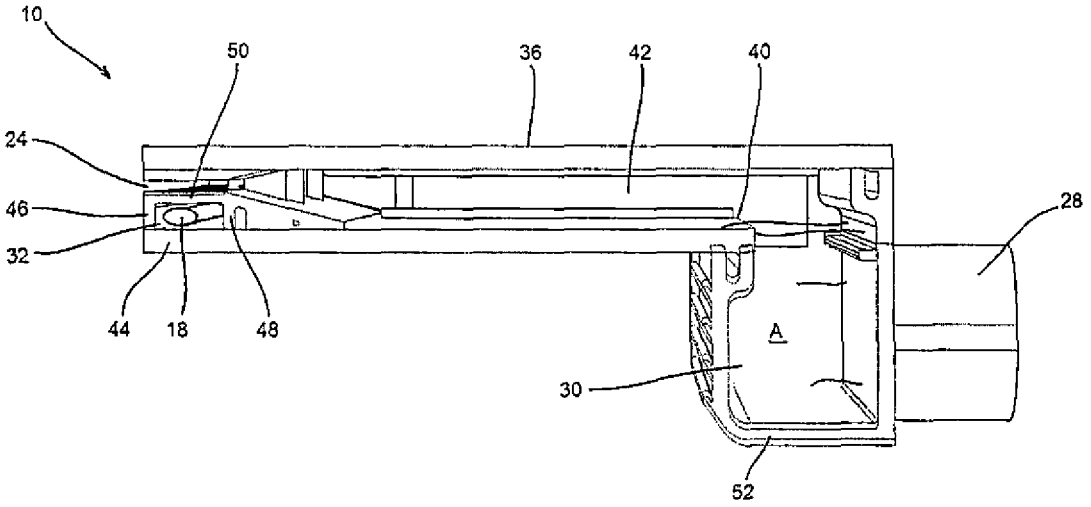
FIG. 5C is a left perspective cross section view of the exemplary embodiment of FIG. 1 as shown in FIG. 5B.

FIG. 3A is a left plan view and FIG. 3B is a left perspective view of the lighted waterfall device 10. FIG. 3C is a left perspective cross section view of the lighted waterfall device 10 through line 3'-3' of FIG. 3B. FIG. 4A is a front plan view and FIG. 4B is a front perspective view of the lighted waterfall device 10. FIG. 4C is a front perspective view, partly in cross section, of the lighted waterfall device 10 through line 4'-4' of FIG. 4B. FIG. 5A is a right plan view and FIG. 5B is left cross section view of the lighted waterfall device 10 through line 5'-5' of FIG. 5C. FIG. 5C is a left perspective cross section view of the lighted waterfall device 10 as shown in FIG. 5B.

Figure 6A:
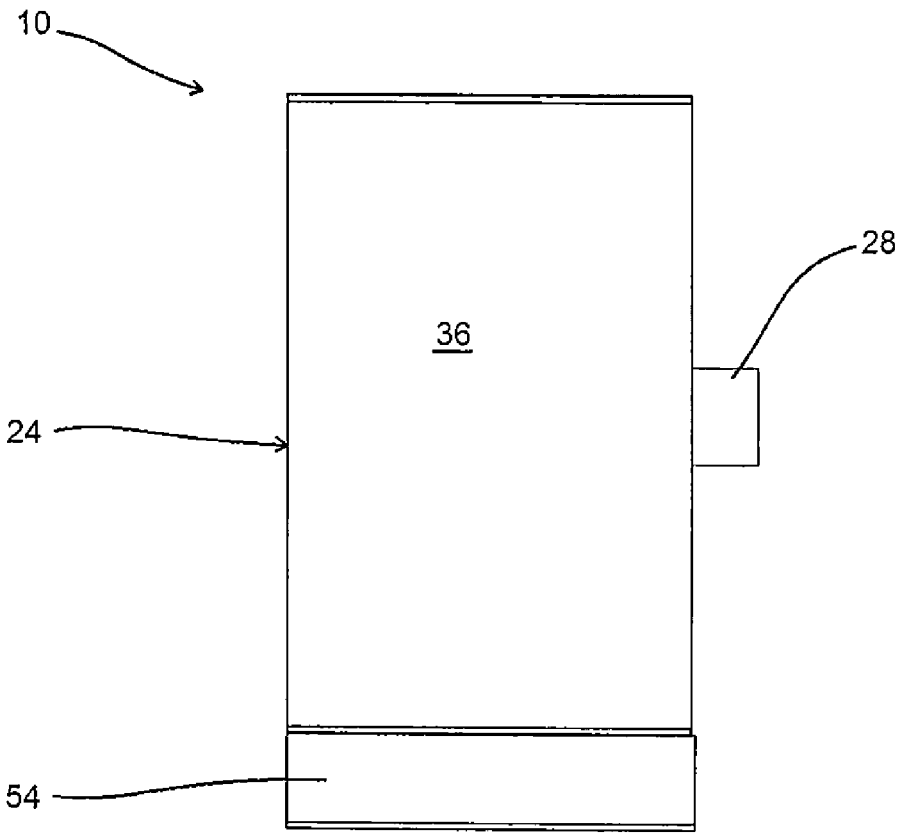
FIG. 6A is a top plan view of the exemplary embodiment of FIG. 1.
Figure 6B:
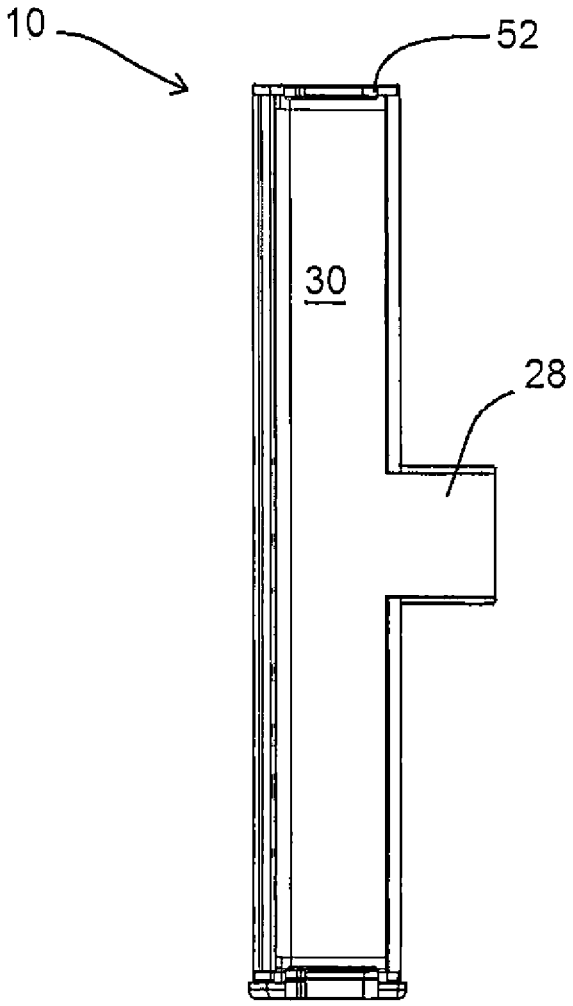
FIG. 6B is a top cross section view of the exemplary embodiment of FIG. 1 through line 6'-6' of FIG. 7A.
Figure 7A:
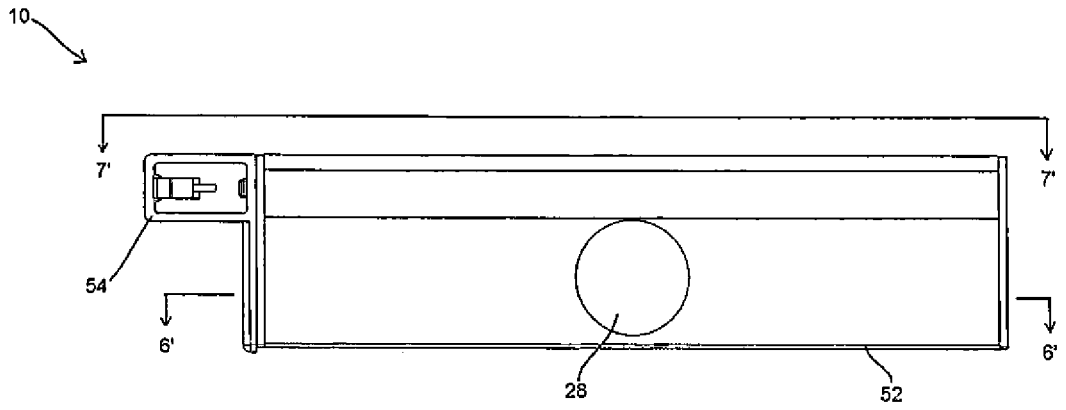
FIG. 7A is a rear plan view of the exemplary embodiment of FIG. 1.
Figure 7B:
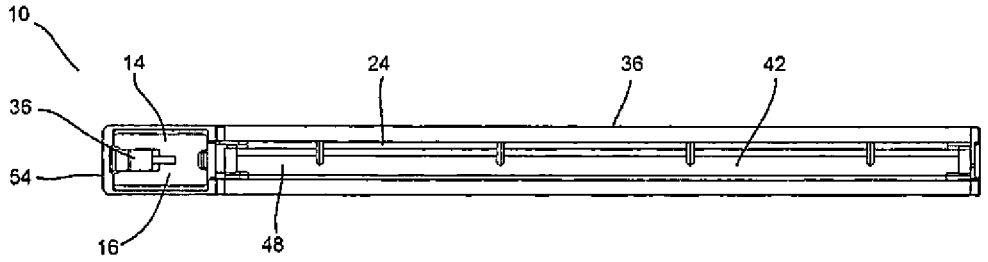
FIG. 7B is a rear cross section view of the exemplary embodiment of FIG. 1 through line 7'-7' of FIG. 7A.
Figure 7C:
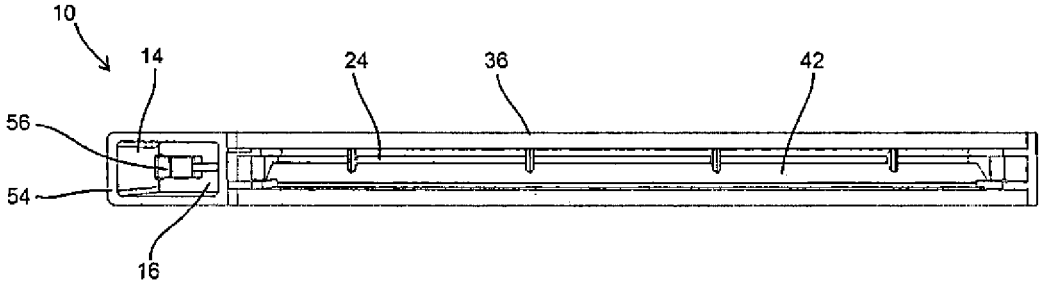
FIG. 7C is a rear perspective cross section view of the exemplary embodiment of FIG. 1 as shown in FIG. 7B.
Figure 8A:
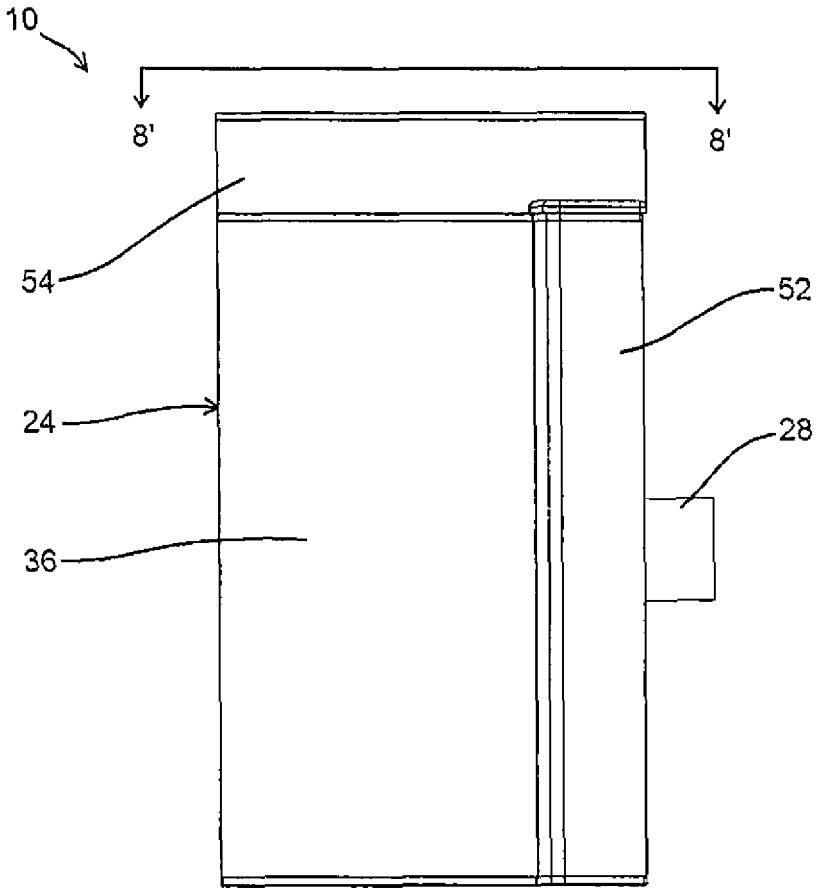
FIG. 8A is a bottom plan view of the exemplary embodiment of FIG. 1.
Figure 8B:
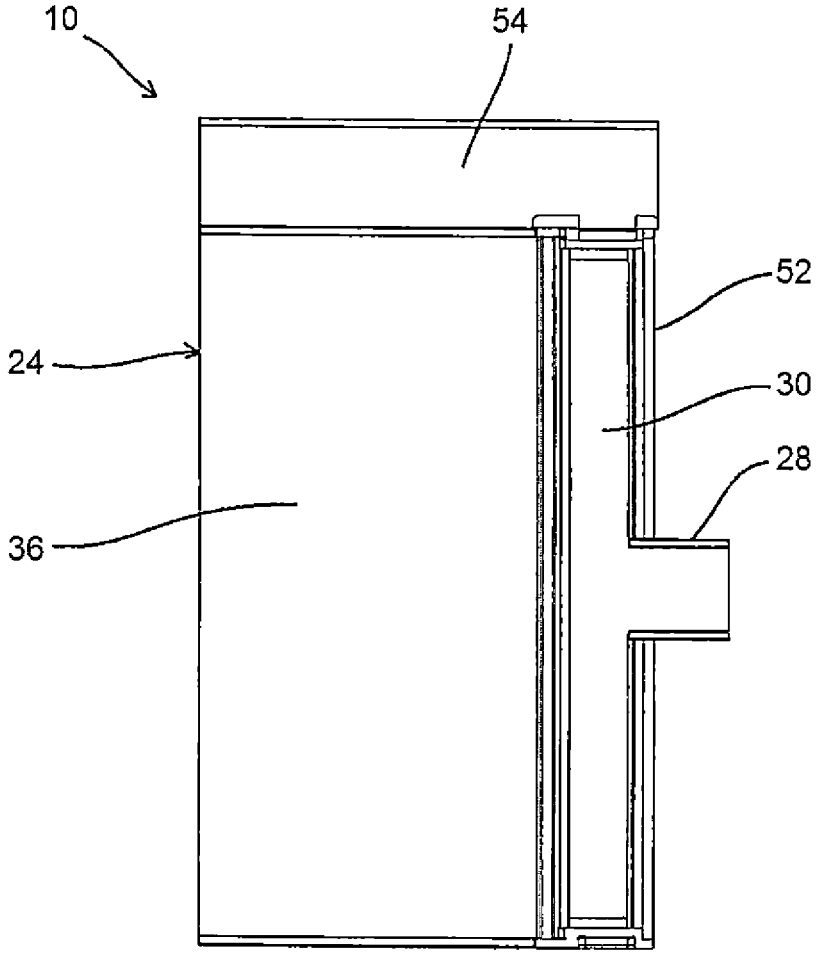
FIG. 8B is a bottom cross section view of the exemplary embodiment of FIG. 1 through line 8'-8' of FIG. 8A.
Figure 8C:
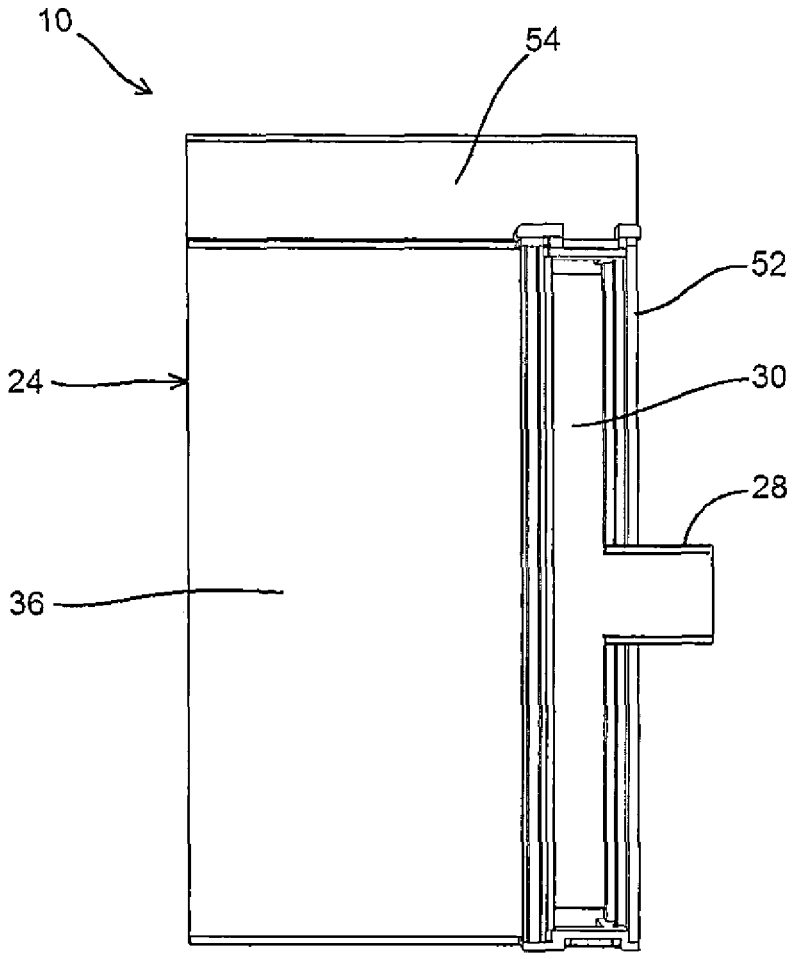
FIG. 8C is a bottom perspective cross section view of the exemplary embodiment of FIG. 1 as shown in FIG. 8B.

FIG. 6A is a top plan view and FIG. 6B is a top cross section view of the lighted waterfall device 10 through line 6'-6' of FIG. 7A. FIG. 7A is a rear plan view and FIG. 7B is a rear cross section view of the lighted waterfall device 10 through line 7'-7' of FIG. 6A. FIG. 7C is a rear perspective cross section view of the lighted waterfall device 10 as shown in FIG. 7B. FIG. 8A is a bottom plan view and FIG. 8B is a bottom cross section view of the lighted waterfall device 10 through line 8'-8' of FIG. 8A. FIG. 8C is a bottom perspective cross section view of the lighted waterfall device 10 as shown in FIG. 8B.

Figure 9:
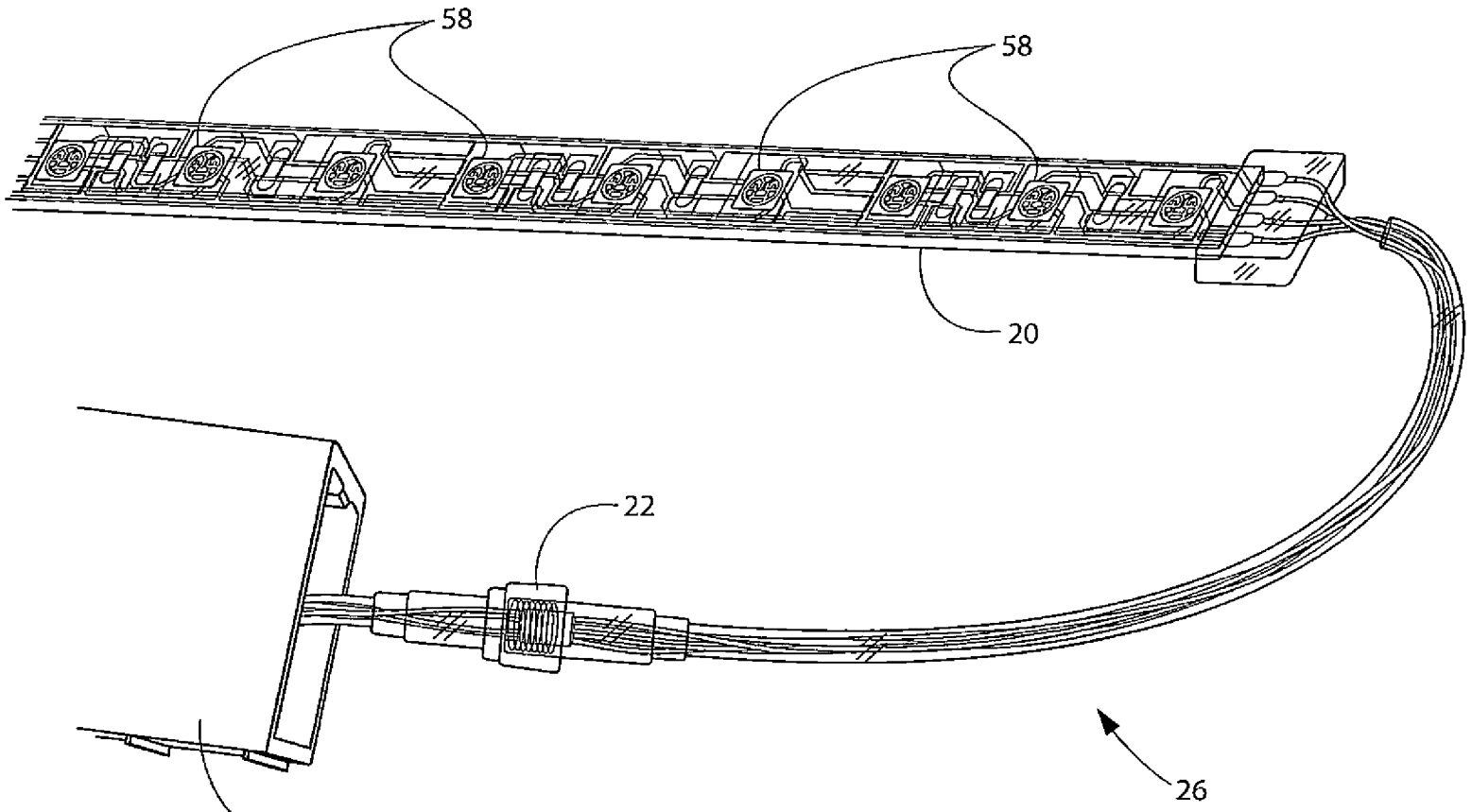
FIG. 9 is a top perspective view of a light emitting diode strip suitable for use with the invention.
Figure 10:
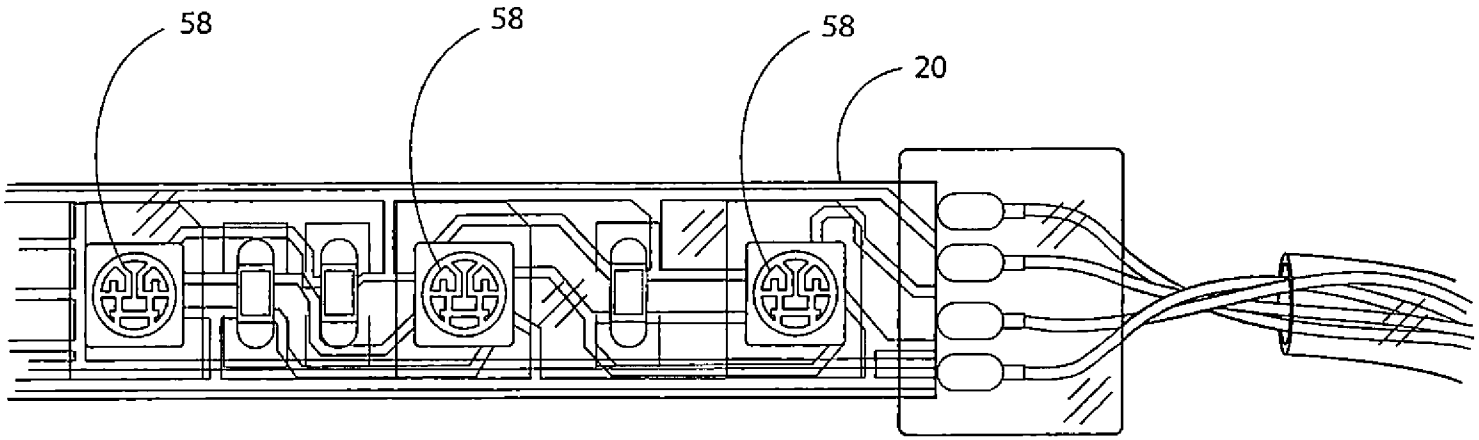
FIG. 10 is a top perspective view of a light emitting diode strip suitable for use with the invention shown in more detail.
Figure 11:
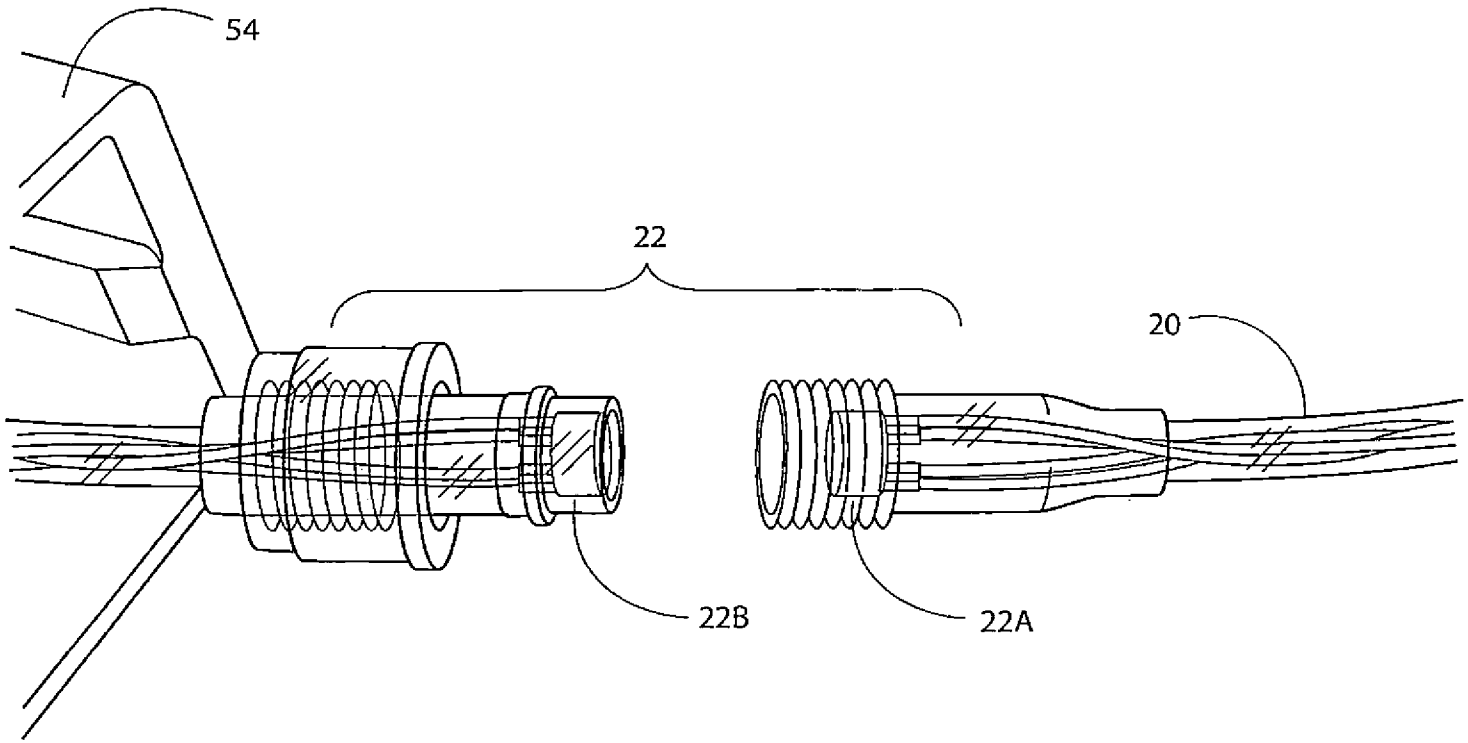
FIG. 11 is a side perspective view of a connector for electrically connecting the light emitting diode strip of FIG. 9 to the invention.

FIG. 9 is a top perspective view of a LED (light emitting diode) strip 20 suitable for use with the invention. FIG. 10 is a top perspective view of a LED strip 20 suitable for use with the invention shown in more detail. FIG. 11 is a side perspective view of a connector 22 for electrically connecting the LED strip 20 of FIG. 8 to the invention.

The lighted waterfall device produces a waterfall into a spa, swimming pool, hot tub, garden bath, or the like, together referred to herein as a spa S, and that incorporates a first exemplary embodiment of a removable and replaceable lighting unit 26 comprising LED strip 20 and connector 22 so that, for example, the lighted waterfall device 10 can be permanently mounted yet allow the simple replacement of the lighting unit 26. Additionally, the lighted waterfall device 10 produces a lighted waterfall 12 into the spa S that provides satisfactory lighting to the water emanating from the lighted waterfall device 10. In illustrative embodiments, the lighted waterfall device 10 comprises a structure and means for maintaining the lighting unit 26 by allowing the easy and quick removal of the lighting unit 26 from the lighted waterfall device 10, and therefore from the spa S, without removing the lighted waterfall device 10 from the wall W or having to access behind the wall W.

Referring now to FIG. 1, one illustrative embodiment of a lighted waterfall device 10 representative of the present invention is a lighted waterfall device 10 that can provide an aesthetically pleasing and decorative waterfall 12 into a spa S. In this embodiment, lighted waterfall device 10 can be installed on wall W of spa S. As disclosed in more detail herein, to generate the waterfall 12, water from a water source (not shown) flows into lighted waterfall device 10 and is discharged through a primary outlet in the form of waterfall slot 24 into spa S. The water from the water source (not shown) may be a municipal water source or recirculated water from the spa S. As lighted waterfall device 10 can be placed above the surface of the water of spa S on, in, or proximal to, for example, the upper edge of wall W of spa S, lighted waterfall device 10 also can function to fill spa S with water W (i.e., in a non-recirculating mode). As shown in FIG. 1, a representative lighted waterfall device 10 can be installed on or proximal to the edge of a spa S to provide for the addition of an aesthetically pleasing and decorative waterfall 12 that flows into the spa S.

FIG. 1 also illustrates a representative placement of the port 14 and port door 16, which is a means for accessing the means for lighting 18 the waterfall 12. As disclosed in more detail herein, port door 16 can be removed from port 14 allowing access to the interior of, or an interior chamber of, lighted waterfall device 10 to access, replace, remove, or insert the means for lighting 18. Embodiments of the lighted waterfall device 10 can be placed above the surface of the water in the spa S on the upper edge of the spa wall W or within the spa wall W above the water level of the spa S so that the waterfall 12 can be a smooth flow of falling water extending from the lighted waterfall device 10 to the surface of the water in the spa s.

Referring now to FIGS. 2-5, in representative embodiments of the lighted waterfall device 10, water flows through an inlet 28 into the interior hollow or manifold 30 of the lighted waterfall device 10 and is discharged through waterfall slot 24 into the spa S. Waterfall slot 24 can have at its exit to spa S a serrated edge 38 or floor to add turbulence to the waterfall 12 and to improve the lighting effect throughout the pattern of the waterfall 12. The serrated edge 38 or floor preferably is located at a position on the waterfall device 10 proximal to or at a front end of the waterfall device 10 such that the waterfall 12 that emanates from the waterfall slot 24 flows over the serrated edge 38 or floor. When the means for lighting 18 is not on, the serrated edge 38 can provide an aesthetically pleasing pattern to an unlit waterfall 12 by adding turbulence in a controlled manner, such as by creating a pattern in the waterfall 12. Similarly, when the means for lighting 18 is on, the serrated edge 38 can provide additional aesthetic enhancement to a lit waterfall 12 by dispersing light through the water flow pattern in the waterfall 12 created by the turbulence added in a controlled manner.

A spreading area 36 can be located between and fluidly connect manifold 30 and chamber 32. Spreading area 36 can serve at least two purposes. First, spreading area 36 can allow water flowing from manifold 30 to chamber 32 to spread evenly across spreading area 36 prior to emanating from waterfall slot 24 so as to produce a more even waterfall 12. Second, spreading area 36 can provide a connection through spa wall W such that the manifold section 52 portion of the lighted waterfall device 10 can be located on one side (the "dry side") of the spa wall W and accessible from the outside of the spa S, while the waterfall slot 24 can be located on another side (the "wet side") of the spa wall W and accessible from the inside of the spa S.

A means for lighting 18 (see FIGS. 9-11) the waterfall 12, and more particularly for lighting the water emanating from the lighted waterfall device 10, is contained within a chamber 32 in the lighted waterfall device 10 proximal to the waterfall slot 24. Additionally, a port 14 for accessing the means for lighting 18 is located at, on, or proximal to the front of the lighted waterfall device 10 structure, preferably proximal to the waterfall slot 24, so as to allow easier access to the means for lighting 24 located within chamber 32. The port cover 16 can be a door or other covering to chamber 32 in which the means for lighting 18 is retained. The chamber 32 can have a transparent, semi-transparent, or translucent divider between the chamber 32 and the waterfall slot 24 so as to allow the means for lighting 18 to light the waterfall 12 emanating from the waterfall slot 24 yet be separated from the waterfall 12 in a "dry" zone.

Referring now to FIG. 2A, a general configuration of an illustrative embodiment of the lighted waterfall device 10 is shown. Inlet 28 is on the rear of the lighted waterfall device 10 and waterfall slot 24 is on the front of the lighted waterfall device 10. At least a portion of spreading area 36 is located within spa wall W. Port 14 and port cover 16 are located to a side of waterfall slot 24, also on the front of the lighted waterfall device 10.

Referring now to FIG. 2B, the interior of a lighted waterfall device 10 is shown. Inlet 28 allows water to enter manifold 30 and to fill manifold. Optional baffles 34 can reduce turbulence in the water entering manifold 30 and trap debris for later removal. Once water in manifold 30 rises to the level of lip 40, water is generally evenly spread throughout manifold 30 and generally evenly flows over lip 40 into the interior of spreading area 36. Spreading area 36 comprises a passage 42 leading from manifold 30 to waterfall slot 24, the passage 42 being about the same as or greater than the height of waterfall slot 24, about the same as the width of waterfall slot 24, and about the same length as spreading area 36 such that water flowing from manifold 30 evenly flows through passage 42 to waterfall sot 24 and evenly flows out of waterfall slot 24 to form waterfall 12.

FIG. 2B also shows a preferred location of chamber 32, namely beneath waterfall slot 24. Chamber 32 is an elongated hollow chamber running about the entire width and at least a portion of the depth of waterfall slot 24. In this specification, the width of waterfall slot 24 is the dimension of waterfall slot 24 extending across the front of the lighted waterfall device 10, and the depth of waterfall slot 24 is the dimension of waterfall slot 24 extending from the front of lighted waterfall device 10 towards the back of lighted waterfall device 10. Chamber 32 is separated from the ambient in front of lighted waterfall device 10 by a front wall 44, is separated from waterfall slot 24 by a top wall 46, and is separated from passage 42 by a rear wall 48. Chamber 32 also has a bottom wall 50. Preferably, at least top wall 46 is made of a clear, transparent, translucent, or semi-transparent material such that light from the means for lighting 18 can travel through top wall 46 into water flowing through waterfall slot 24. Front wall 44 also may be made of a clear, transparent, translucent, or semi-transparent material such that light from the means for lighting 18 can affect waterfall 12 after emanating from waterfall slot 24. On one end, chamber 32 cooperates with port 14 so as to allow access to chamber 32 from port 14 (see FIG. 2C).

Referring now to FIG. 2C, a detail of a portion of the interior of the lighted waterfall device 10 illustrating the cooperation between chamber 32 and port 14 is shown. As can be seen, port 14 is an opening through the front of lighted waterfall device 10 allowing access to a portion of the interior of lighted waterfall device 10 including access to chamber 32. Through port 14, a means for lighting 18 can be inserted into or removed from chamber 32. A port cover 16 can be used to cover and close port 14.

Referring now to FIG. 3A, a general front structure is shown for a preferred embodiment of lighted waterfall device 10. Inlet 28, attached to the rear of lighted waterfall device 10, allows water to flow into the interior of the lighted waterfall device 10, namely, into manifold 30 located within manifold section 52. Extending frontwards from the manifold section is spreading area 36. Spreading area 36 terminates at the front of the lighted waterfall device, where waterfall slot 24 is located.

Referring now to FIG. 3B, another detail similar to FIG. 3A is shown, this time in perspective.

Referring now to FIG. 3C, a detail of a portion of the interior of the lighted waterfall device 10 is shown. Water A fills a portion of manifold 30. Once water in manifold 30 rises to the level of lip 40, water A flows over lip 40 and into the passage 42 in the interior of spreading area 36. Water A flows through passage 42 from manifold 30 to waterfall slot 24, and then flows out of waterfall slot 24 to form waterfall 12. As disclosed in more detail herein, light emanating from means for lighting 18 within chamber 32 illuminates water A as water A passes over top wall 46 (which also can be considered a bottom wall of waterfall slot 24), thus providing illumination to waterfall 12. In addition, at least some of the internal surfaces of chamber 32 can be coated with a reflective material 60 to increase the amount of light directed to waterfall 12. In this view, bottom wall 50 is coated with a reflective material 60 to help direct light up through top wall 46 or front wall 44, whichever or both are transparent, semi-transparent, or translucent, and into water or waterfall 12.

Referring now to FIG. 4A, a general left side structure is shown for a preferred embodiment of lighted waterfall device 10. Waterfall slot 24 extends generally the entire width of the lighted waterfall device 10, with the exception of the thickness of structure walls and of the port section 54. Manifold section 52 extends downward and port section 54 extends sidewards from the lighted waterfall device 10. Port cover 16 is shown covering port 14.

Referring now to FIG. 4B, a front perspective view of the lighted waterfall device 10 is shown for more detail of the structure. Waterfall slot 24 extends generally the entire width of the lighted waterfall device 10, with the exception of the thickness of structure walls and of the port section 54. Manifold section 52 extends downward from the rear of spreading area 36, and port section 54 extends sidewards from the front of, or just in front of, the side of spreading area 36. Port cover 16 is shown covering port 14.

Referring now to FIG. 4C, a detail of a portion of the interior of the lighted waterfall device 10 is shown. In this view, the interior of passage 42 and of port 14 is shown. Passage 42 provides for the generally free flow of water from manifold 30 through spreading area 36 to waterfall slot 24. Port 14 allows access to chamber 32.

Referring now to FIG. 5A, a general right side structure is shown for a preferred embodiment of lighted waterfall device 10. Inlet 28 extends rearward from the back of manifold section 52. Spreading area 36 extends frontward from the top of manifold section 52. Port section 54 extends sideward from the front of or just in front of spreading area.

Referring now to FIG. 5B, a detail of a portion of the interior of the lighted waterfall device 10 is shown. Water A fills a portion of manifold 30 over the level of lip 40, and begins to flow into the passage 42 in the interior of spreading area 36. Water A then will flow through passage 42 from manifold 30 to waterfall slot 24, and then flow out of waterfall slot 24 to form waterfall 12. As disclosed in more detail herein, light emanating from means for lighting 18 within chamber 32 illuminates water A as water A passes over top wall 46 (which also can be considered a bottom wall of waterfall slot 24), thus providing illumination to waterfall 12. In this view, two means for lighting 18 are shown in chamber 32. For example, a first means for lighting 18 can produce a steady light or a light of a first color, while a second means for lighting 18 can produce a blinking or pulsing light or a light of a second color. Chamber 32 can be structured to hold one, two, or more means for lighting.

Referring now to FIG. 5C, another detail similar to FIG. 5B of a portion of the interior of the lighted waterfall device 10 is shown, this time in perspective.

Referring now to FIG. 6A, a general top structure is shown for a preferred embodiment of lighted waterfall device 10. In this view, inlet 28 can be extending from the rear of lighted waterfall device 10, and port section 54 can be seen extending from a side of lighted waterfall device 10. Waterfall slot 24 is located on the front of lighted waterfall device 10. Although spreading area 36, and therefore a large section of lighted waterfall device 10, is shown as generally rectangular in cross section, this shape is illustrative only. Other shapes, such as squares, ovals, trapezoids, and other geometric shapes can be suitable depending on the aesthetics desired or the shape and structure of the spa S or the spa wall W.

Referring now to FIG. 6B, a detail of a portion of the interior of the lighted waterfall device 10 is shown, specifically showing the interior of manifold 30 and inlet 28. As can be seen, inlet 28 leads to and is fluidly connected to manifold 30 such that water can flow directly from a water source through inlet 28 to manifold 30.

Referring now to FIG. 7A, a general rear structure is shown for a preferred embodiment of lighted waterfall device 10. In this view, inlet 28 can be extending from the rear of lighted waterfall device 10, specifically from the rear of manifold section 52, and port section 54 can be seen extending from a side of lighted waterfall device 10. Although manifold section 52, and therefore a large section of lighted waterfall device 10, is shown as generally rectangular in cross section, this shape is illustrative only. Other shapes, such as squares, ovals, trapezoids, and other geometric shapes can be suitable depending on the aesthetics desired or the shape and structure of the spa S or the spa wall W.

Referring now to FIG. 7B, a detail of a portion of the interior of the lighted waterfall device 10 is shown, specifically the interior of spreading area 36, namely, passage 42. In this view, which is from the rear of the lighted waterfall device 10 looking through passage 42 and out through waterfall slot 24, the narrowing of passage 42 caused by rear wall 48 of chamber 32 can be seen. This gives rise to a waterfall slot 24 that is narrower, that is, has a smaller height, that the height of passage 42. The rise in passage 42 due to the presence of rear wall 48 also helps to create a more uniform waterfall 12 as water can build up evenly behind and along rear 48 wall and therefore overflow rear wall 48 more evenly prior to flowing through waterfall slot 24. In other embodiments, waterfall slot 24 can be the same height as or have a larger height than the height of passage 42. Port cover 16 can be seen in port section 54, in this view comprising a latch 56 for securing port cover closed across the front opening of port 14.

Referring now to FIG. 7C, another detail similar to FIG. 7B of a portion of the interior of the lighted waterfall device 10 is shown, this time in perspective.

Referring now to FIG. 8A, a general bottom structure is shown for a preferred embodiment of lighted waterfall device 10. In this view, inlet 28 can be extending from the rear of lighted waterfall device 10, specifically from the rear of manifold section 52, and port section 54 can be seen extending from a side of lighted waterfall device 10, specifically from a side of spreading section 36. Waterfall slot 24 is located on the front of lighted waterfall device 10.

Referring now to FIG. 8B, a detail of a portion of the interior of the lighted waterfall device 10 is shown, specifically showing the interior of manifold 30 and inlet 28. As can be seen, inlet 28 leads to and is fluidly connected to manifold 30 such that water can flow directly from a water source through inlet 28 to manifold 30.

Referring now to FIG. 8C, another detail similar to FIG. 8B of a portion of the interior of the lighted waterfall device 10 is shown, this time in perspective.

Referring now to FIGS. 9-11, in one embodiment, the means for lighting 18 is a LED strip 20 of light emitting diodes (LEDs). LED strip 20 can comprise at least one and preferably a plurality of individual LEDs 58 so as to provide more uniform light across the waterfall 12. By using an LED strip 20, the LED strip 20 can be selected or cut to be of a desired length, such as the length of the chamber 32. In this manner, different lengths LED strips 20 can be used for different sized lighted waterfall devices 10.

Referring now to FIG. 9, a representative LED strip 20 is shown comprising a plurality of LEDs 58. At one end of LED strip 20 is a connector 22 for connecting the LED strip 20 to an electrical source for powering the LEDs 58. The connector 22 is convenient in that it allows the LED strip 20 to be connected to and disconnected from the lighted waterfall device 10 for ease of removal and replacement. If a user needs to replace a defective LED strip 20 with a new LED strip 20, or to replace a LED strip 20 of one color of LEDs 58 for a LED strip 20 of another color of LEDs 58, all the user needs to do is to disconnect the connector 22, remove the first LED strip 20, insert the new LED strip 20, and connect the connector 22.

Referring now to FIG. 10, an enlarged view of LED strip 20 is shown for additional detail.

Referring now to FIG. 11, an enlarged view of a representative connector 22 is shown, with strip connector 22A being part of the LED strip 20 and device connector 22B being attached to the lighted waterfall device 10.

Preferably, chamber 32 is segregated from the remainder of the interior of the lighted waterfall device 10 such that the interior of chamber 32 remains dry. Although this is not a requirement as there are waterproof LED strips 20 and waterproof connectors 22, it is more convenient as both waterproof and non-waterproof LED strips 20 and connectors 22 can be used.

Thus, a representative lighted waterfall device 10 of the present invention generally comprises an inlet 28, a primary outlet or waterfall slot 24, an interior manifold 30 for holding and spreading water along the waterfall slot 24, a chamber 32 for the means for lighting 18 the waterfall 12, and an access port 14 to the chamber 32. When the lighted waterfall device 10 is installed in the spa S, the lighted waterfall device 10 can appear as a generally continuous shaped structure with the waterfall slot 24 generally in the center of the lighted waterfall device 10 such that water emanates from the lighted waterfall device 10 into the spa S. When the means for lighting 18 is on, light is directed to and lights the waterfall 12 emanating from the waterfall slot 24.

Lighted waterfall device 10 provides an aesthetically pleasant waterfall 12 into spa S. As lighted waterfall device 10 preferably is located above the water surface of spa S on, for example, wall W of spa S, waterfall 12 can provide a smooth flow of falling water extending from lighted waterfall device 10 to the water surface of spa S. For aesthetic reasons waterfall 12 can be substantially smooth over its width and over its length as it flows into the water of spa S. More particularly, waterfall 12 from lighted waterfall device 10 preferably is free of bubbles and ripples and flows as a generally continuous sheet of water. The preferred structure of the lighted waterfall device 10 helps accomplish this by having a manifold 30 and a rear wall 48 interrupting passage 42, both of serve to even the flow of water through and over waterfall slot 24.

The lighted waterfall device 10 can be anchored to or contained within the wall W or edge of a spa S using any appropriate means as long as water is fed into, and water can flow out of, the lighted waterfall device. In one embodiment, the waterfall apparatus may be contained within the spa wall W, such as within a concrete or stone spa wall W. In this embodiment, the waterfall sot 24 would face the interior of the spa (the "wet side") and the inlet 28 could face in a generally opposite direction towards the mechanical components of the spa (the "dry side"). This can be considered a more permanent installation of the lighted waterfall device 10. In another embodiment, the lighted waterfall device 10 may be structured to have securing ends for securing the lighted waterfall device to the spa wall W. In this embodiment, the lighted waterfall device 10 can be installed with a minimum of disturbance to the surrounding spa S. This can be considered a less permanent installation of the lighted waterfall device 10. In any type of installation, it is preferable to have the port 14 facing into the spa S, or at least accessible from the spa S, so as to take advantage of the port 14 and the simple and convenient insertion and removal of the means for lighting 18.

The lighted waterfall device 10 can be used on almost any artificial water body. While the lighted waterfall device 10 is described in connection with a spa S, it is understood that the lighted waterfall device 10 can be used on spas, swimming pools, tubs, and the like. For example, the lighted waterfall device 10 can be placed on or proximal to the edge of a swimming pool so to provide a waterfall 12. One of ordinary skill in the art can modify the lighted waterfall device 10 without undue experimentation so that it can be placed on almost any artificial water body.

As prior art waterfall apparatuses typically are unitary devices with the individual parts having been glued, welded, or otherwise adhered together, access to the interior of such prior art waterfall apparatuses often is impossible or at least very difficult. Therefore, the removable port cover 16 and the convenient placement of port 14 in an easy to reach location on the front of the lighted waterfall device 10 of the present invention allows for access to, insertion of, removal of, and replacement of the means for lighting 18, such as LED strip 20, that otherwise may not be possible in prior art waterfall apparatuses. For example, the means for lighting in prior art waterfall apparatuses may be permanently anchored in such devices, and inaccessible to a user. If the means for lighting in prior art waterfall apparatuses fail, or a user desires to change the means for lighting in prior art waterfall apparatuses, it may be impossible to remove or replace the means for lighting without significant deconstruction or destruction of the prior art waterfall apparatus or the spa.

In use, the means for lighting 18 can be inserted into and removed from the chamber 32 via the port 14. Specifically, a user can remove the port cover 16 to access the port 14. The means for lighting 18 is readily accessible through the port 14, and the user can grasp the mean for lighting 18, pull the means for lighting 18 out of the chamber 32, and disconnect the means for lighting via connector 20. The user then can insert a new or different means for lighting in the chamber 32 via the port 14, connect the connector 20, and close the port 14 using the port cover 16. In this manner, if the means for lighting 18 fails, the means for lighting 18 can be easily replaced without disassembling the lighted waterfall device 10, the spa S, or the spa wall W. Additionally, if a user decides to change the color of the means for lighting 18, a means for lighting 18 of one color can be easily replaced with a means for lighting 18 of another color without disassembling the lighted waterfall device 10, the spa S or the spa wall W. LED strips 20 of various lengths can be inserted into the chamber 32, irrespective of the length of the chamber 32. For example, if a user desires to illuminate only a portion of a waterfall 12, the user can insert a LED strip 20 of a length shorter than the chamber 32, and thus shorter than the waterfall slot 24.

The shape of waterfall 12 can be modified by the configuration of waterfall slot 24. For example, if waterfall slot 24 is a regular uninterrupted slit, a relatively smooth waterfall 12 over its length and width can be generated. Alternatively, if divisions or interruptions are introduced into the waterfall slot 24, or waterfall slot 24 has a non-linear shape, waterfall 12 can have a sprinkler type shape or a scalloped shape, which is not a smooth shaped waterfall. One of ordinary skill in the art can modify waterfall slot 24 so that lighted waterfall device 10 will produce a waterfall 12 of a desired shape. The shape of chamber 32 preferably is structured to parallel or mirror the shape of the waterfall slot 24 to provide a satisfactory amount of illumination to the waterfall 12.

With regard to allowing the light from the means for lighting 18 to act upon the water and the waterfall 12, as disclosed herein, at least top wall 46 and/or front wall 44, or any other wall between means for lighting 18 and water flowing through waterfall slot 24 or waterfall 12, preferably is transparent, semi-transparent, translucent, or conducts light in some manner to water flowing through waterfall slot 24 or waterfall 12.

As aesthetic alternatives, chamber 32 can be structured to hold at least two means for lighting 18, such as at least two LED strips 20 to generate an illuminated waterfall 12 of more than one color or more than one pattern of light. For example, a first LED strip can produce a steady light or a light of a first color, while a second LED strip 20 can produce a blinking or pulsing light or a light of a second color. Alternatively or in addition, at least some of the internal surfaces of chamber 32 can be coated with a reflective material to increase the amount of light directed to waterfall 20.

Lighted waterfall device 10 can be manufactured from relatively inexpensive materials. For example, lighted waterfall device 10 can be formed of plastics, metal, or other materials. Preferably, lighted waterfall device 10 can be formed from molded or forged parts made from a plastic material as such material will not rust from the exposure to water, particularly chlorinated water. Such plastics, metals, and other materials are known in the art. Alternatively, for more elegant or expensive installations, at least portions of lighted waterfall device 10 can be made of more elegant or expensive materials, such as gold, silver, pewter, crystal, and the like.

Figure 12A:
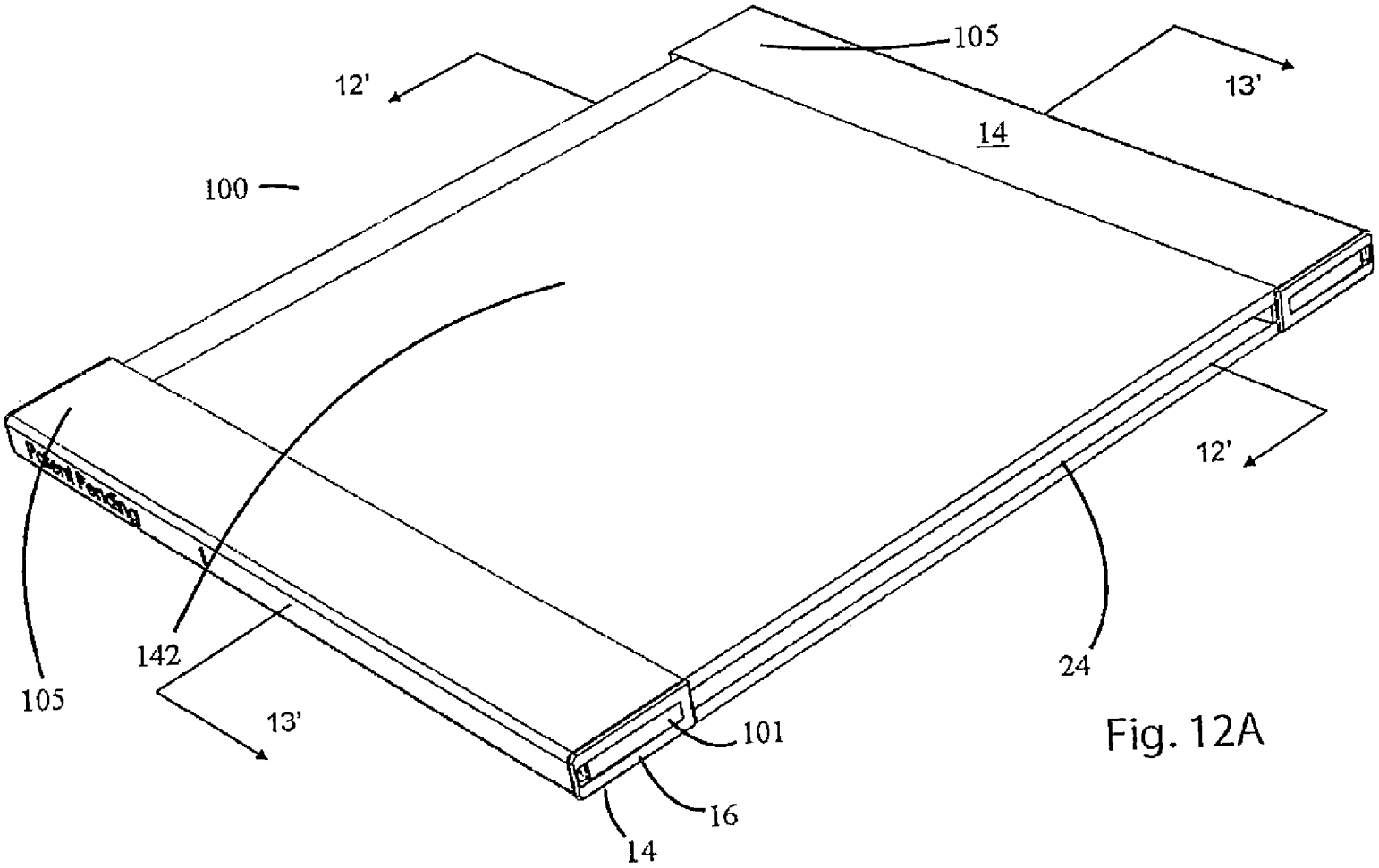
FIG. 12A is a top left perspective view of a second exemplary embodiment of the invention.
Figure 12B:
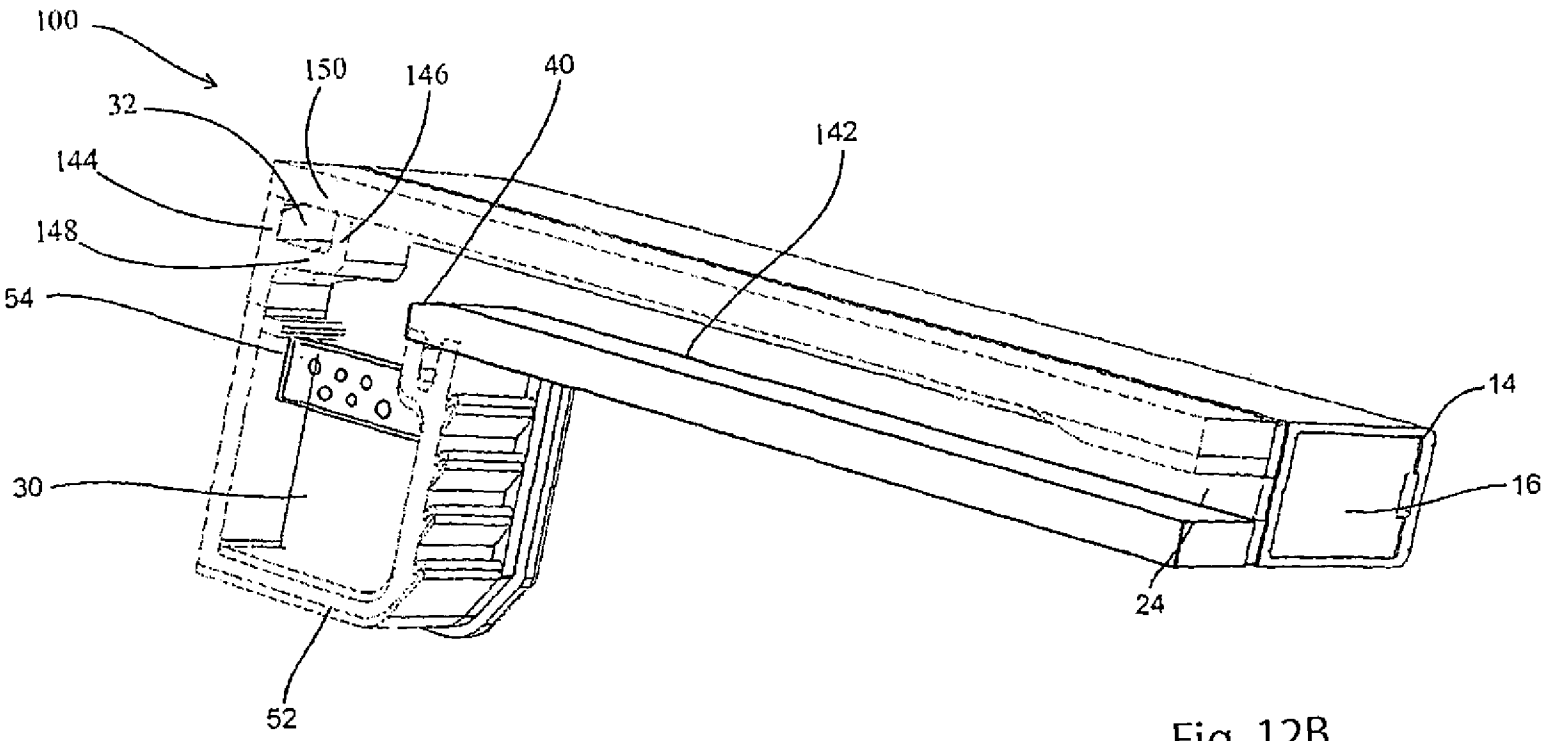
FIG. 12B is a left perspective cross section view of the exemplary embodiment of FIG. 12A through line 12'-12'.
Figure 12C:
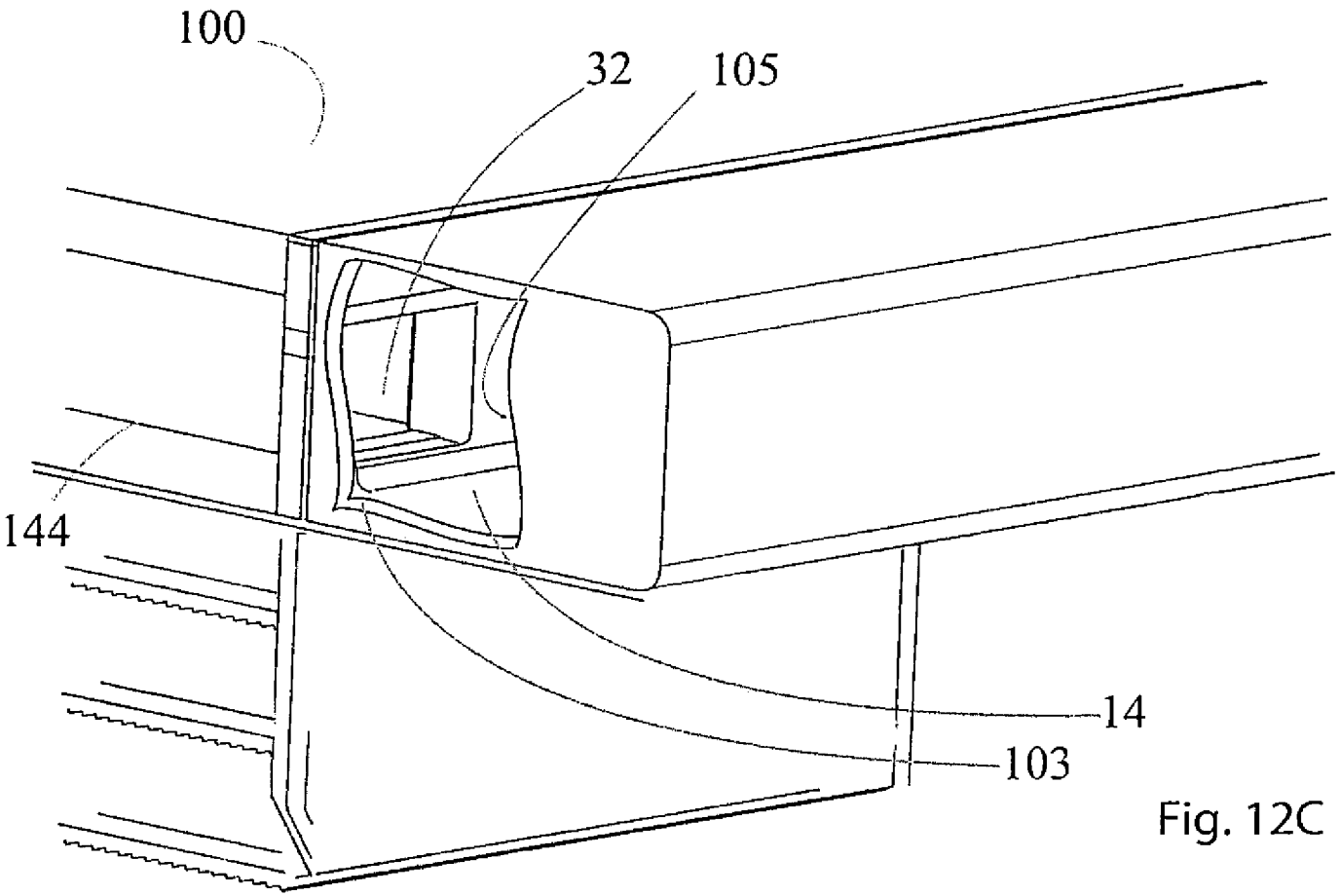
FIG. 12C is a rear, left perspective cut-away view of the exemplary embodiment of FIG. 12A showing a detail of a portion of the interior.
Figure 13:
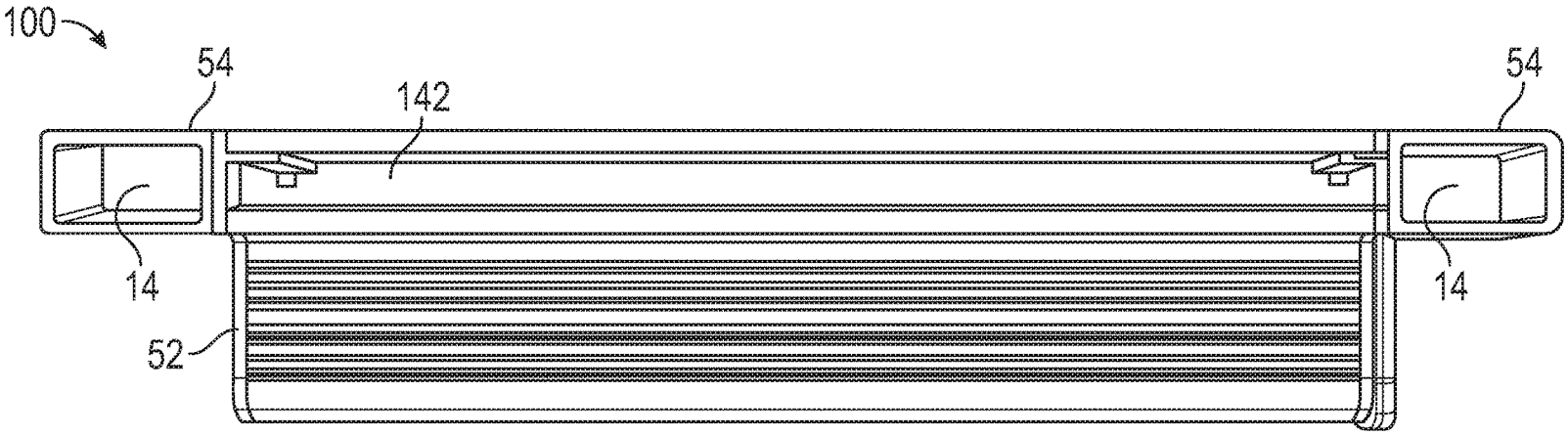
FIG. 13 is a front perspective view, partly in cross section, of the exemplary embodiment of FIG. 12A through line 13'-13'.

Referring now to FIGS. 12-14, a second exemplary embodiment of a lighted waterfall according to the present invention is shown. In FIGS. 2-4, the spreading manifold/area/passage 142 has grooves, resulting in a grooved spreading manifold/area/passage 142, while in FIGS. 12-14, the spreading manifold/area/passage 142 is ungrooved.

Figure 14A:
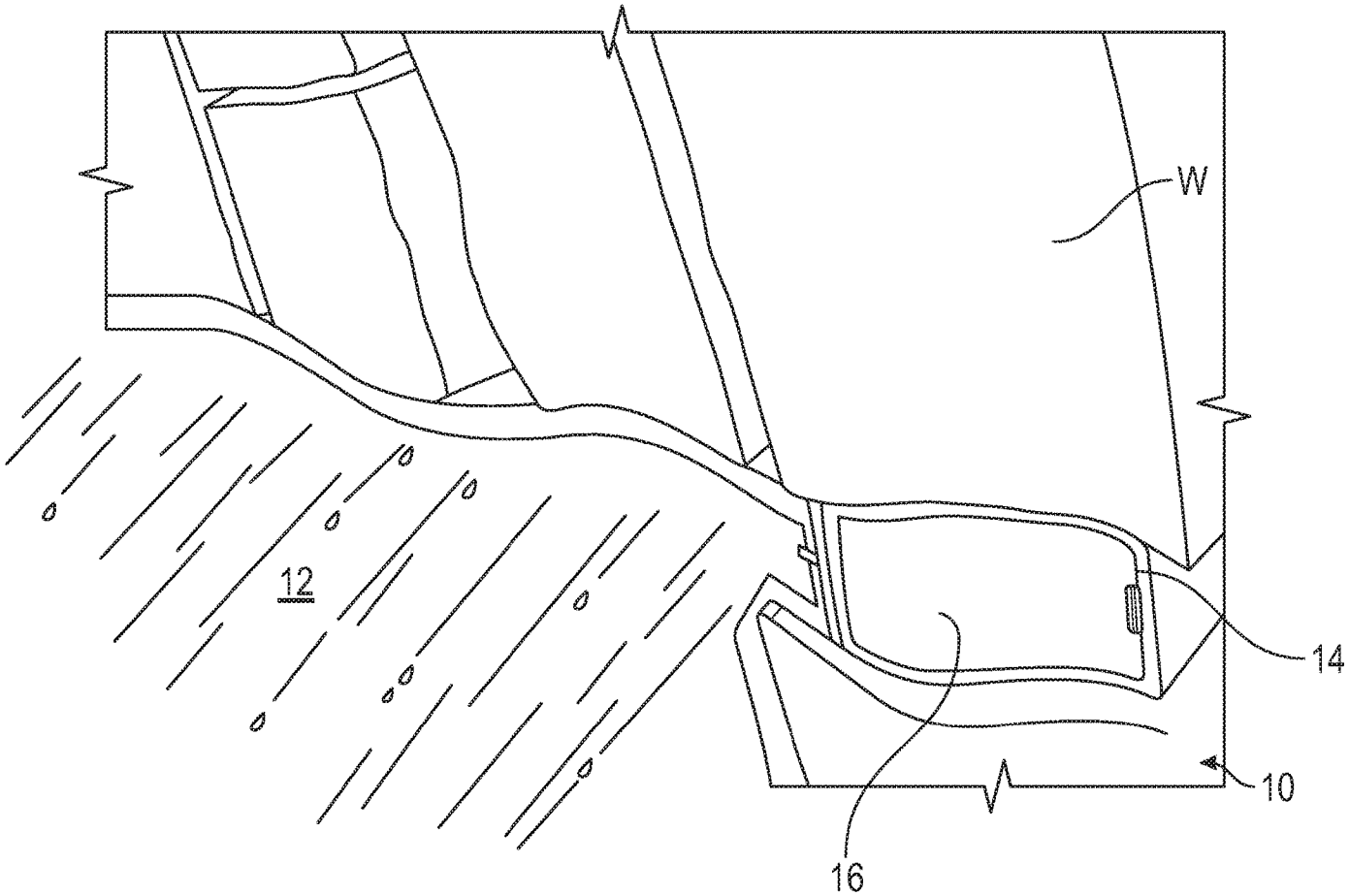
FIG. 14A is a front perspective view of the exemplary embodiment of FIG. 12A shown with a customized shaping of the front end mounted in a spa wall.
Figure 14B:
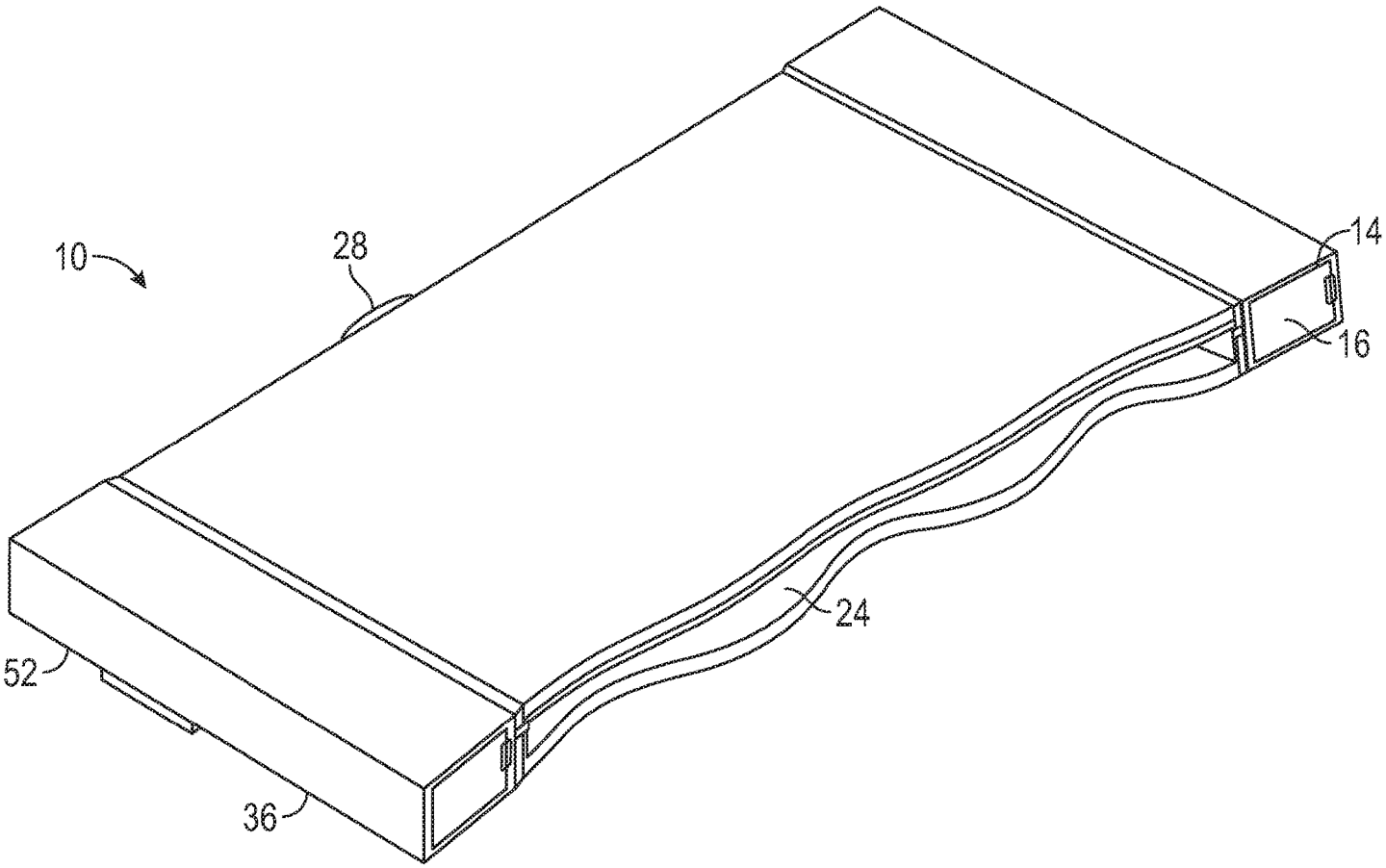
FIG. 14B is a top left perspective view of the exemplary embodiment of FIG. 14A shown without the spa wall.

FIG. 12A is a top left perspective view of the lighted waterfall device 100 and FIG. 12B is a left perspective cross section view of the lighted waterfall device 100 through line 12'-12'. FIG. 12C is a rear, left perspective view of the lighted waterfall device 100 showing a detail of a portion of the interior of the lighted waterfall device 100. FIG. 13 is a front perspective view, partly in cross section, of the lighted waterfall device 100 through line 13'-13'. FIG. 14A is a front perspective view of the lighted waterfall device 100 shown with a customized shaping of the front end mounted in a wall. FIG. 14B is a top left perspective view of the customized lighted waterfall device 100 shown without the wall.

In FIG. 12A, a lighted waterfall device 100 representative of the present invention provides a structure and means for positioning the means for lighting 18 the waterfall, and any chamber 32 in which it is retained, away from the front of the waterfall structure (distal to the waterfall slot/primary outlet) without affecting the satisfactory lighting or the ease-of-repair of the invention. Water from a water source (not shown) flows into the lighted waterfall device 100 and is discharged through a primary outlet in the form of waterfall slot 24.

The port 14 and port door 16 operate as a means for accessing the means for lighting 18, which is distal to and substantially laterally, rearwardly displaced from the waterfall slot 24. Port door 16 can be removed from port 14 allowing access to the interior of, or an interior chamber 32 of (partially seen through the transparent port surface), lighted waterfall device 100 to access, replace, remove, or insert the means for lighting 18. Moreover, the port door 16 comprises an exemplary embodiment of an open face/recess 101 configured to be filled with and retain the surrounding medium of an installed waterfall apparatus (tile, grout, mortar, plaster, etc.) to help hide the device 100 and make it more discreet.

In FIGS. 12B, 12C, and 13, in representative embodiments of the lighted waterfall device 100, water flows through an inlet 28 (not shown) into the interior hollow or manifold 30 of the lighted waterfall device 100 and is discharged through waterfall slot 24. The waterfall slot 24 is proximal to an exemplary embodiment of a spreading manifold/area/passage 142, not entirely dissimilar to the passage 42 of FIGS. 1-11, for spreading the flowing water towards the waterfall slot 24. The spreading manifold/area/passage 142 is configured to allow the flowing water to spread, if necessary, to be the width of the waterfall slot 24, which spreading can add turbulence to the waterfall produced, and improve the lighting effect throughout the pattern of the waterfall produced.

More specifically, the spreading manifold/area/passage 142 preferably is located at a position on the waterfall device 100 proximal to or at a front end of the waterfall device 100 such that the waterfall produced that emanates from the waterfall slot 24 flows over the spreading manifold/area/passage 142. In some embodiments, the floor of the spreading manifold/area/passage 142 can have patterns created or formed therein or thereon, thereby assisting in providing an aesthetically pleasing pattern to an unlit waterfall by disrupting or patterning light traveling through the floor of the spreading manifold/area/passage 142.

Similarly, when the means for lighting 18 is on, the spreading manifold/area/passage 142 can provide additional aesthetic enhancement to a lit waterfall by channeling/infusing the flowing water with turbulence. In this way, the device also can rely on any turbulence created in the water as the water spreads within the spreading manifold/area/passage 142, thereby assisting the light generated from the means for lighting 18 (despite its distal/rearward positioning, opposite the waterfall slot 24) in illuminating the water emanating from the waterfall slot 24.

The spreading manifold/area/passage 142 can serve at least two purposes. First, the spreading manifold/area/passage 142 can allow water flowing from manifold 30 to the waterfall slot 24 to spread evenly across spreading area prior to emanating from waterfall slot 24 so as to produce a more even waterfall. Second, the spreading manifold/area/passage 142 can provide a connection through a spa wall W (not depicted) such that the manifold section 52 portion of the lighted waterfall device 100 can be located on one side (the "dry side") of the spa wall W and accessible from the outside of the spa, while the waterfall slot 24 can be located on another side (the "wet side") of the spa wall W and accessible from the inside of the spa.

The means for lighting 18 is contained within a chamber 32 that is distal, opposite, and rearward of the waterfall slot 24, and substantially aligned on the same plane. The chamber 32 can have a transparent, semi-transparent, or translucent divider between the chamber 32 and the spreading manifold/area/passage 142 such that the means for lighting 18 is positioned to shine light parallel to and in the direction of the water flowing towards the waterfall slot 24 in a way that sufficiently and adequately guides the light towards the water emanating from the waterfall slot 24.

As the means for lighting 18 and chamber 32 are distal to and laterally displaced away from the spreading manifold/area/passage 142 and the waterfall slot 24 (mainly on the dry side of the spa; on one side of the spa wall), and as the waterfall apparatus 100 does not primarily rely on solid wave guide materials, instead primarily relying on the flowing water as a fluid wave guide, the waterfall apparatus 100 benefits from being easily manufactured, assembled, machined, and/or customized at the point of installation. More specifically, the waterfall apparatus 100 can be cut on the spot, laterally through the port(s) 14 and the spreading manifold/area/passage 142, to match the contours of any undulating, curved, or rounded spa wall W at the point of installation. As the lateral cut does not affect the fluid wave guide, or any electrical, power, or moving parts, and as the solid material of the ports and the spreading manifold/area/ passage 142 do not substantially direct the light, the waterfall apparatus 100 can be cut/formed/shaped/customized to match the spa wall without need of special skills, special materials, special tools, etc.

Referring now to FIG. 12A, a general configuration of an illustrative embodiment of the lighted waterfall device 100 is shown. Inlet 28 is on the rear of the lighted waterfall device 100 and waterfall slot 24 is on the front of the lighted waterfall device 100. At least a portion of the spreading manifold/area/passage 142 is located within spa wall W. Port 14 and port cover 16 are located on either side of waterfall slot 24, also on the front of the lighted waterfall device 100. As explained above, the spreading manifold/area/passage 142 and the adjacent ports 14 can be laterally cut across to create a customized edge with a waterfall slot 24.

Referring now to FIG. 12B, the interior of a lighted waterfall device 100 is shown. Inlet 28 allows water to enter manifold 30 and to fill the manifold 30. Optional baffles 54 can reduce turbulence in the water entering manifold 30 and trap debris for later removal. Once water in manifold 30 rises to the level of lip 40 of the spreading manifold/area/passage 142, water is generally evenly spread throughout manifold 30 and generally evenly flows over lip 40 onto the spreading manifold/area/passage 142. The spreading manifold/area/passage 142 comprises a passage leading from manifold 30 to waterfall slot 24, the passage being about the same as or greater than the height of waterfall slot 24, and about the same as the width of waterfall slot 24, such that water flowing from manifold 30 evenly flows through passage 42 to waterfall slot 24 and evenly flows out of waterfall slot 24 to form a waterfall.

FIG. 12B also shows a preferred location of chamber 32, namely running parallel to the horizontal opening to spreading manifold/area/passage 142 and located distal to and laterally spaced from the waterfall slot 24 along the rear of the device 100. Chamber 32 is an elongated hollow manifold running about the entire width and at least a portion of the depth of the spreading manifold/area/passage 142. Chamber 32 is separated from the ambient behind the lighted waterfall device 100 by a rear wall 144, is separated from the spreading manifold/area/passage 142 by a front wall 146, and is separated from the manifold/reservoir 30 by a bottom wall 148. Chamber 32 also has a top wall 150. Preferably, at least front wall 146 is made of a clear, transparent, translucent, or semi-transparent material such that light from the means for lighting 18 can travel through front wall 146 directly into and parallel to water flowing through the spreading manifold/area/passage 142. Rear wall 144, bottom wall 148, and top wall 150 may be opaque or even reflective (for example in coating or material) such that light from the means for lighting 18 can be focused and directed parallel to and in the direction of the spreading manifold/area/passage 142 towards the waterfall slot 24.

Referring now to FIG. 12C, a detail of a portion of the interior of the lighted waterfall device 100 illustrating the cooperation between chamber 32 and port 14 is shown. A cutaway 103 at the rear wall of the port 14, proximal to the chamber 32 and the rear wall 144, exposes the portion of the interior of the lighted waterfall device 100. As can be seen, port 14 is an opening through the front of lighted waterfall device 100 allowing access to a portion of the interior of lighted waterfall device 100 including access to chamber 32. Through port 14, a means for lighting 18 can be inserted (via snaking, for example) into or removed from chamber 32. A port cover 16 can be used to cover and close port 14 on the end of the port 14 opposite the cutaway 103.

In certain exemplary embodiments, the means for lighting 18 can be inserted through a first of the ports 14 (for example, the left side port 14 when looking at the device 100 from the front) and snaked through the chamber 32 and into a second of the ports 14 (for example, the right side port 14 when looking at the device 100 from the front), such as is depicted in FIG. 12A. As is also depicted in FIG. 12A, the cooperation between chamber 32 and port 14 may be defined in certain exemplary embodiments by a rounded, curve portion 105 proximal to the junction between chamber 32 and port 14. In this way, the means for lighting 18 can be easily snaked down a port 14 and easily pushed into the chamber 32 in the proper alignment (directing light through the front wall 146) without difficulty.

Referring now to FIG. 13, a detail of a portion of the interior of the lighted waterfall device 100 is shown. In this view, the interior of the spreading manifold/area/passage 142 and the ports 14 are shown. The spreading manifold/area/passage 142 provides for the generally free flow of water from manifold 30 to waterfall slot 24. The ports 14 allow access to chamber 32.

FIG. 14A is a front perspective view of the exemplary embodiment of FIG. 12A shown with a customized shaping of the front end mounted in a wall. FIG. 14B is a top left perspective view of the exemplary embodiment of FIG. 14A shown without the spa wall W. As the front portion of the device 100 comprises hollow portions of ports 14 and spreading manifold/area/passage 142, this front portion can be cut, formed, or shaped as desired to conform to the spa wall W. For example, FIG. 14A shows the device 100 mounted in a stone spa wall W with undulating or non-linear stones. The front portion of the device 100 can be cut through the ports 14 and the spreading manifold/area/passage 142 so as to conform to the shape of the spa wall W. FIG. 14B shows the cut, formed, or shaped front portion of the device without the surrounding spa wall W for clarity. Devices having lighting means proximal to the waterfall slot 24, such as the first embodiment of the current invention, cannot be so cut, formed, or shaped.

Figure 15A:
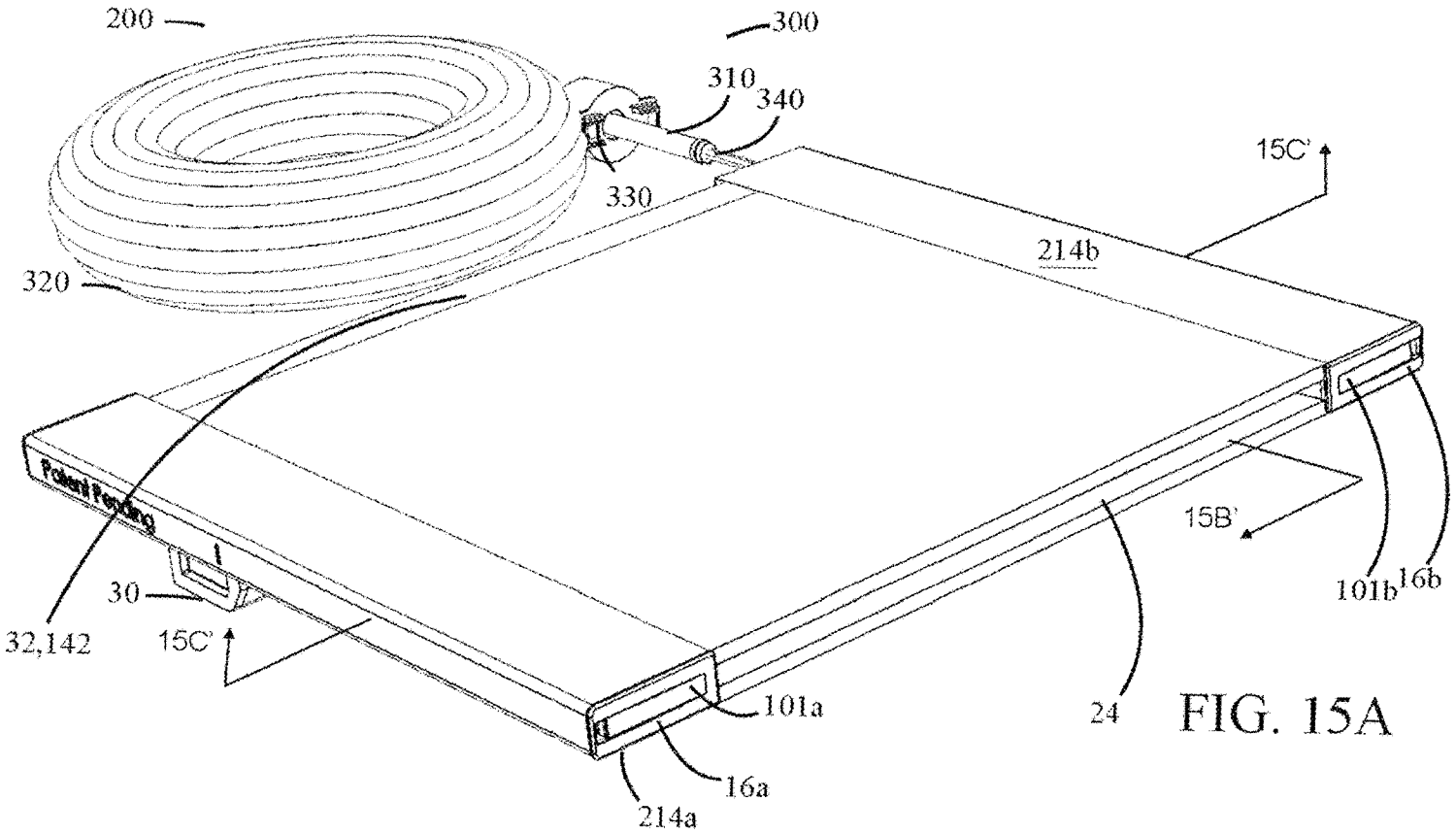
FIG. 15A is a top left perspective view of a third exemplary of the invention.
Figure 15B:
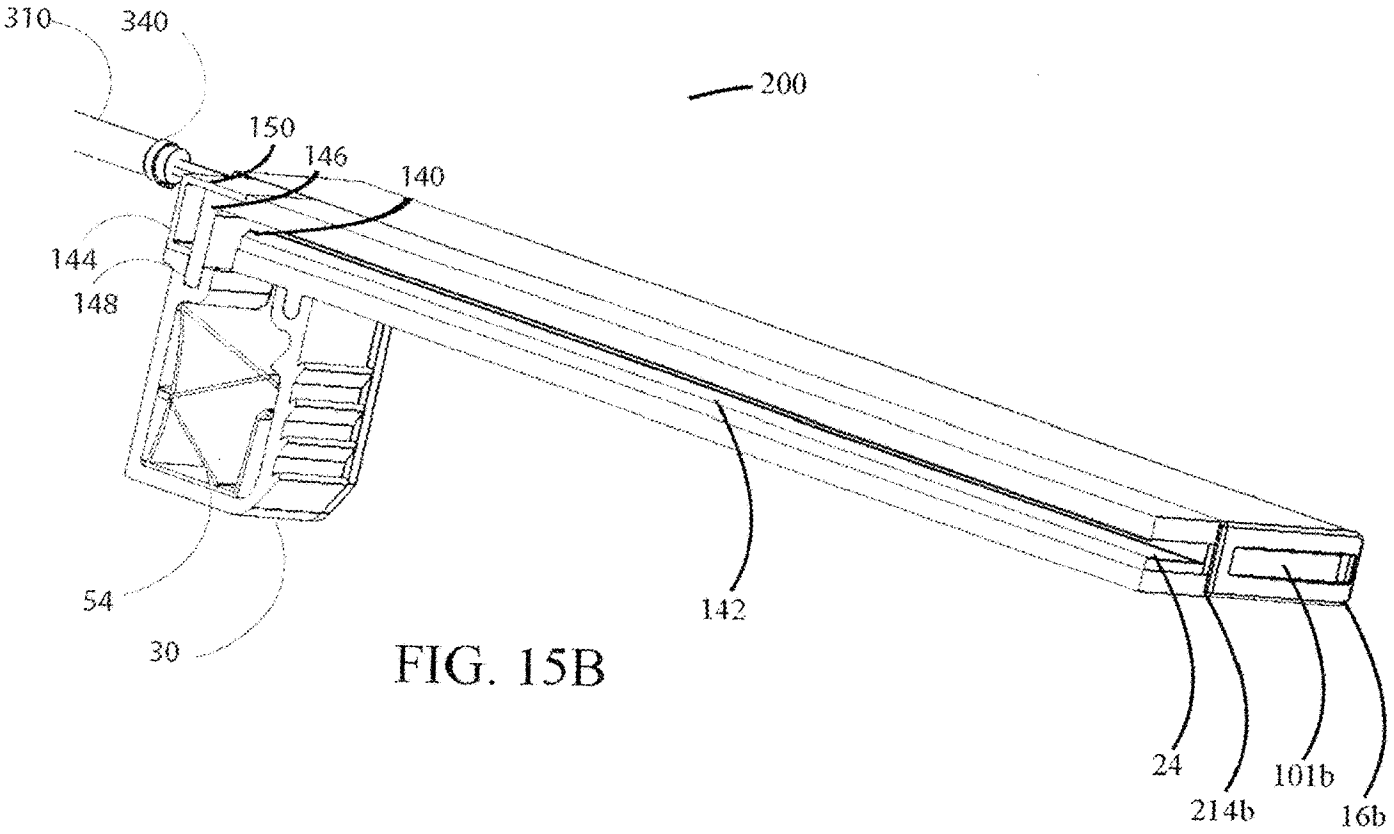
FIG. 15B is a left perspective cross section view of the exemplary embodiment of FIG. 15A through line 15B'-15B'.
Figure 15C:
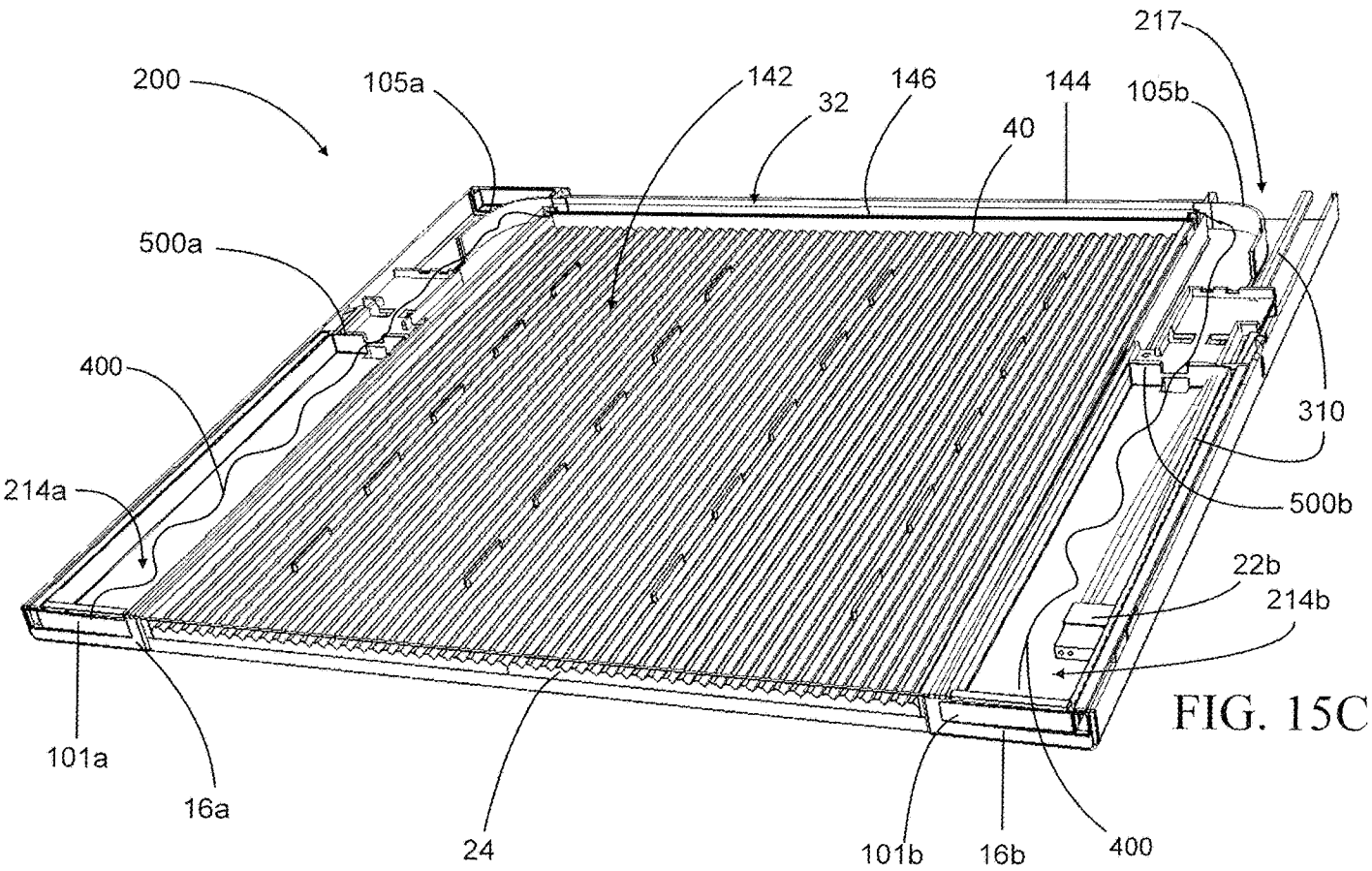
FIG. 15C is a right perspective cross section view of the exemplary embodiment of FIG. 15B through line 15C'-15C'.
Figure 16:
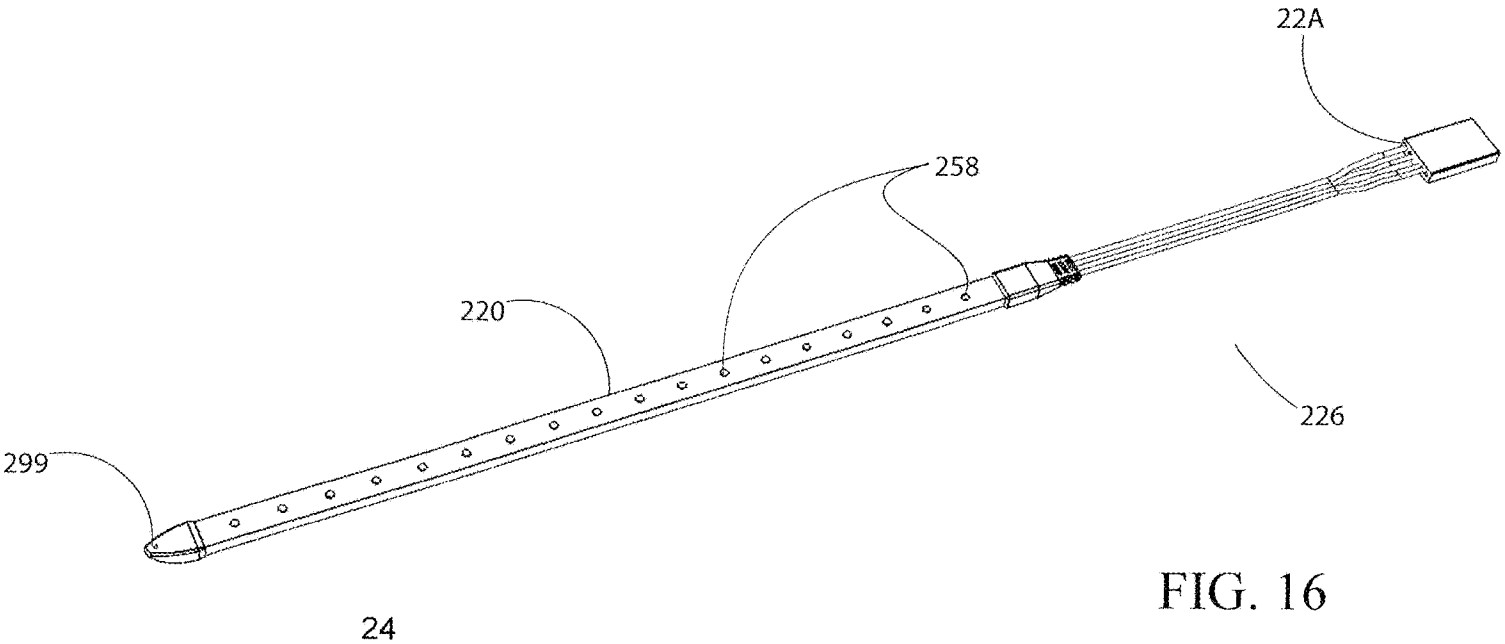
FIG. 16 is a top right perspective view of an exemplary embodiment of a lighting unit for the exemplary embodiment of FIG. 15.

Referring now to FIGS. 15-16, a third exemplary embodiment of a lighted waterfall according to the present invention is shown. The third exemplary embodiment illustrated in FIG. 15A is similar to the second exemplary embodiment illustrated in FIGS. 12-14 and, therefore, only the differences between these exemplary embodiments are described. FIG. 15A is a top left perspective view of the lighted waterfall device 200 and FIG. 15B is a left perspective cross section view of the lighted waterfall device 200 through line 15B'-15B'. FIGS. 15A and 15B have a smooth spreading manifold/area/passage 142. FIG. 15C is a right perspective cross section view of the lighted waterfall device 200 through line 15C'-15C'. FIG. 15C has a grooved spreading manifold/area/passage 142. FIG. 16 is a top right perspective view of an exemplary embodiment of a lighting unit 226 for the lighted waterfall device 200.

In FIG. 15A, a lighted waterfall device 200 representative of the present invention provides a structure and means for quickly installing and replacing a second exemplary embodiment of a removable and replaceable lighting unit 226 in the chamber 32, the chamber 32 being configured and positioned away from the front of the waterfall structure—distal to and laterally displaced from the waterfall slot/primary outlet. The light produced from the lighting unit 226 within the chamber 32 illuminates the water flowing through at least spreading manifold/area/passage 142 and then emanating from the waterfall device 200 upon being discharged through a primary outlet in the form of waterfall slot 24.

Furthermore, the lighted waterfall device 200 has a representative placement of a second exemplary embodiment of a port 214. A port 214 is situated on both lateral sides of the lighted waterfall device 200, that is, on the left side (214*a*) and on the right side (214*b*). Port 214 has a port door 16 as a means for accessing the lighting unit 226. As is disclosed in more detail herein, the port door 16 may be removed from port 214 allowing access to the interior of, or an interior chamber of, the lighted waterfall device 200 to access, replace, remove, or insert the lighting unit 226. Port 214 is located at, on, or proximal to the front of the lighted waterfall device 200 structure, preferably proximal to the waterfall slot 24, so as to allow easier access to the lighting unit 226.

In this exemplary embodiment, the chamber 32 cooperates with the ports 214*a*, 214*b* so as to allow access to the chamber 32 from both ends of ports 214*a*, 214*b* (see FIG. 15C). Moreover, port cover 16 may be a door or other covering to port 214 and/or the chamber 32 to which the lighting unit 226 or any other internal components can be engaged/retained for easy access. Moreover, the entire structure and configuration of port 214 facilitates an inventive process/method of installing or replacing the lighting unit 226.

The lighted waterfall device 200 also has an exemplary embodiment of a power cord length management system 300 comprising an exemplary embodiment of a retractable and extendable power cord 310, a power cord bundle/spool 320, a constriction component 330, a power cord collar 340, and a device/unit connector component 22*b*. The power cord length management system 300 is configured to electrically power the lighting unit 226 (see FIG. 15C). Moreover, a strip connector component 22*a* terminates one end of the lighting unit 226 and complements the unit connector component 22*b* at the terminal end of the power cord 310 (see FIG. 16).

As the connector 22 and the lighting unit 226 are intended to be ultimately positioned and situated/housed within the ports 214 and/or the chamber 32, the connector 22 is convenient in that it allows the lighting unit 226 to be quickly and readily connected to and disconnected from the lighted waterfall device 200 within or partially within one or both of the ports 214. Moreover, the port 214 is convenient in that it is structured and configured to retain and channel the power cord 310 such that the power cord length management system 300 may facilitate extension or retraction of the power cord 310 out of the interior of the port 214. The power cord length management system 300 also helps ensure that the unit connector end 22*b* of the power cord 310 remains within or proximate to the port 214 and available for engagement with the strip connector 22*a*.

The lighted waterfall device 200 also has an exemplary embodiment of a pull-through system comprising a guide wire 400 configured to extend through the specialized port 214 and facilitate insertion/repair/replacement of the lighting unit 226 (see FIG. 15C). In this exemplary embodiment, the pull-through system is configured as an exemplary guide wire 400 running from one port 214*a* to the other port 214*b*, preferably with one end engaged to the port cover 16*a* of port 214*a* for easy retrieval and access. As the unit connector component 22*b* at the terminal end of the power cord 310 is also readily and easily retrievable from the port 214*b*, a user servicing the lighted waterfall 200 may quickly and easily install or replace the lighting unit 226.

Specifically for this exemplary embodiment, a user may quickly and easily retrieve and extend out of port 214*b* the power cord 310 via the unit connector component 22*b* end, with the power cord length management system 300 providing sufficient slack via the power cord bundle 320, the constriction component 330, and the power cord collar 340. The user may then engage or disengage the strip connector component 22*a* and the unit connector component 22*b* so as to control the power supply to the lighting unit 226. The user may then engage or disengage the lighting unit 226 to/from the pull-through system 400. If the user is removing a previously installed lighting unit 226, then the user pulls/pulled the lighting unit 226 out of the chamber 32 and the port 214*b*. If the user is installing a lighting unit 226, then the user pushes/pulls the lighting unit 226 into the port 214*b* and the chamber 32. The user may facilitate this entire process with the use of the pull-through system.

In FIG. 15B, in representative embodiments of the lighted waterfall device 200, water flows into the interior manifold 30 and is discharged through the waterfall slot 24. The waterfall slot 24 is proximal to the spreading manifold/area/passage 142. Baffles 54 define the interior manifold 30, and assist in distributing the water more evenly throughout the manifold 30 so as to create a more uniform waterfall 12. Once water in manifold 30 rises to the level of lip 40 of the spreading manifold/area/passage 142, water is generally evenly spread throughout manifold 30 and generally evenly flows over lip 40 onto the spreading manifold/area/passage 142. Thus, if the water is more evenly contained in the manifold 30, the water more evenly flows over lip 40 onto the spreading manifold/area/passage 142. Chamber 32 is an elongated hollow manifold running at least a portion of the width and at least a portion of the depth of the spreading manifold/area/passage 142.

In this particular embodiment, the chamber 32 is separated from the ambient behind the lighted waterfall device 200 by a rear wall 144, is separated from the spreading manifold/area/passage 142 by a front wall 146, and is separated from the interior manifold 30 by a bottom wall 148. Chamber 32 also has a top wall 150. Preferably, at least the front wall 146 is made of a clear, transparent, translucent, or semi-transparent material such that light from the lighting unit 226 can travel through the front wall 146 directly and parallel on to water flowing through the spreading manifold/area/passage 142. The rear wall 144, bottom wall 148, and top wall 150 may be opaque or even reflective (in coating or material) such that light from the lighting unit 226 can be focused and directed parallel to and in the direction of the spreading manifold/area/passage 142 towards the waterfall slot 24.

In FIG. 15C, a cross sectional view of the lighted waterfall device 200 through line 15C'-15C' is shown revealing details regarding the structure, configuration, and internal components of the port 214 and how it facilitates an inventive process/method of installing or replacing the lighting unit 226.

As previously described, the lighted waterfall device 200 provides a structure and means for quickly installing and replacing the lighting unit 226 (best seen in FIG. 16) in the chamber 32. As the chamber 32 is positioned distal to the waterfall slot/primary outlet 24, and as the port 214 is located at, on, or proximal to the waterfall slot 24 in this particular embodiment, it sometimes may be difficult to fully insert and steer/snake the lighting unit 226 through the port 214 into the chamber 32.

For example, in an exemplary lighted waterfall device 100 (best seen in FIGS. 12-14), cooperation between chamber 32 and port 14 is defined by a rounded, curve portion 105 proximal to the junction between chamber 32 and the port 14. In this way, the means for lighting 18 can be more easily snaked down the port 14 and more easily pushed into the chamber 32 in the proper alignment via the rounded, curved portion 105 (directing light through the front wall 146). However, if the lighted waterfall device 100 is very large in scale, and/or the means for lighting 18 is very long in length, any snaking of the means for lighting 18 down the port 14 may result in twisting, warping and/or flaccidity in the means for lighting 18. This may, ultimately, result in the means for lighting 18 not entering the chamber 32 in the proper alignment, despite the rounded, curve portion 105. Moreover, if the port 14 is very long in length, it may be possible to lose the reachability/accessibility of any internal components housed within the port 214 that are important to proper lighted-setup of the waterfall device 100.

As such, the lighted waterfall device 200 of FIG. 15C illustrates one exemplary embodiment of waterfall having ports 214*a*, 214*b*, port doors 16*a*, 16*b*, a power cord length management system 300, and a pull-through system comprising a guide wire 400 that are structured and configured to facilitate the installation and/or replacement of the lighting unit 226 within the chamber 32.

The lighted waterfall device 200 has the left port 214*a* and the right port 214*b* positioned on the lateral sides of the spreading manifold/area/passage 142. The ports 214*a*, 214*b* extend from adjacent to the waterfall slot 24 to adjacent to the chamber 32. The chamber 32 cooperates with the ports 214*a*, 214*b* so as to allow access to the chamber 32 from the ports 214*a*, 214*b*. Cooperation between the chamber 32 and the ports 214*a*, 214*b* is defined by a rounded, curve portion 105 proximal to the junction between the chamber 32 and the ports 214, with the curve portion 105*a* terminating port 214*a* and the curve portion 105*b* terminating port 214*b*.

Port 214*a* has a port door 16*a*, and port 214*b* has a port door 16*b*. A portion/component/piece of the lighting unit 226, the power cord 310, and/or the guide wire 400 may be engaged to/retained by the port doors 16*a*, 16*b* such that the internal components of the lighted waterfall 200 are easily accessible to a user. As such, even if the port 214 is very long in length, the user will not lose reachability/accessibility of any of these internal components within the depths of port 214.

The power cord length management system 300 is configured to electrically power the lighting unit 226 via, at least, the power cord 310 (the power cord length management system 300 is not fully seen in FIG. 15C). The unit connector component end 22*b* of the power cord 310 is intended to be ultimately positioned and situated/housed within port 214*b* (port 214*a* may be used without any change to this description) when the lighted waterfall device 200 is full assembled. In this way, the unit connector component 22*b* of the power cord 310 allows for quick and ready electrical engagement with the strip connector component 22*a* of the lighting unit 226, or any other component of the lighted waterfall device 200, during user service.

As installing or replacing the lighting unit 226 involves removing the port door 16*b* and retrieving and/or manipulating internal components within the port 214*b*, such as engaging or disengaging the strip connector component 22*a* and the unit connector component 22*b*, for example, the power cord length management system 300 also is configured to facilitate extension and/or retraction of at least a portion of the power cord 310 out of/into the port half 214*b*. In this way, the length management system 300 helps ensure that the unit connector end 22*b*, for example, remains within or proximate to the port 214 and available for engagement with the strip connector 22*a*, or any other component of the lighted waterfall device 200.

More specifically, the port 214 comprises an exemplary embodiment of internal supports 500 that are structured and configured to retain and channel the portion of the retractable and extendable power cord 310 situated within the port 214. A portion of the power cord 310 extends into the port half 214*b* through the end opposite the port door 16*b* via an exemplary embodiment of an opening 217. Port 214*a* and internal supports 500*a* may be used without any change to this description.

The power cord 310 outside the port half 214*b* extends through the constriction component 330. The constriction component 330 is configured to be mounted or anchored on the dry side of the waterfall spa to support the power cord 310 as it traverses a wall, for example, to communicate with lighted waterfall device 200. The remainder of the power cord 310, and all slack, beyond the constriction component 330, and on the opposite side as the port half 214*b*, is managed by the power cord bundle 320 that also may be mounted or anchored on the dry side of the waterfall spa. In this way, due to the slack provided by the power cord bundle 320, the constriction component 330, and the power cord collar 340, the internal supports 500*b* allow the unit connector component 22*b* end of the power cord 310 within the port half 214*b* to extend or retract out of and into the port door 16*b*, but not beyond the internal supports 500*b*, towards the opening 217 end.

Furthermore, on the side opposite the internal supports 500*b*, towards the constriction component 330, at a point outside port 214*b*, the power cord collar 340 defines the surface of, and is engaged to, the power cord 310. The power cord collar 340 increases the external thickness of the power cord 310 to a measure greater than the aperture defined by the constriction component 330 through which the power cord 310 extends. In this way, because of the difference in thickness of the power cord 310 on one side of the constriction component 330, the constriction component 330 and the power cord collar 340 prevent the power cord 310 from fully retracting out of the constriction component 330 and out of the internal supports 500*b* and out of port 214*b*.

Returning to FIG. 15C, the pull-through system of the lighted waterfall device 200 facilitates insertion and proper alignment of the lighting unit 226 into the chamber 32. The guide wire 400 helps a user pull the lighting unit 226 through port 214*b* into the chamber 32 and into proper alignment. The pull-through system may be used while a user pushes the lighting unit 226 into port 214*b* into the chamber 32 while leveraging the curve portion 105*b*. The curve portion 105*a* may be used without any change to this description.

More specifically, the pull-through system is configured as a guide wire 400 running from port 214*a* to port 214*b*. One end of the guide wire 400 is engaged to the port cover 16*a* of port 214*a* for easy retrieval and access. The other end of the guide wire 400 extends to port 214*b* and may be engaged to the port cover 16*a* for easy retrieval and access. The portion of the guide wire 400 in port 214*b* is configured to detachably engage to the lighting unit 226 during installation or repair.

For this exemplary embodiment, a user may quickly and easily retrieve and extend out of port 214*b* the guide wire 400. The user may then quickly and easily attach the guide wire 400 to the lighting unit 226 via the wire eyelet 299 defined on the end opposite the strip connector component 22*a* (best seen in FIG. 16). The user may then quickly and easily retrieve and extend out of port 214*b* the guide wire 400. The user may then pull the lighting unit 226, wire eyelet 299 end leading, through port 214*b* into the chamber 32 by pulling the guide wire 400 from port 214*a* end. The user may adjust the orientation and alignment of the lighting unit 226 as the lighting unit 226 is being inserted (whether pulled and/or pushed) through port 214*b* and into the chamber 32. For example, a user may snake/push the lighting unit down port 214*b* and, via the rounded, curved portion 105, enter the chamber 32. The user may hold the lighting unit 226 in the correct alignment for the chamber 32 while using the guide wire 400 to maintain the proper alignment of the lighting unit 226.

In FIG. 16, the second exemplary removable and replaceable lighting unit 226 comprises an LED strip 220, a strip connector component 22*a* and a wire eyelet 299. The strip connector component 22*a* terminates one end of the lighting unit 226 and complements the unit connector component 22*b* at the terminal end of the power cord 310. The wire eyelet 299 is defined on the end opposite the strip connector component 22*a* and is configured to quickly and easily attach the guide wire 400 to the lighting unit 226 such that a user may pull the lighting unit 226 (the wire eyelet 299 end leading) when attached.

In this particular embodiment, the lighting unit is configured as an LED strip comprising at least one and preferably a plurality of individual LEDs 258 so as to provide more uniform light across the chamber 32. The LED strip 20 may be selected or cut to be of a desired length, such as the length of the chamber 32. In this manner, different lengths LED strips 20 can be used for different sized lighted waterfall devices 200. Moreover, the strip connector component 22*a* is convenient in that it allows the LED strip 220 to be connected to and disconnected from the lighted waterfall device 200 for ease of removal and replacement.

Figure 17A:
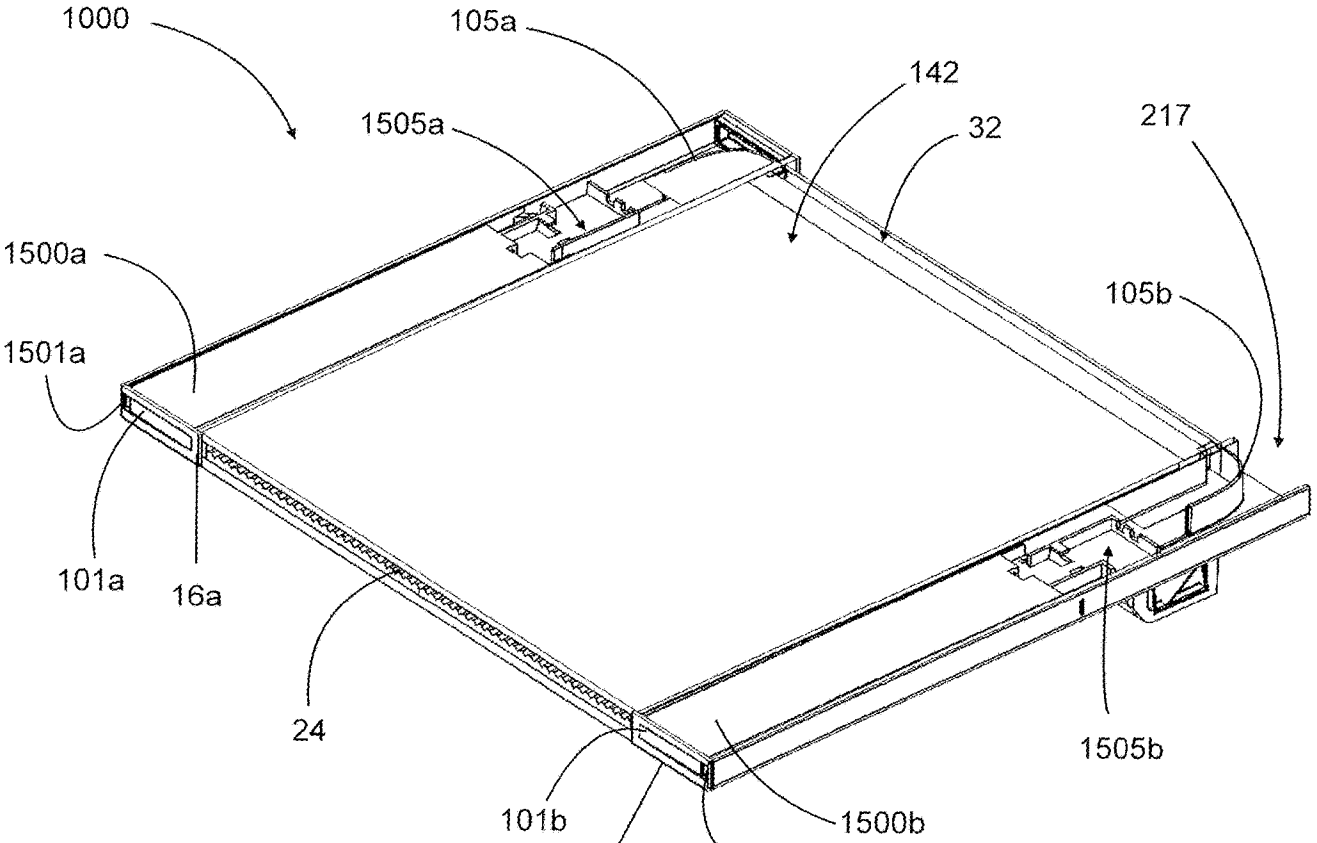
FIG. 17A is a right perspective cross section view of a fourth exemplary of the invention through line 17A'-17A.
Figure 17B:
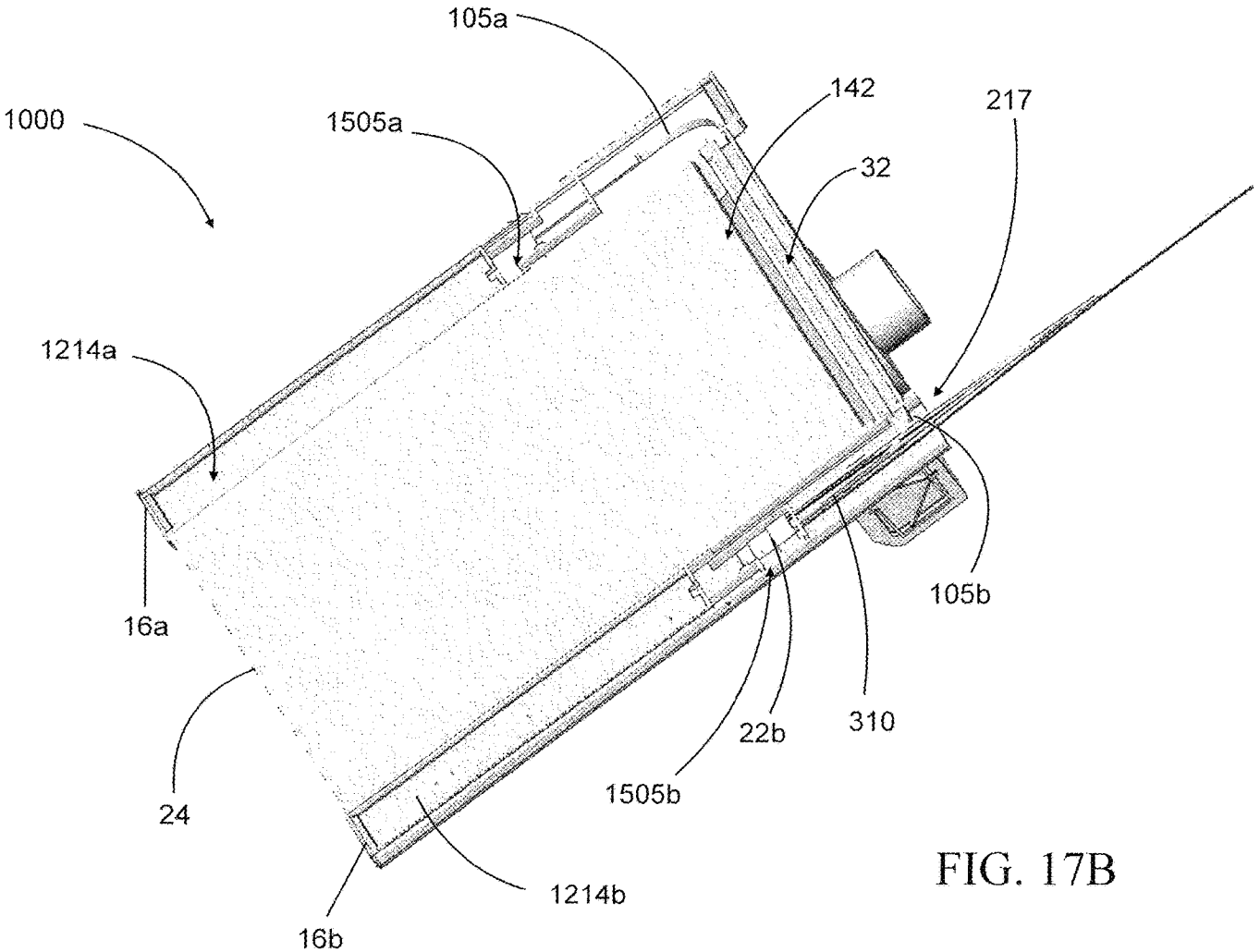
FIG. 17B is a right perspective cross section view of the exemplary embodiment of FIG. 17A through line 17B'-17B'.

Referring now to FIGS. 17-18, a fourth exemplary embodiment of a lighted waterfall according to the present invention is shown. The fourth exemplary embodiment illustrated in FIG. 15A is similar to the third exemplary embodiment illustrated in FIGS. 15-16 and, therefore, only the differences between these exemplary embodiments are described. FIG. 17A is a right perspective cross section view of the lighted waterfall device 1000 through line 17A'-17A'. FIG. 17B is a right perspective cross section view of the lighted waterfall device 1000 through line 17B'-17B'. FIG. 18 are perspective views of an exemplary user 1 using the lighted waterfall device 1000.

In FIG. 17A, a lighted waterfall device 1000 representative of the present invention provides a structure and means for quickly installing and replacing a removable and replaceable lighting unit 226 from a chamber 32, which is configured and positioned distal to and laterally displaced from the waterfall slot 24. In FIG. 17B, a cross sectional view of the lighted waterfall device 1000 through line 17B'-17B' is shown revealing details regarding the structure, configuration, and internal components of the port 1214 and how it facilitates an inventive process/method of installing or replacing the lighting unit 226.

Like the third exemplary embodiment, the fourth exemplary embodiment of the lighted waterfall device 1000 also has a power cord length management system 300 and a pull-through system comprising a guide wire 400. The power cord length management system 300 comprises a retractable and extendable power cord 310, a power cord bundle/spool 320, a constriction component 330, a power cord collar 340, and a device/unit connector component 122*b*.

The power cord length management system 300 is configured to facilitate extension and/or retraction of at least a portion of the power cord 310 out of/into another exemplary embodiment of a specialized port 1214. The guide wire 400 is configured to extend through the specialized port 1214, from one exemplary embodiment of a port half 1214*a* to another exemplary embodiment of a port half 1214*b*.

Furthermore, the lighted waterfall device 1000 has a third exemplary embodiment of a port 1214 situated on the left lateral side 1214*a* and on the right lateral side 1214*b*. The chamber 32 cooperates with the port halves 1214*a*, 1214*b* so as to allow access to the chamber 32 from both ends of port halves 1214*a*, 1214*b* (see FIG. 17). The unit connector component end 22*b* of a power cord 310 is intended to be ultimately positioned and situated/housed within port half 214*b* (port half 214*b* may be used without any change to this description) when the lighted waterfall device 1000 is fully assembled.

The port 1214 provides an internal structure and means for quickly installing and replacing the lighting unit 226 (best seen in FIGS. 18A-18L) in the chamber 32 without having to steer/snake the lighting unit 226 through the port 1214. Instead, each lateral half of the specialized port 1214 each, respectively, comprises a port insertion structure 1500 capped on one end by an exemplary embodiment of a port door 16. The port insertion structures 1500*a*, 1500*b* are each respectively configured as a means for accessing the lighting unit 226, the guide wire 400 and/or other electrical supply components, and as a structure upon which the lighting unit 226 and/or the guide wire 400 or any other internal components can be engaged/retained for channeling into the port halves 1214*a*, 1214*b* and for easy access. The port insertion structures 1500*a*, 1500*b*, can be in the form of drawer-like structures.

In one exemplary embodiment, the lighted waterfall device 1000 has two matching port insertion structures 1500*a*, 1500*b* complementary of the lateral port halves 1214*a*, 1214*b*, which also are matching in structure and configuration. The port insertion structures 1500*a*, 1500*b* are configured to slidably enter the respective and appropriate port halves 1214*a*, 1214*b*, and comprise port doors 16*a*, 16*b* to engage snuggly therein so as to cap the port halves 1214*a*, 1214*b*. The port doors 16*a*, 16*b* cap the end of the port halves 1214*a*, 1214*b* when the port insertion structures 1500*a*, 1500*b* are engaged within their respective port halves. The port doors 16*a*, 16*b* may be removed from their corresponding port insertions structures 1500*a*, 1500*b* allowing for access to the interior of, or an interior chamber of, port insertions structures 1500*a*, 1500*b* should that be necessary.

More specifically, and with referenced to FIG. 17B, the lighted waterfall device 1000 has the left port half 214*a* and the right port half 1214*b* positioned on the lateral sides of the spreading manifold/area/passage 142. The port halves 1214*a*, 1214*b* extend from adjacent to the waterfall slot 24 to adjacent to the chamber 32. Cooperation between the chamber 32 and the ports 1214*a*, 1214*b* is defined by a rounded, curve portion 105 proximal to the junction between the chamber 32 and the port 1214, with the curve portion 105*a* terminating port 1214*a* and the curve portion 105*b* terminating port 1214*b*.

The port half 1214*a* has a corresponding port insertion structure 1500*a*, and port half 1214*b* has a corresponding port insertion structure 1500*b*. The port insertion structures 1500*a*, 1500*b* may be removed from port 1214 allowing access to the interior of, or an interior chamber of, the port 1214 to access, replace, remove, or insert the lighting unit 226. A portion/component/piece of the lighting unit 226, the power cord 310, and/or the guide wire 400 may be engaged to/retained by the port insertion structures 1500*a*, 1500*b* such that the internal components of the lighted waterfall 1000 are easily accessible to a user.

Port insertion structures 1500 can be drawer-like structures that can slide in and out of ports 1214. The proximal, or front, end of port insertion structures 1500 comprise no electrical or mechanical components required for the operation of the waterfall, generally being hollow elongated portions. As such, this portion of port insertion structures 1500 can be cut, formed, or shaped along with the front portion of the device 1000 to conform to the shape of the spa wall W into which the device 1000 is mounted. Port doors 16 can either be shaped to cooperate with the spa wall W surface, or can be made of a flexible material, such as rubber, to conform to the cut, formed, or shaped end of port insertion structures 1500.

The distal, or rear, end of port insertion structures 1500 comprise an area or volume, such as chamber 1505, for retaining and maintaining, for example, at least a portion of unit connector 22*b* or guide wire 400. For example, the back wall of port insertion structure 1500 may have slots or holes therethrough to allow throughput of power cord 310 or guide wire 400, and retaining portions to prevent unit connector 22*b* or guide wire 400 from coming loose from chamber 1505 without action by the user 1. In this manner, when the port insertion structures 1500 are removed from or inserted into ports 1214, unit connector 22*b*, power cord 310, and/or guide wire 400 will be removed from or inserted into ports 1214 as well. Preferably, some area or volume is left open between the back of port insertion structures 1500 and the rear of ports 1214 to allow some of power cord 310 and guide wire 400 to be stored therein (see FIG. 18L).

In particular, for this exemplary embodiment, one end of the guide wire 400 is engaged to the port insertion structure 1500*a* for easy retrieval and access. The other end of the guide wire 400 may extend to port 1214*b* and may be engaged to the port insertion structure 1500*b* for easy retrieval and access. The portion of the guide wire 400 that may be in the port half 1214*b* (depending on the stage of repair/installation) is also configured to detachably engage to the lighting unit 226.

As installing or replacing the lighting unit 226, in this exemplary embodiment, involves removing the port insertion structure 1500*b* and retrieving and/or manipulating internal components detachably engaged to the port insertion structure 1500*b*, such as engaging or disengaging the strip connector component 22*a* terminating one end of the lighting unit 226, and the unit connector component 22*b*, for example, the end of the port insertion structure 1500*b* opposite the port door end 16*b* is configured to retain and channel a power cord 310, and/or a portion of a lighting unit 226, within the port half 1214*b*, as the respective port insertion structure 1500*b* is inserted or removed from the interior of a respective port half 1214*b*.

In this way, the port insertion structure 1500 helps ensure that a unit connector end 22*b* of a power cord 310 remains within or proximate to the port half 1214*b* and available for engagement with the lighting unit 226*b*. The port insertion structure 1500*b* is configured to facilitate this by having a physical structure that can clip in/friction fit-in the unit connector component 22*b* and/or the strip connector component 22*a* of the lighting unit 226 into a cradle at the end of the port insertion structure 1500 opposite the port door 16*b*. Due to the slack provided by the power cord bundle 320, the constriction component 330, and the power cord collar 340, the port insertion structure 1500*b* allows the connector component 22 within the port half 214*b* to extend or retract out of/into the port door 16*b*, via the opening 217 end, as the port insertion structure 1500*b* is being removed or inserted. This allows the connector component 22 and any cable end that might extend from it, whether for the lighting unit 226 or the power cable 301, to be correctly positioned within the port 1214 without having the cables snagged or intertwined, in an orderly fashions, or without having the cables fold over themselves. Instead, the connector component 22 and any cables are cradled and a configured to slide in and out of the port half 1214*b* as the lighting unit is positioned properly within the chamber 32.

In FIG. 18, an exemplary embodiment of a user 1 uses an exemplary embodiment of a lighted waterfall device 1000. In FIG. 18A, the user 1 handles an exemplary embodiment of a long thin tool 2000 and inserts the long thin tool 2000 through an exemplary embodiment of an aperture 1501 defined through the port door 16*a*. The aperture 1501 communicates with a long, thin groove 1503 defined along the lateral most side of the port insertion structures 1500 (best seen in FIGS. 18C-18F). The long, thin grooves 1503 are configured as a way of establishing a friction-fit with the port insertion structure 1500 to pull it out of the port half 1214. Other means for removing port insertion structures 1500 also are suitable, such as, for example, tabs, latches, clips, indentations, and the like.

Figure 18A:
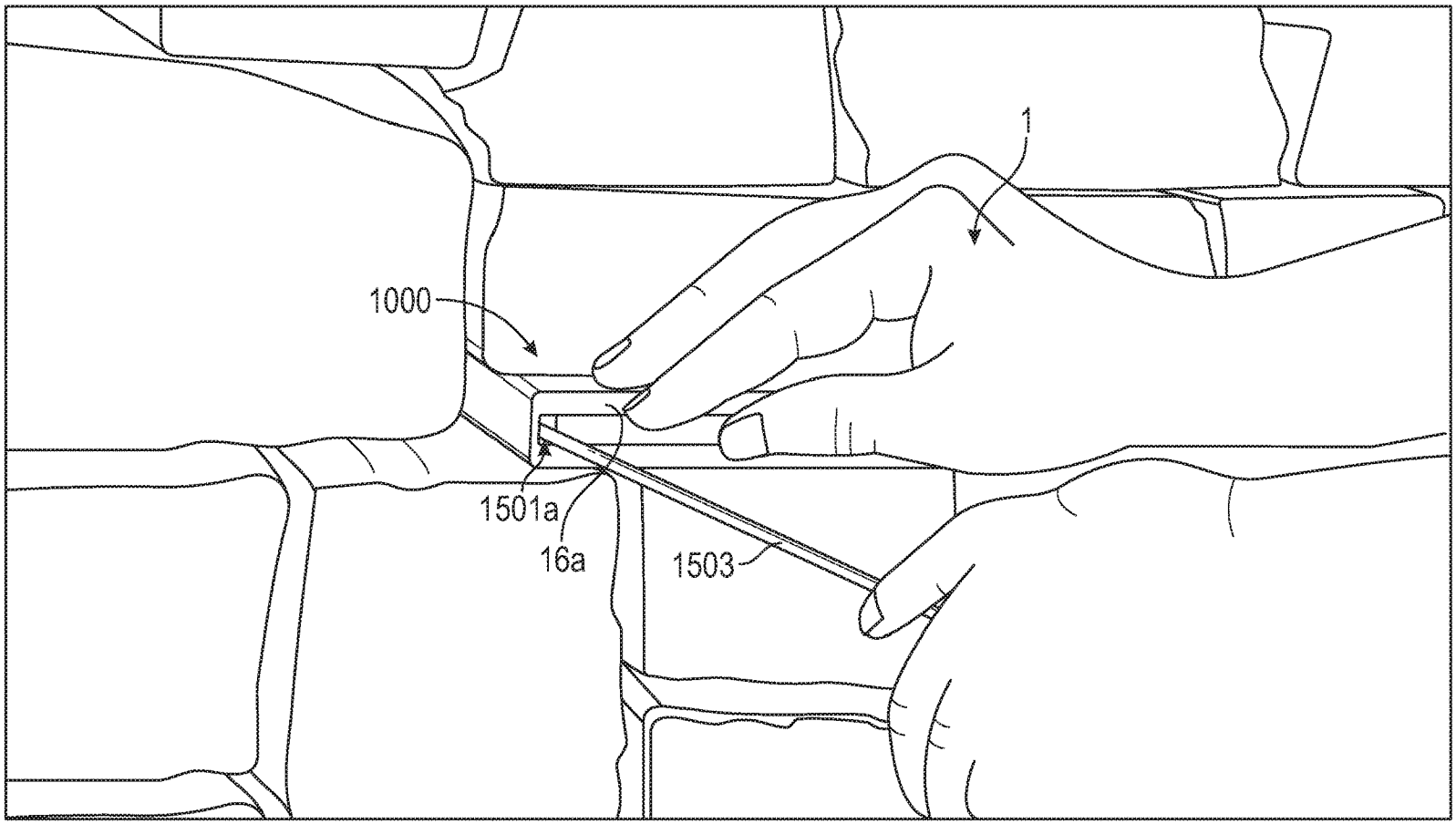
FIG. 18A is a first view of a user using the exemplary embodiment of FIG. 17.
Figure 18B:
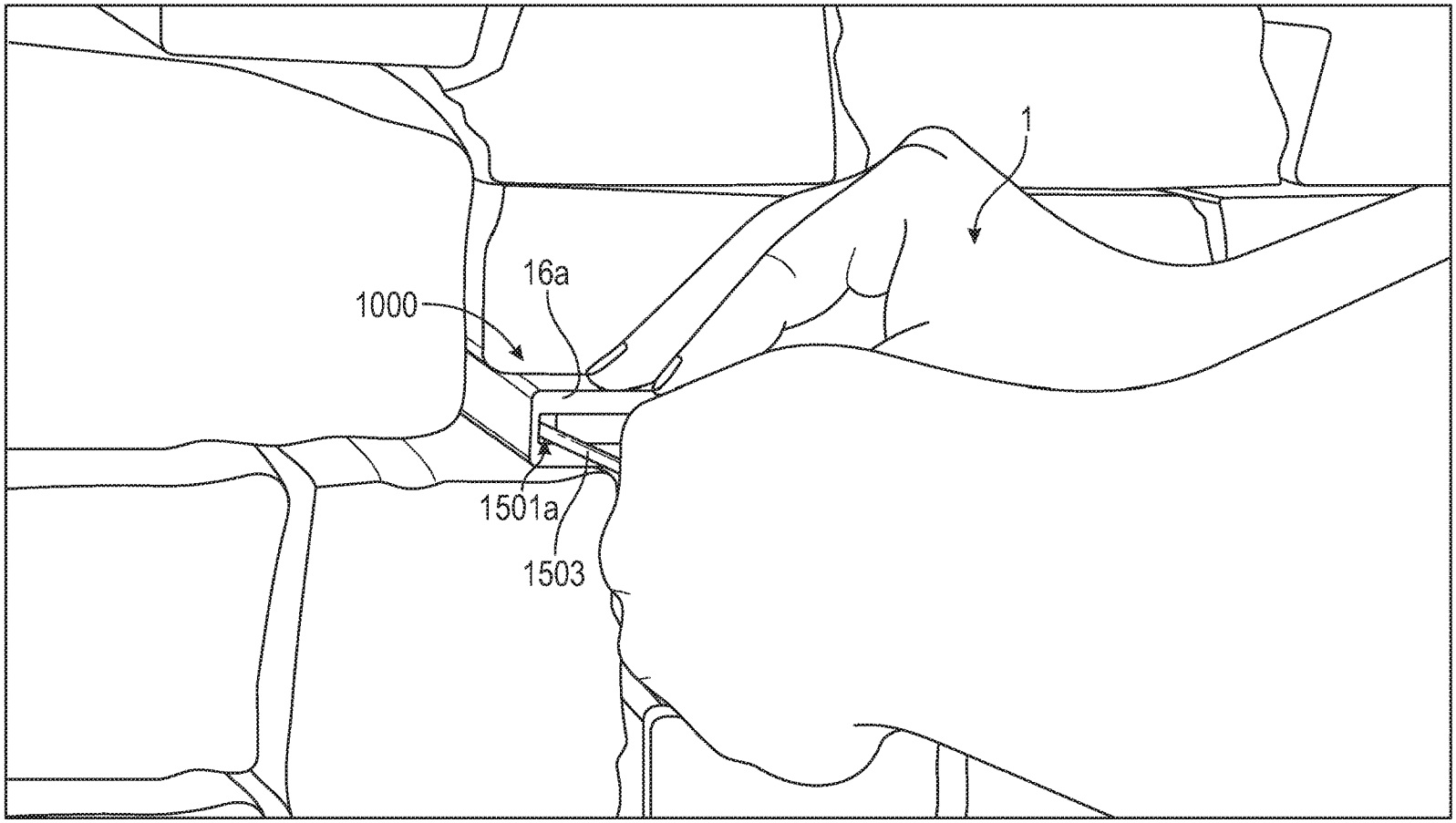
FIG. 18B is a second view of a user using the exemplary embodiment of FIG. 17.
Figure 18C:
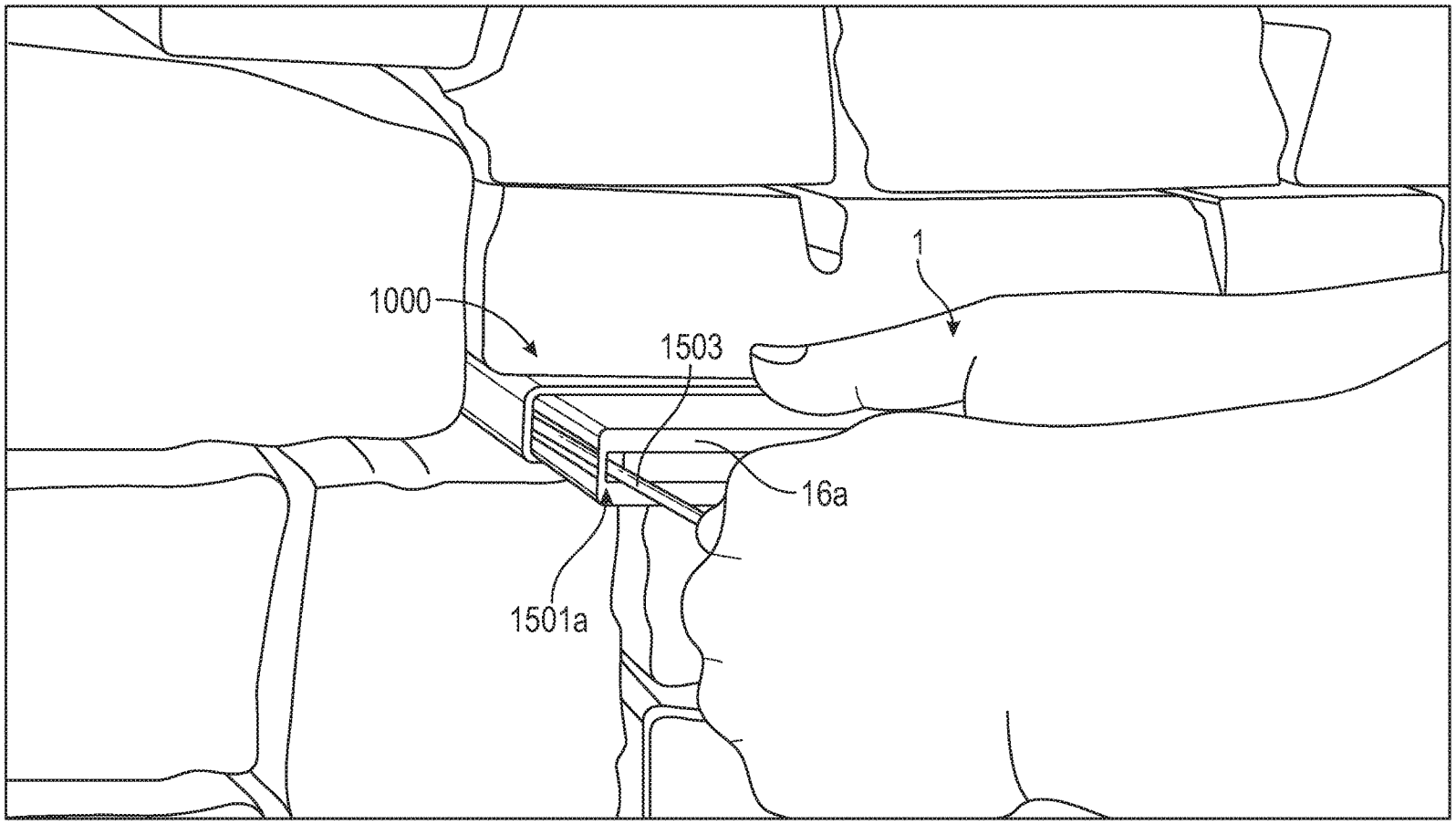
FIG. 18C is a third view of a user using the exemplary embodiment of FIG. 17.
Figure 18D:
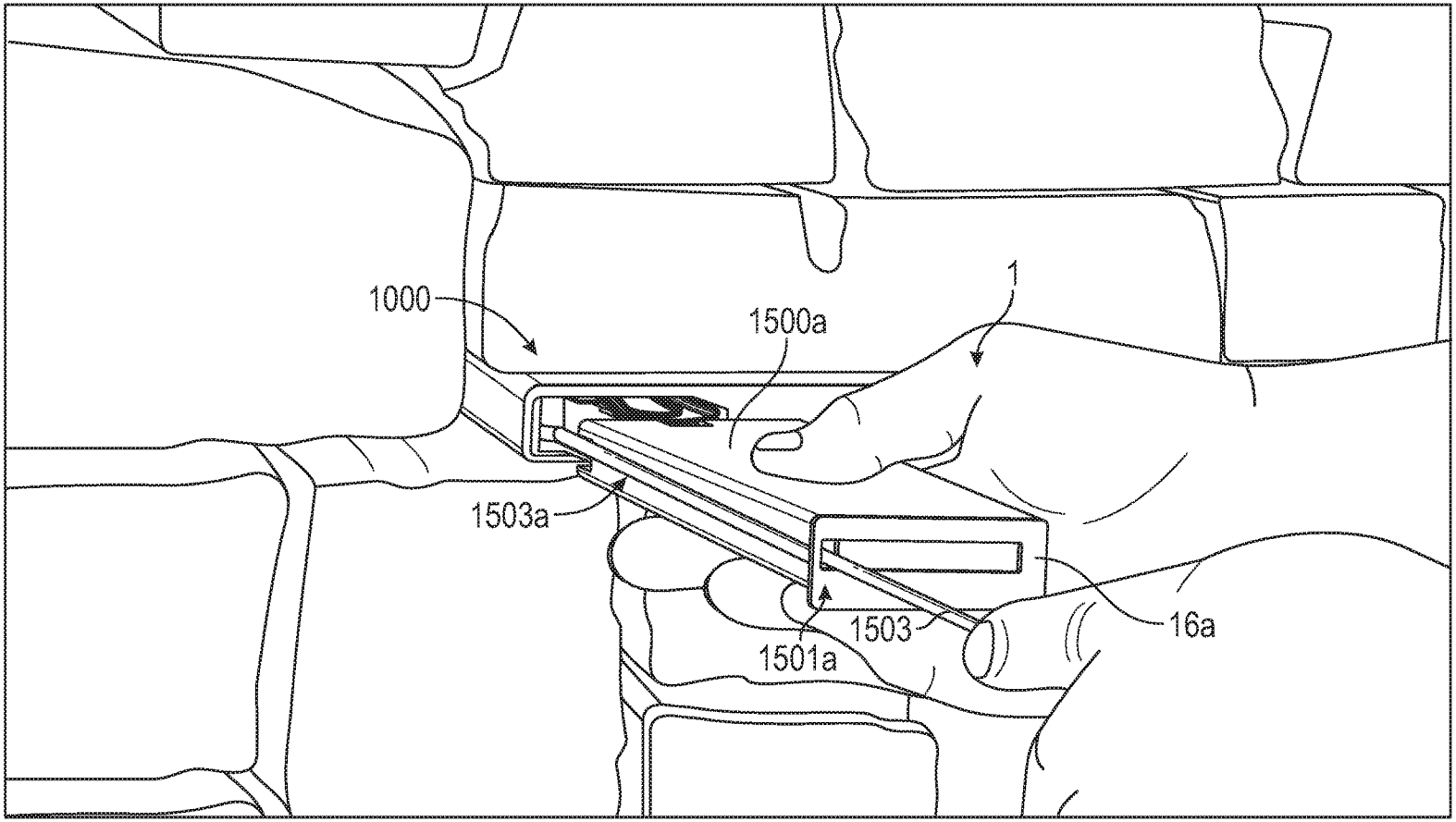
FIG. 18D is a fourth view of a user using the exemplary embodiment of FIG. 17.
Figure 18E:
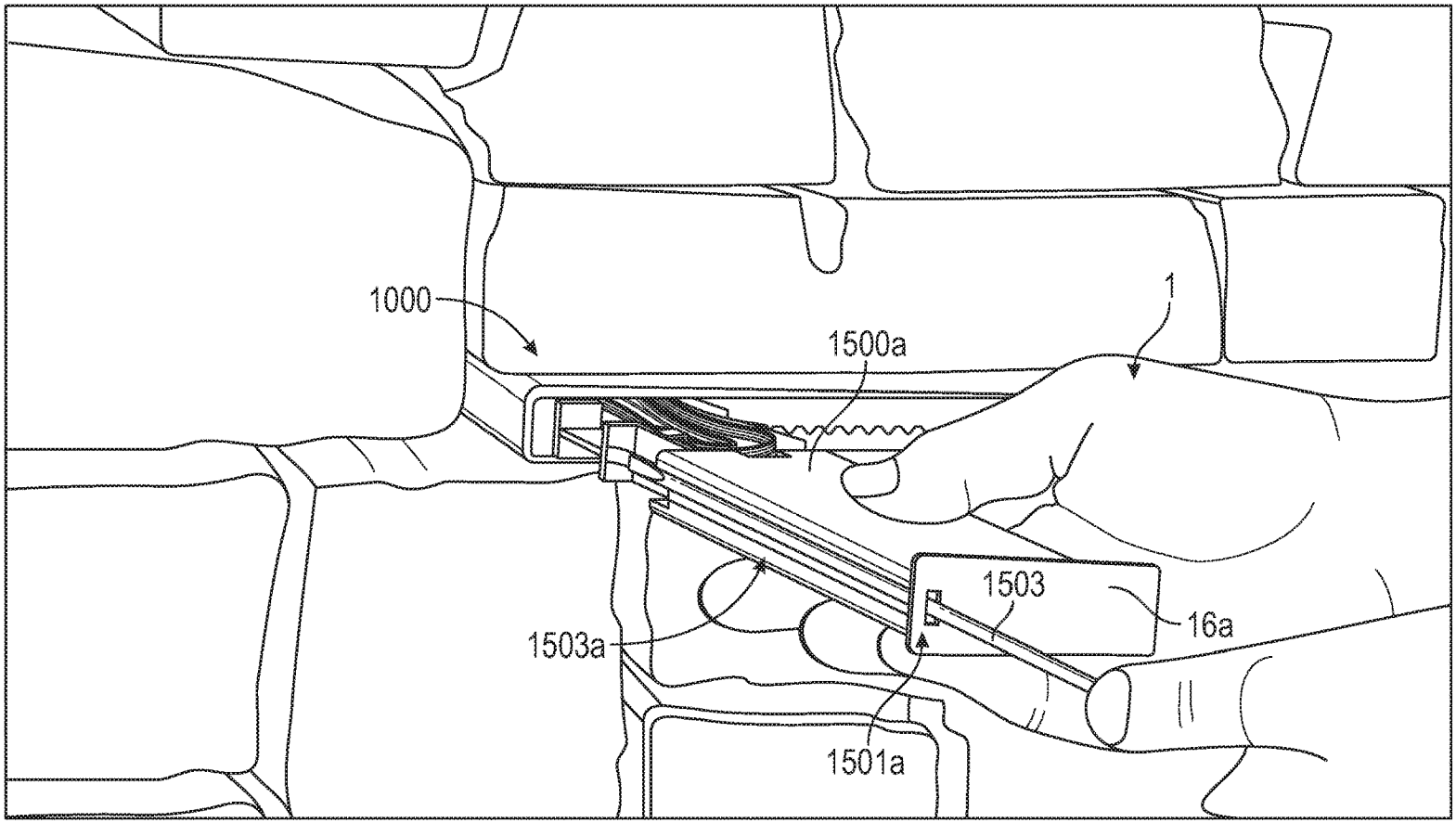
FIG. 18E is a fifth view of a user using the exemplary embodiment of FIG. 17.

In FIG. 18B, the user 1 fully inserts the long thin tool 2000 into the aperture 1501 and the long, thin groove 1503. In FIG. 18C, the user 1 begins pulling the port insertion structure 1500*a* out of the port half 1214*a* using the long thin tool 2000 by pushing in towards the long, thin groove 1503 and pulling out. In FIGS. 18D and 18E, the user 1 finished pulling the port insertion structure 1500*a* out of the port half 1214*a* as far as the exemplary slack from the power cord length management system 300 lets out. At this length of extension out of the port half 1214*a*, the end of the port insertion structure 1500*a* opposite the port door end 16*a* (configured to retain and cradle the connector component 22, for example) is exposed and slid out of the port half 1214*a*.

Figure 18F:
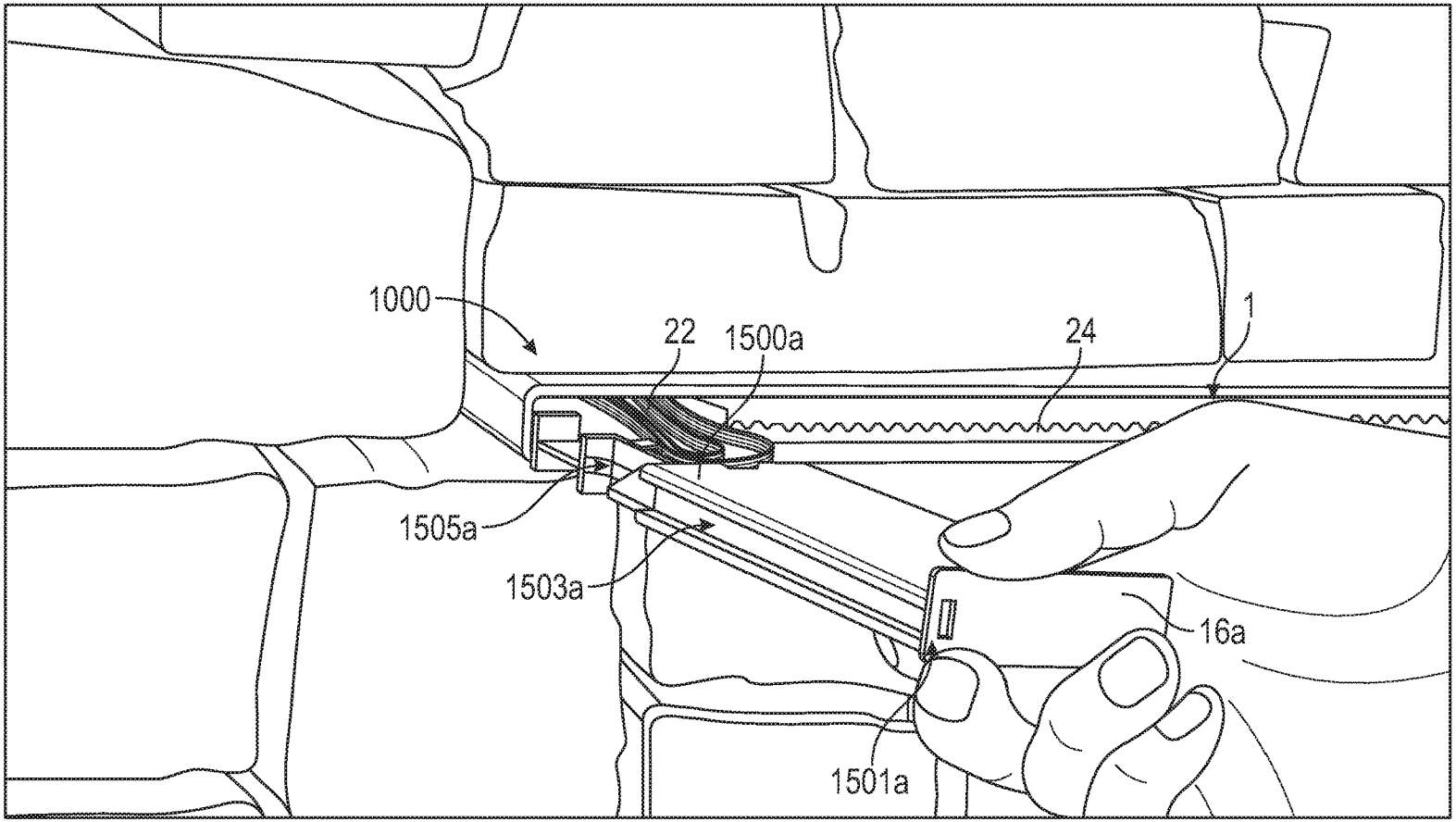
FIG. 18F is a sixth view of a user using the exemplary embodiment of FIG. 17.
Figure 18G:
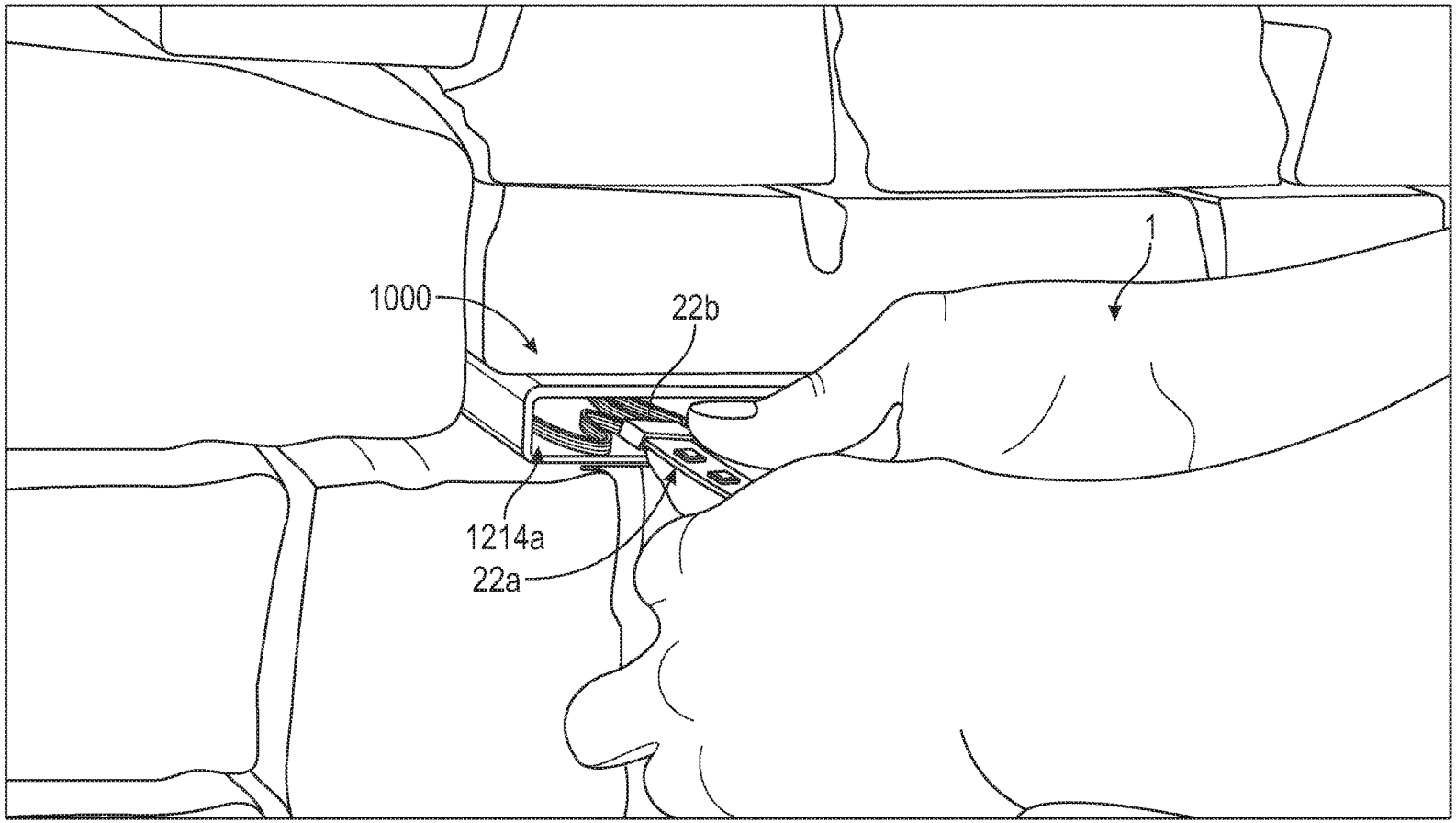
FIG. 18G is a seventh view of a user using the exemplary embodiment of FIG. 17.
Figure 18H:
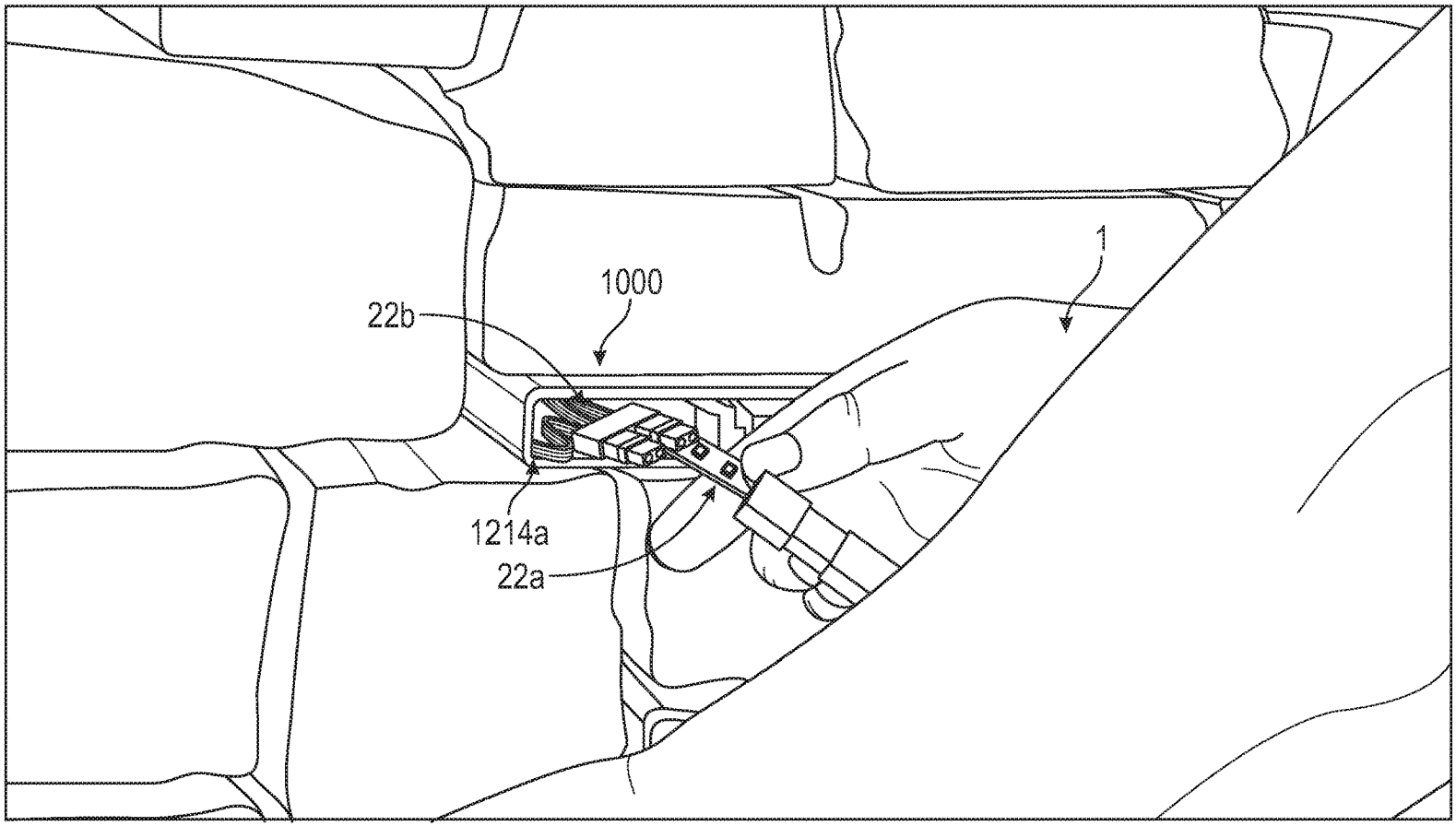
FIG. 18H is an eighth view of a user using the exemplary embodiment of FIG. 17.

In FIG. 18F, the user 1 finished pulling the long thin tool 2000 out of the long, thin groove 1503. In FIG. 18G, the user 1 uncradles the connector component off of the port insertion structure 1500*a* by popping it out of an exemplary embodiment of a cradle portion 1505*a* defined on the end of the port insertion structure 1500*a* opposite the port door end 16*a*. In FIGS. 18G-18H, the user 1 disconnects the strip connector component 22*a* from the unit connector component 22*b*. Once disconnected, the power cord cable 301 can retract slightly back into the port half 1214*a* while the strip connector component 22*a* end of the lighting unit 226 remains available for continued handling.

Figure 18I:
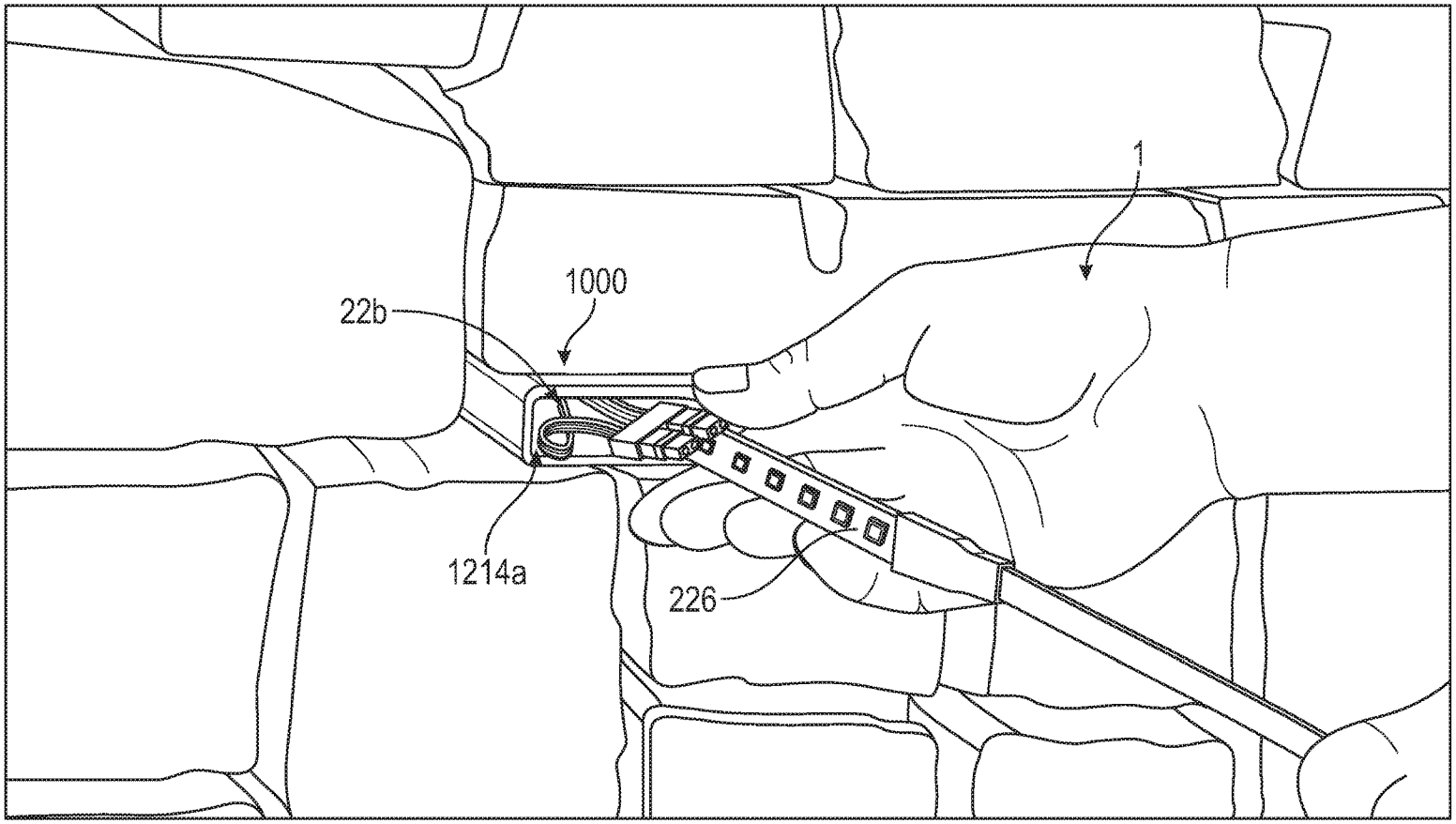
FIG. 18I is a ninth view of a user using the exemplary embodiment of FIG. 17.
Figure 18J:
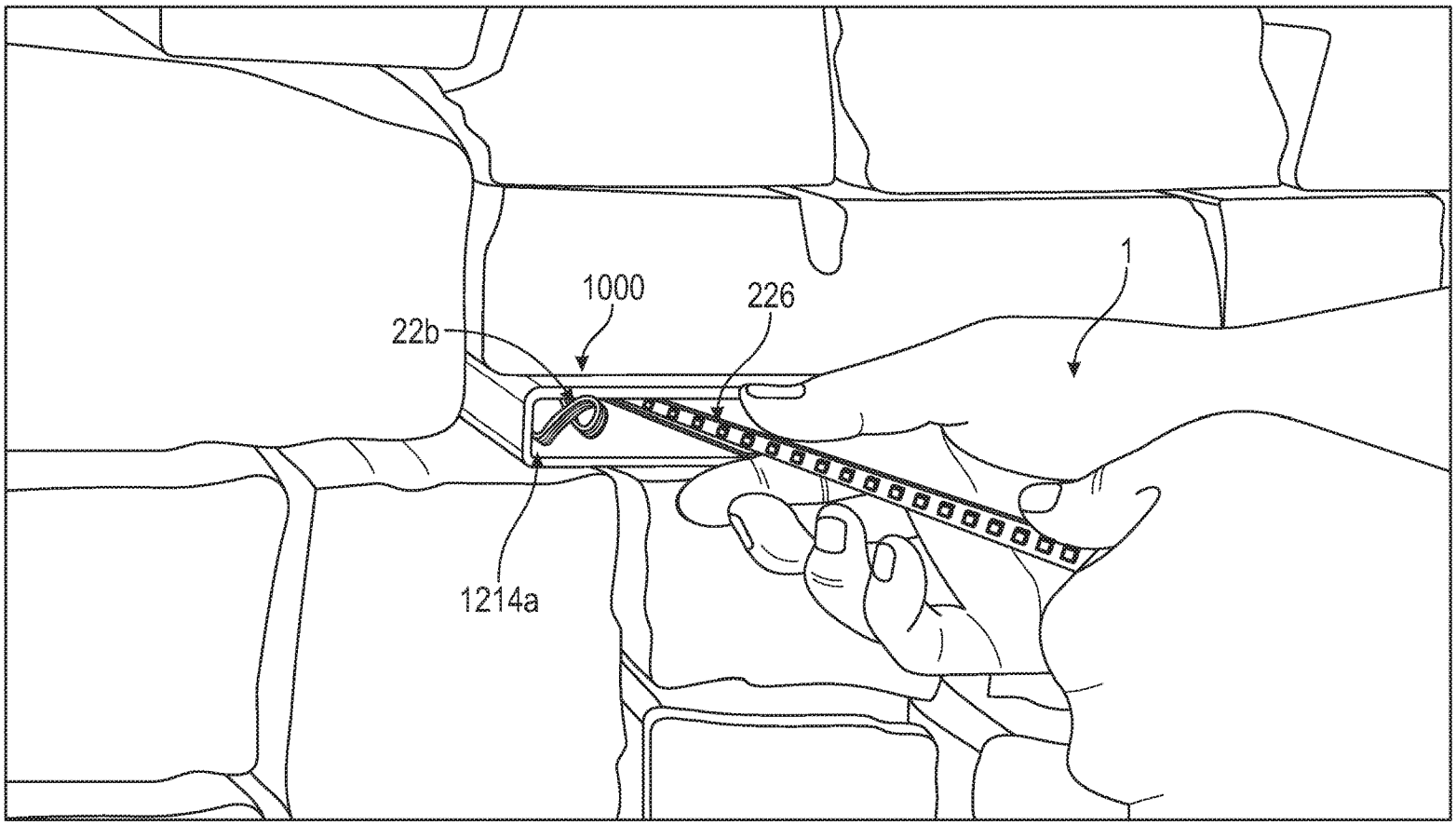
FIG. 18J is a tenth view of a user using the exemplary embodiment of FIG. 17.
Figure 18K:
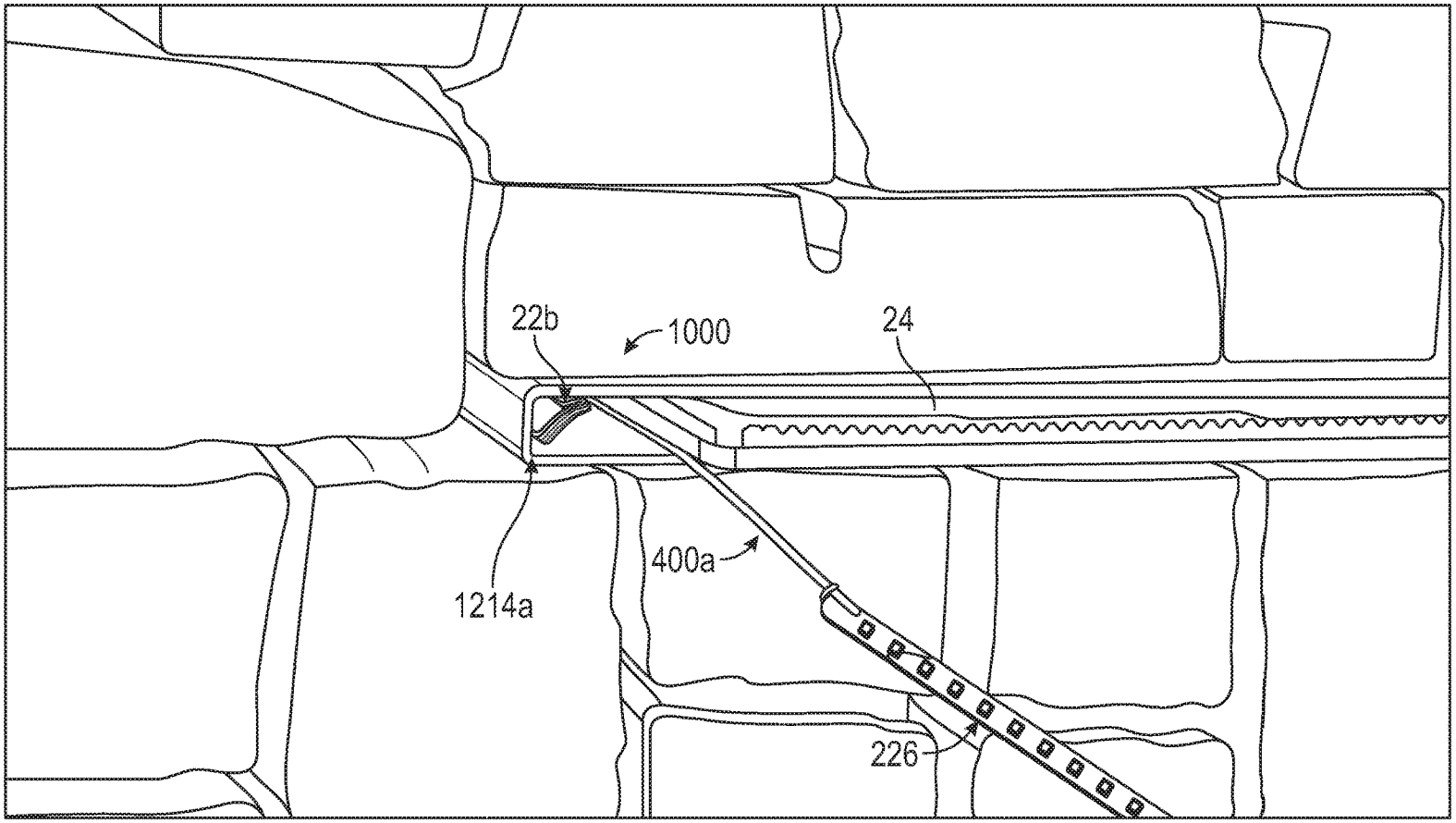
FIG. 18K is an eleventh view of a user using the exemplary embodiment of FIG. 17.
Figure 18L:
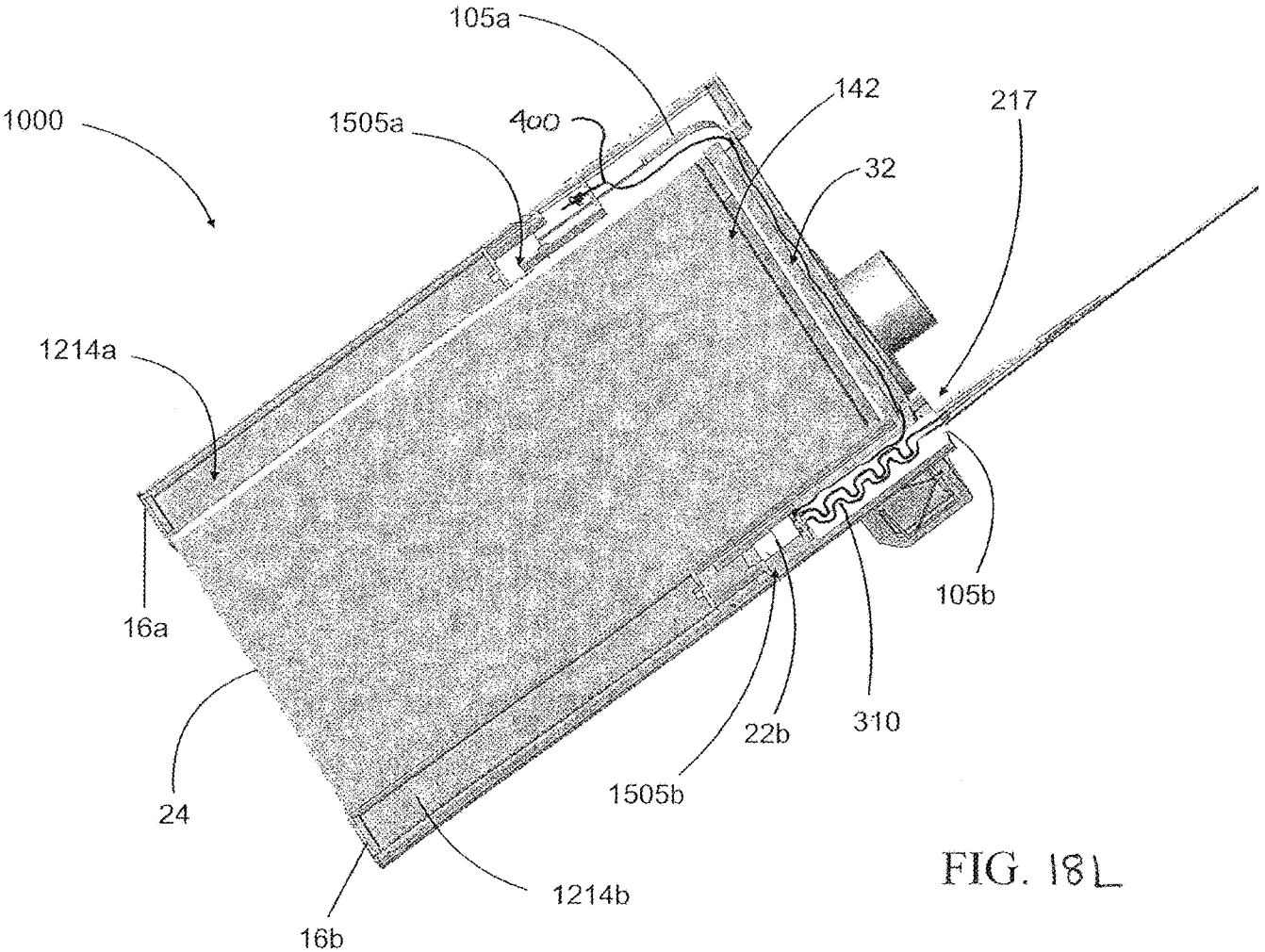
FIG. 18L is a right perspective cross section view of the exemplary embodiment of FIG. 17A through line 17B'-17B' to show cord and wire management.

In FIGS. 18I-18K, the user 1 pulls the lighting unit 226 out of the chamber 32 and the port half 1214*a* via the strip connector component end 22*a* of the lighting unit 226. As can be readily seen by a person having ordinary skill in the art, extraction of the lighting unit 226 does not alter the state of the power cord 301 while within the port 1214. Moreover, the lighting unit 226 remains engaged to the guide wire 400 when fully removed from the port 1214.

To complete installation or repair, as is described in greater detail herein, the user 1 may quickly and easily retrieve and extend out of port half 1214*a* the guide wire 400. The opposite end to the guide wire 400 seen in FIG. 18K, is conveniently attached to the port insertion structure 1500*b*. The user 1 may then quickly and easily attach the guide wire 400 to the new replacement lighting unit 226 via the wire eyelet 299 defined on the end opposite the strip connector component 22*a* (best seen in FIG. 16). The user 1 may then quickly and easily retrieve and extend out of port 1214*b* the guide wire 400. The user 1 may then pull the lighting unit 226, wire eyelet 299 end leading, through port 1214*a* into the chamber 32 by pulling the guide wire 400 from port half 1214*b* end. The user 1 may adjust the orientation and alignment of the lighting unit 226 as the lighting unit 226 is being inserted. The lighting unit 226 moving down port 214*a* interacts with the rounded, curved portion 105*a*, and then enters the chamber 32. The user 1 may hold the lighting unit 226 in the correct alignment for the chamber 32 while using the guide wire 400 to maintain the proper alignment of the lighting unit 226.

The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

LIST OF REFERENCE NUMERALS

1 user
10 first exemplary embodiment of lighted waterfall device
12 waterfall
14 port
16 port cover
18 means for lighting
20 LED strip
22 connector
24 waterfall slot
26 lighting unit
28 inlet
30 manifold
32 chamber
34 baffles
36 spreading area
38 serrated edge
40 lip
42 passage
44 front wall
46 top wall
48 rear wall
50 bottom wall
52 manifold section
54 port section
56 latch
58 LED
60 reflective material
100 second exemplary embodiment of lighted waterfall device
101 open face/recess
103 cutaway
105 rounded, curve portion
142 spreading manifold/area/passage
144 rear wall
146 front wall
148 bottom wall
150 top wall
200 third exemplary embodiment of lighted waterfall device
214 specialized port
217 opening
220 LED strip
226 lighting unit
258 LED
299 wire eyelet
300 power cord management system
310 retractable and extendable power cord
320 power cord bundle/spool
330 constriction component
340 power cord collar
400 pull-through system
500 internal port supports
1000 fourth exemplary embodiment of lighted waterfall device
1500 port insertion structure
1501 aperture
1503 long, thin groove corresponding to the tool 2000
1505 cradle portion
2000 long, thin port insertion structure tool

What is claimed is:

1. A waterfall apparatus for producing an artificial waterfall comprising:

a) a waterfall outlet for producing a waterfall, the waterfall outlet being on a front end of the waterfall apparatus, the waterfall outlet defined at least in part by a spreading manifold forming, at least in part, a spreading passage, the waterfall outlet terminating in a horizontal waterfall slot through which water emanates from the waterfall apparatus via the spreading passage, the waterfall slot also being on the front end of the waterfall apparatus and having a horizontal width relative to the front end;

b) a lighting unit;

c) a chamber for containing the lighting unit, wherein the chamber is substantially aligned on the same plane as, and laterally displaced from, the waterfall slot, the chamber having a horizontal width also relative to the front end and that is substantially the same as the waterfall slot width, and wherein the chamber is defined by at least one side that is located between the chamber and the spreading passage, the at least one side comprising a material that allows light from the lighting unit to act upon at least one of water flowing through the spreading manifold and water emanating from the waterfall slot; and d) a port to the chamber for accessing the lighting unit, wherein the port is located through and accessible from the front end of the waterfall apparatus, and wherein the port is separate from the waterfall slot whereby the chamber is not in fluid communication with the waterfall outlet and the waterfall slot.

2. The waterfall apparatus as claimed in claim 1, wherein the at least one side of the chamber is a material selected from the group consisting of clear, transparent, translucent, and semi-transparent materials.

3. The waterfall apparatus as claimed in claim 2, wherein the chamber is located at a position on the rear end of the waterfall apparatus, distal to the front end.

4. The waterfall apparatus as claimed in claim 2, wherein the lighting unit has a length that is substantially the same length as the chamber length.

5. The waterfall apparatus as claimed in claim 4, wherein the lighting unit has a connector that cooperates with a connector on the waterfall apparatus whereby the lighting unit can be connected to and disconnected from the connector on the waterfall apparatus for removing the lighting unit from the waterfall apparatus and installing a different lighting unit into the waterfall apparatus.

6. The waterfall apparatus as claimed in claim 5, wherein the lighting strip and the connector is accessible through the port.

7. The waterfall apparatus as claimed in claim 4, wherein the lighting unit is a strip of light emitting diodes.

8. The waterfall apparatus as claimed in claim 1, wherein the spreading manifold is located at a position on the waterfall apparatus proximal to and leading up to the waterfall slot at the front end of the waterfall apparatus such that the waterfall that emanates out of the waterfall slot flows over the spreading manifold, wherein the spreading manifold creates a waterfall flow pattern, whereby light is dispersed through the waterfall flow pattern.

9. The waterfall apparatus as claimed in claim 3, wherein the spreading manifold is located at a position on the waterfall apparatus proximal to and leading up to the waterfall slot at the front end of the waterfall apparatus such that the waterfall that emanates out of the waterfall slot flows over the spreading manifold, wherein the spreading manifold creates a waterfall flow pattern, whereby light is dispersed through the waterfall flow pattern.

10. The waterfall apparatus as claimed in claim 3, wherein the chamber is oriented to run parallel to the waterfall slot.

11. A waterfall apparatus for producing an artificial waterfall comprising:

a) a waterfall outlet for producing a waterfall, the waterfall outlet being on a front end of the waterfall apparatus, the waterfall outlet defined at least in part by a spreading manifold forming, at least in part, a spreading passage, the waterfall outlet terminating in a horizontal waterfall slot through which water emanates from the waterfall apparatus via the spreading passage, the waterfall slot also being on the front end of the waterfall apparatus and having a horizontal width relative to the front end;

b) a lighting unit;

c) a chamber for containing the lighting unit, wherein the chamber is substantially aligned on the same plane as, and laterally displaced from, the waterfall slot, the chamber having a horizontal width also relative to the front end and that is substantially the same as the waterfall slot width, wherein the chamber is defined by at least one side that is located between the chamber and the spreading passage, the at least one side comprising a material selected from the group consisting of clear, transparent, translucent, and semi-transparent materials, and wherein the lighting unit is aligned and oriented within the chamber to shine light, through the at least one side, directly onto, and parallel with, water flowing through the spreading manifold; and d) a port to the chamber for accessing the lighting unit, wherein the port is located through and accessible from the front end of the waterfall apparatus, and wherein the port is separate from the waterfall slot whereby the chamber is not in fluid communication with the waterfall outlet and the waterfall slot.

12. The waterfall apparatus as claimed in claim 11, wherein the chamber is located at a position on the rear end of the waterfall apparatus, distal to the front end.

13. The waterfall apparatus as claimed in claim 11, wherein the lighting unit has a length that is substantially the same length as the chamber length.

14. The waterfall apparatus as claimed in claim 13, wherein the lighting unit has a connector that cooperates with a connector on the waterfall apparatus whereby the lighting unit can be connected to and disconnected from the connector on the waterfall apparatus for removing the lighting unit from the waterfall apparatus and installing a different lighting unit into the waterfall apparatus.

15. The waterfall apparatus as claimed in claim 14, wherein the lighting strip and the connector is accessible through the port.

16. The waterfall apparatus as claimed in claim 11, wherein the spreading manifold is located at a position on the waterfall apparatus proximal to and leading up to the waterfall slot at the front end of the waterfall apparatus such that the waterfall that emanates out of the waterfall slot flows over the spreading manifold, wherein the spreading manifold creates a waterfall flow pattern, whereby light is dispersed through the waterfall flow pattern.

17. The waterfall apparatus as claimed in claim 11, wherein the chamber is oriented to run parallel to the waterfall slot.

18. A waterfall apparatus for producing an artificial waterfall comprising:

a) a waterfall outlet for producing a waterfall, the waterfall outlet being on a front end of the waterfall apparatus, the waterfall outlet defined at least in part by a spreading manifold forming, at least in part, a spreading passage, the waterfall outlet terminating in a horizontal waterfall slot through which water emanates from the waterfall apparatus via the spreading passage, the waterfall slot also being on the front end of the waterfall apparatus and having a horizontal width relative to the front end;

b) a lighting unit;

c) a chamber for containing the lighting unit, wherein the chamber is substantially aligned on the same plane as, and laterally displaced from, the waterfall slot, the chamber having a horizontal width also relative to the front end and that is substantially the same as the waterfall slot width, wherein the chamber is defined by at least one side that is located between the chamber and the spreading passage, the at least one side comprising a material selected from the group consisting of clear, transparent, translucent, and semi-transparent materials, wherein the chamber is also defined by the remaining sides comprising a material selected from the group consisting of opaque or reflective materials, and wherein the lighting unit is aligned and oriented within the chamber to shine light, through the at least one side, directly onto, and parallel with, water flowing through the spreading manifold; and d) a port to the chamber for accessing the lighting unit, wherein the port is located through and accessible from the front end of the waterfall apparatus, and wherein the port is separate from the waterfall slot whereby the chamber is not in fluid communication with the waterfall outlet and the waterfall slot.

19. The waterfall apparatus as claimed in claim 18, wherein:

the chamber is located at a position on the rear end of the waterfall apparatus, distal to the front end;

the lighting unit has a length that is substantially the same length as the chamber length; and the chamber is oriented to run parallel to the waterfall slot.

20. The waterfall apparatus as claimed in claim 19, wherein the spreading manifold is located at a position on the waterfall apparatus proximal to and leading up to the waterfall slot at the front end of the waterfall apparatus such that the waterfall that emanates out of the waterfall slot flows over the spreading manifold, wherein the spreading manifold creates a waterfall flow pattern, whereby light is dispersed through the waterfall flow pattern.

* * * * *